US009630180B2

(12) United States Patent
Srinivasan et al.

(10) Patent No.: US 9,630,180 B2
(45) Date of Patent: Apr. 25, 2017

(54) DROPLET ACTUATOR CONFIGURATIONS AND METHODS OF CONDUCTING DROPLET OPERATIONS

(71) Applicant: ADVANCED LIQUID LOGIC, INC., San Diego, CA (US)

(72) Inventors: Vijay Srinivasan, San Diego, CA (US); Michael G. Pollack, San Diego, CA (US); Vamsee K. Pamula, Cary, NC (US); Zhishan Hua, Oceanside, CA (US); Arjun Sudarsan, Carlsbad, CA (US); Philip Y. Paik, Chula Vista, CA (US)

(73) Assignee: ADVANCED LIQUID LOGIC, INC., Morrisville, NC (US)

( * ) Notice: Subject to any disclaimer, the term of this patent is extended or adjusted under 35 U.S.C. 154(b) by 0 days.

(21) Appl. No.: 14/590,470

(22) Filed: Jan. 6, 2015

(65) Prior Publication Data

US 2015/0174578 A1 Jun. 25, 2015

Related U.S. Application Data

(63) Continuation of application No. 12/682,830, filed as application No. PCT/US2008/088205 on Dec. 23, 2008, now abandoned.

(Continued)

(51) Int. Cl.
*B01L 3/00* (2006.01)
*B01F 13/00* (2006.01)

(Continued)

(52) U.S. Cl.
CPC ..... *B01L 3/52* (2013.01); *B01F 13/0071* (2013.01); *B01F 13/0076* (2013.01);

(Continued)

(58) Field of Classification Search
CPC ..... B01L 3/502784; B01L 3/502792; B01L 2400/0415

(Continued)

(56) References Cited

U.S. PATENT DOCUMENTS 4,127,460 A 11/1978 Gaske et al.
4,244,693 A 1/1981 Guon (Continued)

FOREIGN PATENT DOCUMENTS

JP 2006078225 A 3/2006
JP 2006317364 A 11/2006

(Continued)

OTHER PUBLICATIONS

Chakrabarty, "Automated Design of Microfluidics-Based Biochips: connecting Biochemistry of Electronics CAD", IEEE International Conference on Computer Design, San Jose, CA, Oct. 1-4, 2006, 93-100.

(Continued)

*Primary Examiner* — Brian R Gordon
(74) *Attorney, Agent, or Firm* — Dean D. Small; The Small Patent Law Group, LLC

(57) ABSTRACT

A droplet actuator with a droplet formation electrode configuration associated with a droplet operations surface, wherein the electrode configuration may include one or more electrodes configured to control volume of a droplet during formation of a sub-droplet on the droplet operations surface. Methods of making and using the droplet actuator are also provided.

20 Claims, 18 Drawing Sheets

Related U.S. Application Data

(60) Provisional application No. 61/016,618, filed on Dec. 26, 2007, provisional application No. 61/016,480, filed on Dec. 23, 2007.

(51) Int. Cl.
*F04B 19/00* (2006.01)
*B01L 3/02* (2006.01)

(52) U.S. Cl.
CPC ..... *B01L 3/502792* (2013.01); *F04B 19/006* (2013.01); *B01L 3/0241* (2013.01); *B01L 2200/027* (2013.01); *B01L 2200/0605* (2013.01); *B01L 2200/143* (2013.01); *B01L 2200/16* (2013.01); *B01L 2300/089* (2013.01); *B01L 2300/0816* (2013.01); *B01L 2300/0819* (2013.01); *B01L 2400/0427* (2013.01); *B01L 2400/06* (2013.01); *B01L 2400/0688* (2013.01)

(58) Field of Classification Search
USPC ..... 422/501–502; 204/600–604, 450–453
See application file for complete search history.

(56) References Cited

U.S. PATENT DOCUMENTS 4,636,785 A 1/1987 Le Pesant
5,038,852 A 8/1991 Johnson et al.
5,176,203 A 1/1993 Larzul
5,181,016 A 1/1993 Lee et al.
5,225,332 A 7/1993 Weaver et al.
5,266,498 A 11/1993 Tarcha et al.
5,455,008 A 10/1995 Earley et al.
5,472,881 A 12/1995 Beebe et al.
5,486,337 A 1/1996 Ohkawa et al.
5,498,392 A 3/1996 Wilding et al.
5,720,923 A 2/1998 Haff et al.
5,779,977 A 7/1998 Haff et al.
5,817,526 A 10/1998 Kinoshita et al.
5,827,480 A 10/1998 Haff et al.
5,945,281 A 8/1999 Prabhu et al.
5,998,224 A 12/1999 Rohr et al.
6,013,531 A 1/2000 Wang et al.
6,033,880 A 3/2000 Haff et al.
6,063,339 A 5/2000 Tisone et al.
6,130,098 A 10/2000 Handique et al.
6,152,181 A 11/2000 Wapner et al.
6,180,372 B1 1/2001 Franzen
6,294,063 B1 9/2001 Becker et al.
6,319,668 B1 11/2001 Nova et al.
6,453,928 B1 9/2002 Kaplan et al.
6,461,570 B2 10/2002 Ishihara et al.
6,548,311 B1 4/2003 Knoll
6,565,727 B1 * 5/2003 Shenderov ..... B01F 13/0071 204/600
6,632,655 B1 10/2003 Mehta et al.
6,673,533 B1 1/2004 Wohlstadter et al.
6,673,620 B1 * 1/2004 Loeffler et al. ..... 436/46
6,734,436 B2 5/2004 Faris et al.
6,773,566 B2 8/2004 Shenderov
6,790,011 B1 9/2004 Le Pesant et al.
6,841,128 B2 1/2005 Kambara et al.
6,846,638 B2 1/2005 Shipwash
6,911,132 B2 6/2005 Pamula et al.
6,924,792 B1 8/2005 Jessop
6,955,881 B2 10/2005 Tanaami
6,977,033 B2 12/2005 Becker et al.
6,989,234 B2 1/2006 Kolar et al.
6,995,024 B2 2/2006 Smith et al.
7,052,244 B2 5/2006 Fouillet et al.
7,163,612 B2 1/2007 Sterling et al.
7,211,223 B2 5/2007 Fouillet et al.
7,211,442 B2 5/2007 Gilbert et al.
7,255,780 B2 8/2007 Shenderov
7,267,752 B2 9/2007 King et al.
7,328,979 B2 2/2008 Decre et al.
7,329,545 B2 2/2008 Pamula et al.
7,438,860 B2 10/2008 Takagi et al.
7,439,014 B2 10/2008 Pamula et al.
7,458,661 B2 12/2008 Kim et al.
7,495,031 B2 2/2009 Sakuma et al.
7,531,072 B2 5/2009 Roux et al.
7,547,380 B2 6/2009 Velev
7,556,776 B2 7/2009 Fraden et al.
7,569,129 B2 8/2009 Pamula et al.
7,579,172 B2 8/2009 Cho et al.
7,641,779 B2 1/2010 Becker et al.
7,727,466 B2 6/2010 Meathrel et al.
7,727,723 B2 6/2010 Pollack et al.
7,759,132 B2 7/2010 Pollack et al.
7,763,471 B2 7/2010 Pamula et al.
7,767,147 B2 * 8/2010 Adachi et al. ..... 422/63
7,767,435 B2 8/2010 Chiu et al.
7,815,871 B2 10/2010 Pamula et al.
7,816,121 B2 10/2010 Pollack et al.
7,822,510 B2 10/2010 Paik et al.
7,851,184 B2 12/2010 Pollack et al.
7,875,160 B2 1/2011 Jary
7,901,947 B2 3/2011 Pollack et al.
7,919,330 B2 4/2011 De Guzman et al.
7,922,886 B2 4/2011 Fouillet et al.
7,939,021 B2 5/2011 Smith et al.
7,943,030 B2 5/2011 Shenderov
7,989,056 B2 8/2011 Plissonnier et al.
7,998,436 B2 8/2011 Pollack
8,007,739 B2 8/2011 Pollack et al.
8,041,463 B2 10/2011 Pollack et al.
8,048,628 B2 11/2011 Pollack et al.
8,075,754 B2 12/2011 Sauter-Starace et al.
8,088,578 B2 1/2012 Hua et al.
8,093,062 B2 1/2012 Winger et al.
8,093,064 B2 1/2012 Shah et al.
8,137,917 B2 3/2012 Pollack et al.
8,147,668 B2 4/2012 Pollack et al.
8,179,216 B2 5/2012 Knospe
8,202,686 B2 6/2012 Pamula et al.
8,208,146 B2 6/2012 Srinivasan et al.
8,221,605 B2 7/2012 Pollack et al.
8,236,156 B2 8/2012 Sarrut et al.
8,268,246 B2 9/2012 Srinivasan et al.
8,287,711 B2 10/2012 Pollack et al.
8,292,798 B2 10/2012 Califorrniaa
8,304,253 B2 11/2012 Yi et al.
8,313,698 B2 11/2012 Pollack et al.
8,317,990 B2 11/2012 Pamula et al.
8,337,778 B2 12/2012 Stone et al.
8,342,207 B2 1/2013 Raccurt et al.
8,349,276 B2 1/2013 Pamula et al.
8,364,315 B2 1/2013 Sturmer et al.
8,388,909 B2 3/2013 Pollack et al.
8,389,297 B2 3/2013 Pamula et al.
8,394,249 B2 3/2013 Pollack et al.
8,426,213 B2 4/2013 Eckhardt et al.
8,440,392 B2 5/2013 Pamula et al.
8,444,836 B2 5/2013 Fouillet et al.
9,266,076 B2 * 2/2016 Kim ..... B01F 13/0076
2002/0001544 A1 1/2002 Hess et al.
2002/0005354 A1 1/2002 Spence et al.
2002/0036139 A1 3/2002 Becker et al.
2002/0043463 A1 4/2002 Shenderov
2002/0058332 A1 5/2002 Quake et al.
2002/0143437 A1 10/2002 Handique et al.
2003/0007898 A1 1/2003 Bohm et al.
2003/0049177 A1 3/2003 Smith et al.
2003/0164295 A1 9/2003 Sterling
2003/0183525 A1 * 10/2003 Elrod ..... B01F 5/0085 506/32
2003/0205632 A1 11/2003 Kim et al.
2004/0031688 A1 2/2004 Shenderov
2004/0055871 A1 3/2004 Walton et al.
2004/0055891 A1 3/2004 Pamula et al.
2004/0058450 A1 3/2004 Pamula et al.
2004/0086870 A1 5/2004 Tyvoll et al.
2004/0101445 A1 5/2004 Shvets et al.

(56) References Cited

U.S. PATENT DOCUMENTS

2004/0180346 A1 9/2004 Anderson et al.
2004/0209376 A1 10/2004 Natan et al.
2004/0211659 A1 10/2004 Velev
2004/0231987 A1 11/2004 Sterling et al.
2005/0056569 A1 3/2005 Yuan et al.
2005/0189049 A1 9/2005 Ohno et al.
2005/0227349 A1 10/2005 Kim et al.
2005/0282224 A1 12/2005 Fouillet et al.
2006/0021875 A1 2/2006 Griffith et al.
2006/0039823 A1 2/2006 Yamakawa et al.
2006/0040375 A1 2/2006 Arney et al.
2006/0054503 A1 3/2006 Pamula et al.
2006/0097155 A1 5/2006 Adachi et al.
2006/0102477 A1 5/2006 Vann et al.
2006/0164490 A1 7/2006 Kim et al.
2006/0194331 A1 8/2006 Pamula et al.
2006/0210443 A1 9/2006 Stearns et al.
2006/0231398 A1* 10/2006 Sarrut et al. ..... 204/450
2007/0023292 A1 2/2007 Kim et al.
2007/0037294 A1 2/2007 Pamula et al.
2007/0045117 A1 3/2007 Pamula et al.
2007/0064990 A1 3/2007 Roth
2007/0075922 A1 4/2007 Jessop
2007/0086927 A1* 4/2007 Natarajan ..... G01N 13/04 422/502
2007/0179641 A1 8/2007 Lucas et al.
2007/0202538 A1 8/2007 Glezer et al.
2007/0207513 A1 9/2007 Sorensen et al.
2007/0217956 A1 9/2007 Pamula et al.
2007/0241068 A1 10/2007 Pamula et al.
2007/0242105 A1 10/2007 Srinivasan et al.
2007/0242111 A1 10/2007 Pamula et al.
2007/0243634 A1 10/2007 Pamula et al.
2007/0267294 A1 11/2007 Shenderov
2007/0275415 A1 11/2007 Srinivasan et al.
2008/0003142 A1 1/2008 Link et al.
2008/0003588 A1 1/2008 Hasson et al.
2008/0006535 A1 1/2008 Paik et al.
2008/0023330 A1 1/2008 Viovy
2008/0038810 A1 2/2008 Pollack et al.
2008/0044893 A1 2/2008 Pollack et al.
2008/0044914 A1 2/2008 Pamula et al.
2008/0050834 A1 2/2008 Pamula et al.
2008/0053205 A1 3/2008 Pollack et al.
2008/0105549 A1 5/2008 Pamela et al.
2008/0113081 A1 5/2008 Hossainy et al.
2008/0124252 A1 5/2008 Marchand et al.
2008/0142376 A1* 6/2008 Fouillet ..... B01L 3/502792 205/775
2008/0151240 A1 6/2008 Roth
2008/0166793 A1 7/2008 Beer et al.
2008/0210558 A1* 9/2008 Sauter-Starace .... B01L 3/50273 204/450
2008/0247920 A1 10/2008 Pollack et al.
2008/0264797 A1 10/2008 Pamula et al.
2008/0274513 A1 11/2008 Shenderov et al.
2008/0281471 A1 11/2008 Smith et al.
2008/0283414 A1 11/2008 Monroe et al.
2008/0302431 A1 12/2008 Marchand et al.
2008/0305481 A1 12/2008 Whitman et al.
2009/0014394 A1 1/2009 Yi et al.
2009/0042319 A1 2/2009 De Guzman et al.
2009/0053726 A1 2/2009 Owen et al.
2009/0127123 A1 5/2009 Raccurt et al.
2009/0134027 A1 5/2009 Jary
2009/0142564 A1 6/2009 Plissonnier et al.
2009/0155902 A1 6/2009 Pollack et al.
2009/0192044 A1 7/2009 Fouillet
2009/0260988 A1 10/2009 Pamula et al.
2009/0263834 A1 10/2009 Sista et al.
2009/0280251 A1 11/2009 De Guzman et al.
2009/0280475 A1 11/2009 Pollack et al.
2009/0280476 A1 11/2009 Srinivasan et al.
2009/0283407 A1 11/2009 Shah et al.
2009/0288710 A1 11/2009 Viovy et al.
2009/0291433 A1 11/2009 Pollack et al.
2009/0304944 A1* 12/2009 Sudarsan ..... B01F 13/0071 427/458
2009/0311713 A1 12/2009 Pollack et al.
2009/0321262 A1 12/2009 Adachi et al.
2010/0025242 A1 2/2010 Pamula et al.
2010/0025250 A1 2/2010 Pamula et al.
2010/0028920 A1 2/2010 Eckhardt
2010/0032293 A1 2/2010 Pollack et al.
2010/0041086 A1 2/2010 Pamula et al.
2010/0048410 A1 2/2010 Shenderov et al.
2010/0062508 A1 3/2010 Pamula et al.
2010/0068764 A1 3/2010 Sista et al.
2010/0087012 A1 4/2010 Shenderov et al.
2010/0096266 A1* 4/2010 Kim ..... B01F 13/0071 204/451
2010/0116640 A1 5/2010 Pamula et al.
2010/0118307 A1 5/2010 Srinivasan et al.
2010/0120130 A1* 5/2010 Srinivasan ..... B01F 13/0071 435/283.1
2010/0126860 A1 5/2010 Srinivasan et al.
2010/0130369 A1 5/2010 Shenderov et al.
2010/0140093 A1 6/2010 Pamula et al.
2010/0143963 A1 6/2010 Pollack
2010/0151439 A1 6/2010 Pamula et al.
2010/0194408 A1 8/2010 Sturmer et al.
2010/0221713 A1 9/2010 Pollack et al.
2010/0236927 A1 9/2010 Pope et al.
2010/0236928 A1 9/2010 Srinivasan et al.
2010/0236929 A1 9/2010 Pollack et al.
2010/0258441 A1 10/2010 Sista et al.
2010/0270156 A1 10/2010 Srinivasan et al.
2010/0279374 A1 11/2010 Sista et al.
2010/0282608 A1* 11/2010 Srinivasan ..... B01L 3/502792 204/450
2010/0282609 A1* 11/2010 Pollack ..... B01L 3/5027 204/450
2010/0291578 A1 11/2010 Pollack et al.
2010/0307917 A1 12/2010 Srinivasan et al.
2010/0320088 A1 12/2010 Fouillet et al.
2010/0323405 A1 12/2010 Pollack et al.
2011/0076692 A1 3/2011 Sista et al.
2011/0086377 A1 4/2011 Thwar et al.
2011/0091989 A1 4/2011 Sista et al.
2011/0097763 A1 4/2011 Pollack et al.
2011/0100823 A1 5/2011 Pollack et al.
2011/0104725 A1 5/2011 Pamula et al.
2011/0104747 A1 5/2011 Pollack et al.
2011/0104816 A1 5/2011 Pollack et al.
2011/0114490 A1 5/2011 Pamula et al.
2011/0118132 A1 5/2011 Winger et al.
2011/0180571 A1 7/2011 Srinivasan et al.
2011/0186433 A1 8/2011 Pollack et al.
2011/0203930 A1 8/2011 Pamula et al.
2011/0209998 A1 9/2011 Shenderov
2011/0213499 A1 9/2011 Sturmer et al.
2011/0303542 A1 12/2011 Srinivasan et al.
2011/0311980 A1 12/2011 Pollack et al.
2012/0018306 A1 1/2012 Srinivasan et al.
2012/0132528 A1 5/2012 Shenderov et al.
2012/0165238 A1 6/2012 Pamula et al.
2013/0059366 A1 3/2013 Pollack et al.
2013/0217583 A1 8/2013 Link et al.
2013/0280131 A1 10/2013 Handique et al.

FOREIGN PATENT DOCUMENTS

JP 2006329899 A 12/2006
JP 2006329904 A 12/2006
JP 2008096590 A 4/2008
KR 10-2005-0071505 A 7/2005
WO 0069565 A1 11/2000
WO 0073655 A1 12/2000
WO 2004011938 A2 2/2004
WO 2004029585 A1 4/2004
WO 2004030820 4/2004
WO 2004073863 A2 9/2004
WO 2005047696 A1 5/2005

(56) References Cited

FOREIGN PATENT DOCUMENTS

| | | | |
|---|---|---|---|
| WO | 2005069015 | A1 | 7/2005 |
| WO | 2006003292 | A1 | 1/2006 |
| WO | 2006013303 | A1 | 2/2006 |
| WO | 2006070162 | A1 | 7/2006 |
| WO | 2006076390 | A1 | 7/2006 |
| WO | 2006081558 | | 8/2006 |
| WO | 2006085905 | A1 | 8/2006 |
| WO | 2006124458 | A2 | 11/2006 |
| WO | 2006127451 | A2 | 11/2006 |
| WO | 2006129486 | A1 | 12/2006 |
| WO | 2006132211 | A1 | 12/2006 |
| WO | 2006134307 | A1 | 12/2006 |
| WO | 2006138543 | | 12/2006 |
| WO | 2007003720 | A1 | 1/2007 |
| WO | 2007012638 | A1 | 2/2007 |
| WO | 2007033990 | A1 | 3/2007 |
| WO | 2007048111 | | 4/2007 |
| WO | 2007120240 | A2 | 10/2007 |
| WO | 2007120241 | A2 | 10/2007 |
| WO | 2007123908 | A2 | 11/2007 |
| WO | 2008051310 | A2 | 5/2008 |
| WO | 2008055256 | A3 | 5/2008 |
| WO | 2008068229 | A1 | 6/2008 |
| WO | 2008091848 | A2 | 7/2008 |
| WO | 2008098236 | A2 | 8/2008 |
| WO | 2008101194 | A2 | 8/2008 |
| WO | 2008106678 | A1 | 9/2008 |
| WO | 2008109664 | A1 | 9/2008 |
| WO | 2008112856 | A1 | 9/2008 |
| WO | 2008116209 | A1 | 9/2008 |
| WO | 2008116221 | A1 | 9/2008 |
| WO | 2008118831 | A2 | 10/2008 |
| WO | 2008124846 | A2 | 10/2008 |
| WO | 2008131420 | A2 | 10/2008 |
| WO | 2008134153 | A1 | 11/2008 |
| WO | 2009002920 | A1 | 12/2008 |
| WO | 2009003184 | A1 | 12/2008 |
| WO | 2009011952 | A1 | 1/2009 |
| WO | 2009021173 | A1 | 2/2009 |
| WO | 2009021233 | A2 | 2/2009 |
| WO | 2009026339 | A2 | 2/2009 |
| WO | 2009029561 | A2 | 3/2009 |
| WO | 2009032863 | A2 | 3/2009 |
| WO | 2009052095 | A1 | 4/2009 |
| WO | 2009052123 | A2 | 4/2009 |
| WO | 2009052321 | A2 | 4/2009 |
| WO | 2009052345 | A1 | 4/2009 |
| WO | 2009052348 | A2 | 4/2009 |
| WO | 2009076414 | | 6/2009 |
| WO | 2009086403 | A2 | 7/2009 |
| WO | 2009111769 | A2 | 9/2009 |
| WO | 2009135205 | A2 | 11/2009 |
| WO | 2009137415 | A2 | 11/2009 |
| WO | 2009140373 | A2 | 11/2009 |
| WO | 2009140671 | A2 | 11/2009 |
| WO | 2010004014 | A1 | 1/2010 |
| WO | 2010006166 | A2 | 1/2010 |
| WO | 2010009463 | A2 | 1/2010 |
| WO | 2010019782 | A2 | 2/2010 |
| WO | 2010027894 | A2 | 3/2010 |
| WO | 2010042637 | A2 | 4/2010 |
| WO | 2010077859 | A3 | 7/2010 |

OTHER PUBLICATIONS

Chakrabarty et al., "Design Automation Challenges for Microfluidics-Based Biochips", DTIP of MEMS & MOEMS, Montreux, Switzerland, Jun. 1-3, 2005.

Chakrabarty et al., "Design Automation for Microfluidics-Based Biochips", ACM Journal on Engineering Technologies in Computing Systems , 1(3), Oct. 2005, 186-223.

Chakrabarty, "Design, Testing, and Applications of Digital Microfluidics-Based Biochips", Proceedings of the 18th International Conf. on VLSI held jointly with 4th International Conf. on Embedded Systems Design (VLSID'05), IEEE, Jan. 3-7, 2005.

Chen et al., "Development of Mesoscale Actuator Device with Micro Interlocking Mechanism", J. Intelligent Material Systems and Structures, vol. 9, No. 4, Jun. 1998, pp. 449-457.

Chen et al., "Mesoscale Actuator Device with Micro Interlocking Mechanism", Proc. IEEE Micro Electro Mechanical Systems Workshop, Heidelberg, Germany, Jan. 1998, pp. 384-389.

Chen et al., "Mesoscale Actuator Device: Micro Interlocking Mechanism to Transfer Macro Load", Sensors and Actuators, vol. 73, Issues 1-2, Mar. 1999, pp. 30-36.

Cotten et al., "Digital Microfluidics: a novel platform for multiplexed detection of lysosomal storage diseases", Abstract # 3747.9. Pediatric Academic Society Conference, 2008.

Delattre et al., "Towards an industrial fabrication process for electrowetting chip using standard MEMS Technology", μTAS2008, San Diego; poster presented, Oct. 15, 2008.

Delattre et al., "Towards an industrial fabrication process for electrowetting chip using standard MEMS Technology", μTAS2008, San Diego; Abstract in proceedings, Oct. 13-16, 2008, 1696-1698.

Dewey, "Towards a Visual Modeling Approach to Designing Microelectromechanical System Transducers", Journal of Micromechanics and Microengineering, vol. 9, Dec. 1999, 332-340.

Dewey et al., "Visual modeling and design of microelectromechanical system tansducers", Microelectronics Journal, vol. 32, Apr. 2001, 373-381.

Fair et al., "A Micro-Watt Metal-Insulator-Solution-Transport (MIST) Device for Scalable Digital Bio-Microfluidic Systems", IEEE IEDM Technical Digest, 2001, 16.4.1-4.

Fair et al., "Advances in droplet-based bio lab-on-a-chip", BioChips 2003, Boston, 2003.

Fair et al., "Bead-Based and Solution-Based Assays Performed on a Digital Microfluidic Platform", Biomedical Engineering Society (BMES) Fall Meeting, Baltimore, MD, Oct. 1, 2005.

Fair, "Biomedical Applications of Electrowetting Systems", 5th International Electrowetting Workshop, Rochester, NY, May 31, 2006.

Fair et al., "Chemical and Biological Applications of Digital-Microfluidic Devices", IEEE Design & Test of Computers, vol. 24(1), Jan.-Feb. 2007, 10-24.

Fair et al., "Chemical and biological pathogen detection in a digital microfluidic platform", DARPA Workshop on Microfluidic Analyzers for DoD and National Security Applications, Keystone, CO, 2006.

Fair, "Digital microfluidics: is a true lab-on-a-chip possible?", Microfluid Nanofluid, vol. 3, Mar. 8, 2007, 245-281.

Fair, "Droplet-based microfluidic Genome sequencing", NHGRI PI's meeting, Boston, 2005.

Fair et al., "Electrowetting-based On-Chip Sample Processing for Integrated Microfluidics", IEEE Inter. Electron Devices Meeting (IEDM), 2003, 32.5.1-32.5.4.

Fair et al., "Integrated chemical/biochemical sample collection, pre-concentration, and analysis on a digital microfluidic lab-on-a-chip platform", Lab-on-a-Chip: Platforms, Devices, and Applications, Conf. 5591, SPIE Optics East, Philadelphia, Oct. 25-28, 2004.

Fair, "Scaling of Digital Microfluidic Devices for Picoliter Applications", The 6th International Electrowetting Meeting, Aug. 20-22, 2008, p. 14.

Fouillet, "Bio-Protocol Integration in Digital Microfluidic Chips", The 6th International Electrowetting Meeting, Aug. 20-22, 2008, p. 15.

Fouillet et al., "Design and Validation of a Complex Generic Fluidic Microprocessor Based on EWOD Droplet for Biological Applications", 9th International Conference on Miniaturized Systems for Chem and Life Sciences, Boston, MA, Oct. 9-13, 2005, 58-60.

Fouillet et al., "Digital microfluidic design and optimization of classic and new fluidic functions for lab on a chip systems", Microfluid Nanofluid, vol. 4, 2008, 159-165.

Hua et al., "Rapid Detection of Methicillin-Resistant Staphylococcus Aureus (MRSA) Using Digital Microfluidics", 12th Intl Conference on Miniaturized Systems for Chemistry and Life Sciences, Proc. μTAS, Oct. 12-16, 2008.

(56) References Cited

OTHER PUBLICATIONS

Jun et al., "Valveless Pumping using Traversing Vapor Bubbles in Microchannels", J. Applied Physics, vol. 83, No. 11, Jun. 1998, pp. 5658-5664.
Kim et al., "MEMS Devices Based on the Use of Surface Tension", Proc. Int. Semiconductor Device Research Symposium (ISDRS'99), Charlottesville, VA, Dec. 1999, pp. 481-484.
Kim, "Microelectromechanical Systems (MEMS) at the UCLA Micromanufacturing Lab", Dig. Papers, Int. Microprocesses and Nanotechnology Conf. (MNC'98), Kyungju, Korea, Jul. 1998, pp. 54-55.
Kim et al., "Micromachines Driven by Surface Tension", AIAA 99/3800, 30th AIAA Fluid Dynamics Conference, Norfolk, VA, (Invited lecture), Jun. 1999, pp. 1-6.
Kleinert et al., "Electric Field-Assisted Convective Assembly of Large-Domain Colloidal Crystals", The 82nd Colloid & Surface Science Symposium, ACS Division of Colloid & Surface Science, North Carolina State University, Raleigh, NC. www.colloids2008.org., Jun. 15-18, 2008.
Lee et al., "Microactuation by Continuous Electrowetting Phenomenon and Silicon Deep Rie Process", Proc. MEMS (DSC—vol. 66) ASME Int. Mechanical Engineering Congress and Exposition, Anaheim, CA, Nov. 1998, 475-480.
Lee et al., "Liquid Micromotor Driven by Continuous Electrowetting", Proc. IEEE Micro Electro Mechanical Systems Workshop, Heidelberg, Germany, Jan. 1998, pp. 538-543.
Lee et al., "Theory and Modeling of Continuous Electrowetting Microactuation", Proc. MEMS (MEMS—vol. 1), ASME Int. Mechanical Engineering Congress and Exposition, Nashville, TN, Nov. 1999, pp. 397-403.
Marchand et al., "Organic Synthesis in Soft Wall-Free Microreactors: Real-Time Monitoring of Fluorogenic Reactions", Analytical Chemistry, vol. 80, Jul. 2, 2008, 6051-6055.
Millington et al., "Digital Microfluidics: a novel platform for multiplexed detection of LSDs with potential for newborn screening", Association of Public Health Laboratories Annual Conference, San Antonio, TX, Nov. 4, 2008.
Mugele et al., "Electrowetting: from basics to applications", Institution of Physics Publishing, Journal of Physics: Condensed Matter, 2005, R705-R774.
Paik et al., "A digital-microfluidic approach to chip cooling", IEEE Design & Test of Computers, vol. 25, Jul. 2008, 372-381.
Paik et al., "Adaptive Cooling of Integrated Circuits Using Digital Microfluidics", IEEE Transactions on VLSI, vol. 16, No. 4, 2008, 432-443.
Paik et al., "Adaptive Cooling of Integrated Circuits Using Digital Microfluidics", accepted for publication in IEEE Transactions on VLSI Systems, 2007, and Artech House, Norwood, MA, 2007.
Paik, "Adaptive Hot-Spot Cooling of Integrated Circuits Using Digital Microfluidics", Dissertation, Dept. of Electrical and Computer Engineering, Duke University, Apr. 25, 2006, 1-188.
Paik et al., "Adaptive hot-spot cooling of integrated circuits using digital microfluidics", Proceedings ASME International Mechanical Engineering Congress and Exposition, Orlando, Florida, USA. IMECE2005-81081, Nov. 5-11, 2005, 1-6.
Paik et al., "Coplanar Digital Microfluidics Using Standard Printed Circuit Board Processes", 9th International Conference on Miniaturized Systems for Chemistry and Life Sciences (MicroTAS), Boston, MA; Poster, 2005.
Paik et al., "Coplanar Digital Microfluidics Using Standard Printed Circuit Board Processes", 9th Int'l Conf. on Miniaturized Systems for Chemistry and Life Sciences, Boston, MA, Oct. 9-13, 2005, 566-68.
Paik et al., "Droplet-Based Hot Spot Cooling Using Topless Digital Microfluidics on a Printed Circuit Board", Int'l Workshops on Thermal Investigations of ICs and Systems (THERMINIC), 2005, 278-83.
Paik et al., "Electrowetting-based droplet mixers for microfluidic systems", Lab on a Chip (LOC), vol. 3. (more mixing videos available, along with the article, at LOC's website), 2003, 28-33.
Paik et al., "Programmable Flow-Through Real Time PCR Using Digital Microfluidics", 11th International Conference on Miniaturized Systems for Chemistry and Life Sciences, Paris, France, Oct. 7-11, 2007, 1559-1561.
Paik et al., "Programmable flow-through real-time PCR using digital microfluidics", Proc. Micro Total Analysis Systems (μTAS), Handout, 2007.
Paik et al., "Programmable flow-through real-time PCR using digital microfluidics", Proc. Micro Total Analysis Systems (μTAS), Poster, 2007.
Paik et al., "Rapid Droplet Mixers for Digital Microfluidic Systems", Masters Thesis, Duke Graduate School., 2002, 1-82.
Paik et al., "Rapid droplet mixers for digital microfluidic systems", Lab on a Chip, vol. 3. (More mixing videos available, along with the article, at LOC's website.), 2003, 253-259.
Paik et al., "Thermal effects on Droplet Transport in Digital Microfluids with Application to Chip Cooling Processing for Integrated Microfluidics", International Conference on Thermal, Mechanics, and Thermomechanical Phenomena in Electronic Systems (ITherm), 2004, 649-654.
Pamula, "A digital microfluidic platform for multiplexed explosive detection", Chapter 18, Electronics Noses and Sensors for the Detection of Explosives, Eds., J.W. Gardner and J. Yinon, Kluwer Academic Publishers, 2004.
Pamula et al., "A droplet-based lab-on-a-chip for colorimetric detection of nitroaromatic explosives", Proceedings of Micro Electro Mechanical Systems, 2005, 722-725.
Pamula et al., "Cooling of integrated circuits using droplet-based microfluidics", Proc. ACM Great Lakes Symposium on VLSI, Apr. 2003, 84-87.
Pamula et al., "Digital microfluidic lab-on-a-chip for protein crystallization", 5th Protein Structure Initiative "Bottlenecks" Workshop, NIH, Bethesda, MD, Apr. 13-14, 2006, I-16.
Pamula et al., "Digital Microfluidics Platform for Lab-on-a-chip applications", Duke University Annual Post Doctoral Research Day, 2002.
Pamula et al., "Microfluidic electrowetting-based droplet mixing", IEEE, 2002, 8-10.
Pollack, et al., "Electrowetting-Based Actuation of Droplets for Integrated Microfluidics", Lab on a Chip (LOC), vol. 2, 2002, 96-101.
Pollack et al., "Electrowetting-based actuation of liquid droplets for microfluidic applications", Appl. Phys. Letters, vol. 77, No. 11, Sep. 11, 2000, 1725-1726.
Pollack, "Electrowetting-based Microactuation of Droplets for Digital Microfluidics", PhD Thesis, Department of Electrical and Computer Engineering, Duke University, 2001.
Pollack et al., "Electrowetting-Based Microfluidics for High-Throughput Screening", smallTalk 2001 Conference Program Abstract, San Diego, Aug. 27-31, 2001, 149.
Pollack et al., "Investigation of electrowetting-based microfluidics for real-time PCR applications", Proc. 7th Int'l Conference on Micro Total Analysis Systems (mTAS), Squaw Valley, CA, Oct. 5-9, 2003, 619-622.
Pollack, "Lab-on-a-chip platform based digital microfluidics", The 6th International Electrowetting Meeting, Aug. 20-22, 2008, 16.
Ren et al., "Automated electrowetting-based droplet dispensing with good reproducibility", Proc. Micro Total Analysis Systems (mTAS), 7th Int. Conf.on Miniaturized Chem and Biochem Analysis Systems, Squaw Valley, CA, Oct. 5-9, 2003, 993-996.
Ren et al., "Automated on-chip droplet dispensing with volume control by electro-wetting actuation and capacitance metering", Sensors and Actuators B: Chemical, vol. 98, Mar. 2004, 319-327.
Ren et al., "Design and testing of an interpolating mixing architecture for electrowetting-based droplet-on-chip chemical dilution", Transducers, 12th International Conference on Solid- State Sensors, Actuators and Microsystems, 2003, 619-622.
Ren et al., "Dynamics of electro-wetting droplet transport", Sensors and Actuators B (Chemical), vol. B87, No. 1, Nov. 15, 2002, 201-206.
Ren et al., "Micro/Nano Liter Droplet Formation and Dispensing by Capacitance Metering and Electrowetting Actuation", IEEE—NANO, 2002, 369-372.

(56) References Cited

OTHER PUBLICATIONS

Rival et al., "Towards Single Cells Gene Expression on EWOD Lab on Chip", ESONN 2008, Grenoble, France; Poster presented, Aug. 26, 2008.
Rival et al., "Towards single cells gene expression on EWOD lab on chip", ESONN, Grenoble, France, abstract in proceedings, Aug. 2008.
Sherman et al., "Flow Control by Using High-Aspect-Ratio, In-Plane Microactuators", Sensors and Actuators, vol. 73, 1999, pp. 169-175.
Sherman et al., "In-Plane Microactuator for Fluid Control Application", Proc. IEEE Micro Electro Mechanical Systems Workshop, Heidelberg, Germany, Jan. 1998, pp. 454-459.
Sista et al., "96-Immunoassay Digital Microfluidic Multiwell Plate", Proc. μTAS, Oct. 12-16, 2008.
Sista, "Development of a Digital Microfluidic Lab-on-a-Chip for Automated Immunoassays with Magnetically Responsive Beads", PhD Thesis, Department of Chemical Engineering, Florida State University, 2007.
Sista et al., "Development of a digital microfluidic platform for point of care testing", Lab on a chip, vol. 8, Dec. 2008, First published as an Advance Article on the web, Nov. 5, 2008, 2091-2104.
Sista et al., "Heterogeneous immunoassays using magnetic beads on a digital microfluidic platform", Lab on a Chip, vol. 8, Dec. 2008, First published as an Advance Article on the web, Oct. 14, 2008, 2188-2196.
Srinivasan et al., "3-D imaging of moving droplets for microfluidics using optical coherence tomography", Proc. 7th International Conference on Micro Total Analysis Systems (mTAS), Squaw Valley, CA, Oct. 5-9, 2003, 1303-1306.
Srinivasan et al., "A digital microfluidic biosensor for multianalyte detection", Proc. IEEE 16th Annual Int'l Conf. on Micro Electro Mechanical Systems Conference, 2003, 327-330.
Srinivasan, "A Digital Microfluidic Lab-on-a-Chip for Clinical Diagnostic Applications", Ph.D. thesis, Dept of Electrical and Computer Engineering, Duke University, 2005.
Srinivasan et al., "An integrated digital microfluidic lab-on-a-chip for clinical diagnostics on human physiological fluids", Lab on a Chip, vol. 4, 2004, 310-315.
Srinivasan et al., "Clinical diagnostics on human whole blood, plasma, serum, urine, saliva, sweat and tears on a digital microfluidic platform", Proc. 7th International Conference on Micro Total Analysis Systems (mTAS), Squaw Valley, CA, Oct. 5-9, 2003, 1287-1290.
Srinivasan et al., "Digital Microfluidic Lab-on-a-Chip for Protein Crystallization", The 82nd ACS Colloid and Surface Science Symposium, 2008.
Srinivasan et al., "Digital Microfluidics: a novel platform for multiplexed detection of lysosomal storage diseases for newborn screening", AACC Oak Ridge Conference Abstracts, Clinical Chemistry, vol. 54, 2008, 1934.
Srinivasan et al., "Droplet-based microfluidic lab-on-a-chip for glucose detection", Analytica Chimica Acta, vol. 507, No. 1, 2004, 145-150.
Srinivasan et al., "Protein Stamping for MALDI Mass Spectrometry Using an Electrowetting-based Microfluidic Platform", Lab-on-a-Chip: Platforms, Devices, and Applications, Conf. 5591, SPIE Optics East, Philadelphia, Oct. 25-28, 2004.
Srinivasan et al., "Scalable Macromodels for Microelectromechanical Systems", Technical Proc. 2001 Int. Conf. on Modeling and Simulation of Microsystems, 2001, 72-75.
Su et al., "Yield Enhancement of Digital Microfluidics-Based Biochips Using Space Redundancy and Local Reconfiguration", Proc. Design, Automation and Test in Europe (DATE) Conf., IEEE, 2005, 1196-1201.
Sudarsan et al., "Printed circuit technology for fabrication of plastic based microfluidic devices", Analytical Chemistry vol. 76, No. 11, Jun. 1, 2004, Previously published online, May 2004, 3229-3235.
Wang et al., "Droplet-based micro oscillating-flow PCR chip", J. Micromechanics and Microengineering, vol. 15, 2005, 1369-1377.
Wang et al., "Efficient in-droplet separation of magnetic particles for digital microfluidics", Journal of Micromechanics and Microengineering, vol. 17, 2007, 2148-2156.
Weaver, "Application of Magnetic Microspheres for Pyrosequencing on a Digital Microfluidic Platform", Department of Electrical and Computer Engineering, Duke University, 2005.
Xu et al., "A Cross-Referencing-Based Droplet Manipulation Method for High-Throughput and Pin-Constrained Digital Microfluidic Arrays", Proceedings of conference on Design, Automation and Test in Europe, Apr. 2007.
Xu et al., "Automated Design of Pin-Constrained Digital Microfluidic Biochips Under Droplet-Interference Constraints", ACM Journal on Emerging Technologies is Computing Systems, vol. 3(3), 2007, 14:1-14:23.
Xu et al., "Automated solution preparation on a digital microfluidic lab-on-chip", PSI Bottlenecks Workshop, 2008.
Xu et al., "Automated, Accurate and Inexpensive Solution-Preparation on a Digital Microfluidic Biochip", Proc. IEEE Biomedical Circuits and Systems Conference (BioCAS), 2008, 301-304.
Xu et al., "Defect-Aware Synthesis of Droplet-Based Microfluidic Biochips", IEEE, 20th International Conference on VLSI Design, 2007.
Xu et al., "Design and Optimization of a Digital Microfluidic Biochip for Protein Crystallization", Proc. IEEE/ACM International Conference on Computer-Aided Design (ICCAD), Nov. 2008, 297-301.
Xu et al., "Digital Microfluidic Biochip Design for Protein Crystallization", IEEE—NIH Life Science Systems and Applications Workshop, LISA, Bethesda, MD, Nov. 8-9, 2007, 140-143.
Xu et al., "Droplet-Trace-Based Array Partitioning and a Pin Assignment Algorithm for the Automated Design of Digital Microfluidic Biochips", CODES, 2006, 112-117.
Xu et al., "Integrated Droplet Routing in the Synthesis of Microfluidic Biochips", IEEE, 2007, 948-953.
Xu et al., "Parallel Scan-Like Test and Multiple-Defect Diagnosis for Digital Microfluidic Biochips", IEEE Transactions on Biomedical Circuits and Systems, vol. 1(2), Jun. 2007, 148-158.
Xu et al., "Parallel Scan-Like Testing and Fault Diagnosis Techniques for Digital Microfluidic Biochips", Proceedings of the 12th IEEE European Test Symposium (ETS), Freiburg, Germany, May 20-24, 2007, 63-68.
Yao et al., "Spot Cooling Using Thermoelectric Microcooler", Proc. 18th Int. Thermoelectric Conf, Baltimore, VA, pp. 256-259, Aug. 1999.
Yi et al., "Channel-to-droplet extractions for on-chip sample preparation", Solid-State Sensor, Actuators and Microsystems Workshop (Hilton Head '06), Hilton Head Island, SC, Jun. 2006, 128-131.
Yi et al., "Characterization of electrowetting actuation on addressable single-side coplanar electrodes", Journal of Micromechanics and Microengineering, vol. 16.,Oct. 2006, 2053-2059.
Yi et al., "EWOD Actuation with Electrode-Free Cover Plate", Digest of Tech. papers,13th International Conference on Solid-State Sensors, Actuators and Microsystems (Transducers '05), Seoul, Korea, Jun. 5-9, 2005, 89-92.
Yi et al., "Geometric surface modification of nozzles for complete transfer of liquid drops", Solid-State Sensor, Actuator and Microsystems Workshop, Hilton Head Island, South Carolina, Jun. 6-10, 2004, 164-167.
Yi, "Soft Printing of Biological Liquids for Micro-arrays: Concept, Principle, Fabrication, and Demonstration", Ph.D. dissertation, UCLA, 2004.
Yi et al., "Soft Printing of Droplets Digitized by Electrowetting", Transducers 12th Int'l Conf. on Solid State Sensors, Actuators and Microsystems, Boston, Jun. 8-12, 2003, 1804-1807.
Yi et al., "Soft Printing of Droplets Pre-Metered by Electrowetting", Sensors and Actuators A: Physical, vol. 114, Jan. 2004, 347-354.
Zeng et al., "Actuation and Control of Droplets by Using Electrowetting-on-Dielectric", Chin. Phys. Lett., vol. 21(9), 2004, 1851-1854.

(56) References Cited

OTHER PUBLICATIONS

Zhao et al., "Droplet Manipulation and Microparticle Sampling on Perforated Microfilter Membranes", J. Micromech. Microeng., vol. 18, 2008, 1-11.
Zhao et al., "In-droplet particle separation by travelling wave dielectrophoresis (twDEP) and EWOD", Solid-State Sensor, Actuators and Microsystems Workshop (Hilton Head '06), Hilton Head Island, SC, Jun. 2006, 181-184.
Zhao et al., "Micro air bubble manipulation by electrowetting on dielectric (EWOD): transporting, splitting, merging and eliminating of bubbles", Lab on a chip, vol. 7, 2007, First published as an Advance Article on the web, Dec. 4, 2006, 273-280.
Zhao et al., "Microparticle Concentration and Separation byTraveling-Wave Dielectrophoresis (twDEP) for Digital Microfluidics", J. Microelectromechanical Systems, vol. 16, No. 6, Dec. 2007, 1472-1481.
Korean Intellectual Property Office Notice to Submit Response, Mar. 31, 2015.
Cho et al. "Creating, transporting, cutting, and merging liquid droplets by electrowetting-based actuation for digital microfluidic circuits", J. of Microelectromechanical Systems, 2003, vol. 12, No. 1, p. 70-80.
Huang et al. "Dielectrophoretic cell concentrator on EWOD-based chips", Proc. of the 1st IEEE Intl. Conference on Nano/Micro Engineered and Molecular Systems, Jan. 18-21, 2006.
Lee et al. "Electrowetting and Electrowetting-on-doelectric for Microscale Liquid Handling". Sensors and Actuators A, 2002, vol. 95. pp. 259-268.
International Search Report dated Aug. 14, 2009 from PCT International Application No. PCT/US2008/088205.
International Preliminary Report on Patentability dated Jun. 29, 2010 from PCT International Application No. PCT/US2008/0882205.
Non-Final Office Action dated May 7, 2012 from related U.S. Appl. No. 12/682,830.
Final Office Action dated Dec. 7, 2012 from related U.S. Appl. No. 12/682,830.
Final Office Action dated Apr. 23, 2013 from related U.S. Appl. No. 12/682,830.
Final Office Action dated Aug. 13, 2014 from related U.S. Appl. No. 12/682,830.
Hua et al., "Rapid detection of methicillin-resistant *Staphylococcus* (MRSA) using digital microfluidics", Proc. μTAS, 2008.
Pamula et al., "Microfluidic electrowetting-based droplet mixing", Proceedings, MEMS conference Berkeley, Aug. 24-26, 2001, 8-10.
"Published Abstract from NIH Grant Project No. DK066956", Award Date Mar. 18, 2004.
"Published Abstract from NIH Grant Project No. GM072155", Award Date Aug. 27, 2004.
Binks, "Wetting: theory and experiment", Current Opinion in Colloids and Interface Science, vol. 6, No. 1, 17-21, 2001.
Chamberlain, et al., "Deletion screening of Duchenne musular dystrophy locus via multiplex DNA amplification", Nuc. Acid. Res. 16, pp. 11141-11156, 1988.
Cho, et al., "Concentration and binary separation of micro particles for droplet-based digital microfluidics", Lab Chip, vol. 7, 490-498, 2007.
Coltro et al., "Toner and paper-based fabrication techniques for microfluidic applications", Electrophoresis, vol. 31, 2487-2498, Jul. 2010.
Dorfman, et al., "Contamination-Free Continuouse Flow Microfluidic Polymerase Chain Reaction for Quantitative and Clinical Applications", Analytical Chemistry 77, 3700-3704, 2005.
Fowler, "Labon-on-a-Chip Technology May Present New ESD Challenges", Electrostatic Discharge (ESD) Journal. Retrieved on Apr. 18, 2008 from:http://www.esdjournal.com/articles/labchip/Lab.htm., Mar. 2002.
Gijs, Mam, "Magnetic bead handling on-chip:new opportunities for analytical applications", Microfluidics and Nanofluidics, vol. 1, 22-40, Oct. 2, 2004.
Huang, et al., "MEMS-based sample preparation for molecular diagnostics", Analytical and Bioanalytical Chemistry, vol. 372, 49-65, 2002.
Jones, et al., "Dielectrophoretic liquid actuation and nanodroplet formation", J. Appl. Phys., vol. 89, No. 2, 1441-1448, Jan. 2001.
Margulies, et al., "Genome sequencing in microfabricated high-density picolitre reactors", Nature, vol. 437, 376-380 and Supplemental Materials, 2005.
Pamula et al., "Digital Microfluidics for Lab-on-a-Chip Applications", "Emerging CAD Challenges for Biochip Design" Workshop, Conference on Design, Automation, and Test in Europe (DATE), Munich, Germany, Advance Programme, pp. 85-87, 2006.
Park, et al., "Single-sided continuous optoelectrowetting (SCOEW) droplet manipulation with light patterns", Lab on a chip, vol. 10, 1655-1661, Jul. 2010.
Pinho, et al., "Haemopoietic progenitors in the adult mouse omentum: permanent production of B lymphocytes and monocytes", Cell Tissue Res., vol. 319, No. 1, 91-102, Jan. 2005.
Poliski, Making materials fit the future: accommodating relentless technological requirements means researchers must recreate and reconfigure materials, frequently challenging established laws of physics, while keeping an eye on Moore's Law, R&D Magazine Conference, Dec. 2001.
Raj, et al., Composite Dielectrics and Surfactants for Low Voltage Electrowetting Devices, University/Government/Industry Micro/Nano Symposium, vol. 17, 187-190, Jul. 13-16, 2008.
Russom, et al., "Pyrosequencing in a Microfluidic Flow-Through Device", Anal. Chem. vol. 77, 7505-7511, 2005.
Schwartz, et al., "Dielectrophoretic approaches to sample preparation and analysis", The University of Texas, Dissertation, Dec. 2001.
Shah, et al., "EWOD-driven droplet microfluidic device integrated with optoelectronic tweezers as an automated platform for cellular isolation and analysis", Lab on a Chip, vol. 9, 1732-1739, Jun. 2009.
Tsuchiya, et al., "On-chip polymerase chain reaction microdevice employing a magnetic droplet-manipulation system", Sensors and Actuators B, vol. 130, 583-588, Oct. 18, 2007.
Wheeler, et al., "Electrowetting-Based Microfluidics for Analysis of Peptides and Proteins by Matrix-Assisted Laser Desportion/Ionization Mass Spectrometry", Anal. Chem. 76, 4833-4838, 2004.
Yi et al., "Microfluidics technology for manipulation and analysis of biological cells", Analytica Chimica Acta, vol. 560, 1-23, 2006.
Written Opinion dated Aug. 14, 2009 from PCT International Application No. PCT/US2008/088205.

* cited by examiner

DROPLET ACTUATOR CONFIGURATIONS AND METHODS OF CONDUCTING DROPLET OPERATIONS

2 RELATED APPLICATIONS

This application is a continuation of and claims priority to U.S. patent application Ser. No. 12/682,830, entitled "Droplet Actuator Configurations and Methods of Conducting Droplet Operations," filed on Jul. 12, 2010 (now abandoned), the application of which is a National Stage Entry of and claims priority to PCT International Patent Application No. PCT/US2008/088205, entitled "Droplet Actuator Configurations and Methods of Conducting Droplet Operations," filed on Dec. 23, 2008 (now expired), the application of which is related to and claims priority to U.S. Patent Application No. 61/016,618, entitled "Reservoir Configurations for a Droplet Actuator," filed on Dec. 26, 2007, and 61/016,480, entitled "Reservoir Configurations for a Droplet Actuator," filed on Dec. 23, 2007, the entire disclosures of which are specifically incorporated herein by reference.

1 GOVERNMENT INTEREST

This invention was made with government support under GM072155 and DK066956, both awarded by the National Institutes of Health of the United States. The United States Government has certain rights in the invention.

3 FIELD OF THE INVENTION

The invention relates to droplet actuators in which droplet operations are mediated by electrodes, and particularly to modifications of droplet actuators and electrode configurations on droplet actuators for enhancing the loading, dispensing, splitting and/or disposing of droplets. The invention also relates to modified droplet actuators in which electrical field gradients are used to conduct or enhance droplet operations.

4 BACKGROUND

Droplet actuators are used to conduct a wide variety of droplet operations. A droplet actuator typically includes two substrates separated by a gap. The substrates include electrodes for conducting droplet operations. The space is typically filled with a filler fluid that is immiscible with the fluid that is to be manipulated on the droplet actuator. The formation and movement of droplets is controlled by electrodes for conducting a variety of droplet operations, such as droplet transport and droplet dispensing. Because there is a need to produce droplets having more accurate and/or precise volumes for both samples and reagents, there is a need for alternative approaches to metering droplets in a droplet actuator. There is also a need for improved approaches to loading droplet operations fluids, such as samples and/or reagents, into and removing such fluids from a droplet actuator.

5 SUMMARY OF THE INVENTION

The invention provides a droplet actuator comprising a droplet formation electrode configuration. The droplet formation electrode configuration may be associated with a droplet operations surface. The electrode configuration may include one or more electrodes configured to control a position of an edge of a droplet during formation of a sub-droplet on the droplet operations surface. The electrode configuration may include one or more electrodes configured to control a volume of a droplet during formation of a sub-droplet on the droplet operations surface. The electrode configuration may include one or more electrodes configured to control a footprint of a droplet or a region of a droplet during formation of a sub-droplet on the droplet operations surface.

The edge of the droplet controlled during droplet formation may include an edge of a necking region of the droplet. The edge of the droplet controlled during droplet formation may include an edge of the sub-droplet being formed. The control of the position of the edge of the droplet may the volume of the sub-droplet. The control of the footprint of the droplet may control the volume of the sub-droplet. The control of a region of the footprint of the droplet may control the volume of the sub-droplet. The control of the necking region of the footprint of the droplet may control the volume of the sub-droplet. The control may exerted by controlling voltage applied to the electrode.

The electrode configuration may include an intermediate electrode configuration. The intermediate electrode configuration may include one or more inner electrodes; and two or more outer electrodes arranged laterally with respect to the inner electrode; and electrodes flanking the intermediate electrode configuration. The intermediate electrode configuration and electrodes flanking the intermediate electrode configuration may be arranged such that activation of the intermediate electrode configuration and the electrodes flanking the intermediate electrode configuration in the presence of the droplet causes the droplet to elongate across the droplet forming electrode configuration. A reduction in voltage applied to two or more of the outer electrodes in the presence the elongated droplet may be effected to initiate necking of the elongated droplet. A reduction in voltage applied to the one or more inner electrodes following a reduction in voltage applied to the two or more outer electrodes may be effected to break the elongated droplet, forming one or more sub-droplets. Deactivation of the two or more outer electrodes in the presence the elongated droplet may be effected to initiate necking of the elongated droplet. Deactivation of the one or more inner electrodes following deactivation of all outer electrodes may be effected to break the elongated droplet, forming one or more sub-droplets. The outer electrodes arranged laterally with respect to the inner electrode may be electrically coupled and function as a single electrode.

The droplet actuator may include a reservoir electrode adjacent to the droplet formation electrode configuration. The droplet actuator may include a droplet operations electrode adjacent to the droplet formation electrode configuration.

The electrode configuration may include one or more centrally located electrodes; and one or more necking electrodes adjacent to an edge of the droplet forming electrode configuration. The centrally located electrodes and necking electrodes may be configured to control droplet necking and splitting in a droplet splitting process effected by sequential deactivation of sets of electrodes beginning with the necking electrodes and continuing to the centrally located electrodes.

The droplet actuator wherein the electrode configuration may include a centrally located electrode that is generally I-shaped and/or hourglass shaped. The electrode configuration may be interposed in a path of electrodes. The electrode configuration and the path of electrodes may be arranged along a common axis. The electrode configuration may include a central electrode arranged symmetrically about the common axis, and necking electrodes flanking the central electrode. The electrode configuration may include a second set of necking electrodes flanking the first set of necking electrodes.

The necking electrodes have a shape which may be convex away from the axis. The necking electrodes may include electrode bars oriented in a substantially parallel orientation relative to the central electrode. The electrode configuration may have a size which is approximately equal to the size of one or more adjacent electrodes in the path of electrodes. The electrode configuration may include four triangles arranged to form a square or rectangle.

The electrode configuration may include an electrode that produces an electrical field gradient that controls a position of an edge of the droplet during formation of the sub-droplet. The electrode that produces the electrical field gradient may a position of an edge of a necking region of the droplet during formation of a sub-droplet. The electrode that produces the electrical field gradient may control a diameter of a necking region of the droplet during formation of a sub-droplet. The electrode that produces the electrical field gradient may control a footprint a necking region of the droplet during formation of a sub-droplet.

The electrode may produce an electrical field gradient at a first voltage that induces droplet necking; and an electrical field gradient at a second voltage that induces droplet splitting. The electrode may produce an electrical field gradient at a first voltage that induces droplet extension; an electrical field gradient at a second voltage that induces droplet necking; and an electrical field gradient at a third voltage that induces droplet splitting.

The field gradient may be established by a composition atop the electrode. The composition may include a dielectric composition. The composition may include a patterned material including regions having different thicknesses. The composition may include a patterned material including regions having different relative static permittivity or dielectric constant. The composition may include two or more patterned materials, each patterned material having a different relative static permittivity or dielectric constant. The composition may include a dielectric material having a first dielectric constant and a dielectric material having a second dielectric constant which may be different from the first dielectric constant. The composition may include dielectric material doped in a patterned fashion with one or more substances that modify the dielectric constant of the dielectric material.

The field gradient may be established by means including shape of the electrode that produces the electrical field gradient. The field gradient may be established by means including variations in electrode thickness in the electrode that produces the electrical field gradient. The field gradient may be established by means including spatial orientation of the electrode in a z direction relative to a droplet operations surface of the droplet actuator. The electrode that produces the electrical field gradient may include conductivity patterns established within the electrode. The electrode that produces the electrical field gradient may include two or more different conductive materials patterned to produce a predetermined field gradient. The electrode that produces the electrical field gradient may include a wire trace in which different regions the electrode that produces the electrical field gradient may include different densities of wire spacing.

The invention provides a system including the droplet actuator and a processor programmed to control the supply of voltage to the one or more electrodes configured to control a position of an edge of the droplet during formation of the sub-droplet. The system may include a sensor for monitoring an edge of the droplet during formation of the sub-droplet. The system may include a sensor for monitoring a footprint of the droplet during formation of the sub-droplet. The system may include a sensor for monitoring a footprint of a region of the droplet during formation of the sub-droplet. The region of the droplet monitored by the system may correspond to volume of the dispensed sub-droplet. The sensor may detect a parameter associated with volume of the sub-droplet. The sensor may be selected to detect one or more electrical, chemical and/or physical properties of the droplet. The sensor may include an imaging device configured to image the droplet. The processor may be configured to adjust voltage of one or more of the electrodes configured to control the position of the edge of the droplet during formation of the sub-droplet. The processor may be configured to adjust voltage of one or more of the electrodes configured to control a position of an edge of the droplet during formation of the sub-droplet.

The invention provides a droplet actuator including substrate including a path or array of electrodes, the path or array including one or more electrodes formed using a wire trace. The wire trace configuration may include wires in a meandering path. Each turn in the meandering path may be substantially equal to other turns in the path. The wire trace configuration may include regions of differing wire density. The wire trace configuration may include a central axial region that may have greater wire density than an outer region. The wire trace configuration may include an elongated electrode having a first end region and a second end region. The first end region may have greater wire density than the second end region. The wire density may gradually increase along the length of the elongated from the second end region to the first end region.

The invention provides a droplet actuator including an droplet formation electrode configuration for forming a droplet. The droplet forming electrode configuration may include a droplet source; an intermediate electrode; and a terminal electrode. When a liquid is present at the droplet source, activation of the intermediate electrode and the terminal electrode may cause a droplet extension to flow across the intermediate electrode and onto the terminal electrode. Increasing voltage applied to the terminal electrode may increase the length of the droplet extension. Deactivation of the intermediate electrode may break the droplet into two sub-droplets.

The droplet source may include a droplet source electrode. The droplet source electrode may include a reservoir. The droplet source electrode may include a reservoir electrode. The droplet source electrode may include a droplet operations electrode. The terminal electrode may be elongated relative to the intermediate electrode. The terminal electrode may have a substantially tapering shape. The terminal electrode may taper away from the droplet source electrode. The terminal electrode may taper towards the droplet source electrode. The terminal electrode may be substantially triangular in shape. An apex of the terminal electrode may be inset into a notch in the intermediate electrode. The terminal electrode may taper from a widest region which may be oriented distally with respect to the intermediate electrode to a narrow region which may be oriented proximally with respect to the intermediate electrode. The terminal electrode may taper from a widest region which may be oriented proximally with respect to the intermediate electrode to a narrow region which may be oriented distally with respect to the intermediate electrode.

The widest region may be approximately equal in width to the diameter of the intermediate electrode taken along an axis of the electrode configuration. The narrow region may be narrower than the diameter of the intermediate electrode taken along an axis of the electrode configuration.

The droplet actuator may be provided as a component of a system including the droplet actuator; and a processor. The processor may be programmed to control voltage applied to electrodes of the electrode configuration. The processor may be programmed to control droplet volume by adjusting voltage applied to the terminal electrode.

The invention provides a droplet actuator including an electrode configured to conduct a droplet operation. The electrode may be configured to produce an electric field gradient that effects a droplet operation by effecting a change in voltage applied to the electrode. The droplet actuator may include a dielectric material atop the electrode configured to establish a dielectric topography that controls the droplet operation upon effecting the change in voltage applied to the electrode.

The field gradient may be established by means including a patterned material atop the electrode. The patterned material atop the electrode may include a dielectric material including regions having different thicknesses. The patterned material atop the electrode may include a dielectric material including regions having different dielectric constants. The patterned material atop the electrode may include a dielectric material including two or more patterned materials, each patterned material having a different dielectric constant. The patterned material atop the electrode may include a dielectric material having a composition which may be varied to produce the electric field gradient. The patterned material atop the electrode may include a first dielectric material of a first dielectric constant patterned on the electrode and a second dielectric material of a second dielectric constant layered on the first dielectric material.

The field gradient may be configured to control the droplet necking and splitting upon reduction of voltage applied to the electrode. Necking may be induced by a first reduction in voltage applied to the electrode configuration and breaking may be induced by a second reduction in voltage applied to the electrode configuration. The field gradient may be established by mans including electrode shape. The field gradient may be established by means including electrode thickness. The field gradient may be established by means including conductivity patterns established within the electrode. The electrode may include two or more different conductive materials patterned to produce a predetermined field gradient. The field gradient may be established by means including a wire trace in which different regions of the electrode configuration have different densities of wire spacing. The field gradient may be established by a means including a pattern of conductive material within the electrode. The field gradient may be established by a means including a pattern of nonconductive material within the electrode. The field gradient may be established by a means including a pattern of differently conductive material within the electrode.

The electrode may produce a patterned field gradient that effects a droplet operation upon activation, deactivation or an adjustment in voltage. A reduction in voltage may effect a droplet operation. An increase in voltage may effect extension of a droplet. An increase in voltage in the presence of a droplet on the electrode effects extension of the droplet.

The invention provides a method of controlling a position of an edge of a droplet during formation of a sub-droplet. The invention provides a method of controlling a footprint of a droplet during formation of a sub-droplet. The invention provides a method of controlling a footprint of a region of a droplet during formation of a sub-droplet.

A method of the invention includes providing droplet actuator including a droplet formation electrode configuration associated with a droplet operations surface, wherein the electrode configuration may include one or more electrodes configured to control a position of an edge of the droplet during formation of the sub-droplet on the droplet operations surface. A method of the invention includes forming the sub-droplet while using the electrode configuration to control the edge of the droplet.

The method may include controlling an edge of a necking region of the droplet while forming the sub-droplet. The method may include controlling a footprint of a necking region of the droplet while forming the sub-droplet. The method may include controlling a region of a footprint of a necking region of the droplet while forming the sub-droplet. The method may include controlling a diameter of a necking region of the droplet while forming the sub-droplet. The method may include controlling volume of a necking region of the droplet while forming the sub-droplet. The method may include controlling drainage of a necking region of the droplet while forming the sub-droplet.

The method may include controlling an edge of the sub-droplet while forming the sub-droplet. The method may include controlling the volume of the sub-droplet while forming the sub-droplet. The method may include controlling a footprint of the sub-droplet while forming the sub-droplet. The method may include controlling a footprint of a region of the sub-droplet while forming the sub-droplet.

Forming the sub-droplet may include voltage applied to the electrode configuration. Forming the sub-droplet may include voltage applied to an intermediate electrode configuration. Forming the sub-droplet may include voltage applied to a terminal electrode configuration. Forming the sub-droplet may include voltage applied to an intermediate electrode of the electrode configuration. Forming the sub-droplet may include voltage applied to a terminal electrode of the electrode configuration.

The electrode configuration may include an intermediate electrode configuration. The intermediate electrode configuration may include one or more inner electrodes; two or more outer electrodes arranged laterally with respect to the inner electrode; and electrodes flanking the intermediate electrode configuration. The intermediate electrode configuration and electrodes flanking the intermediate electrode configuration may be arranged such that activation of the intermediate electrode configuration and the electrodes flanking the intermediate electrode configuration in the presence of the droplet causes the droplet to elongate across the droplet forming electrode configuration. A reduction in voltage applied to two or more of the outer electrodes in the presence the elongated droplet may initiate necking of the elongated droplet. A reduction in voltage applied to the one or more inner electrodes following a reduction in voltage applied to the two or more outer electrodes may break the elongated droplet, forming one or more sub-droplets. Deactivation of the two or more outer electrodes in the presence the elongated droplet may initiate necking of the elongated droplet. Deactivation of the one or more inner electrodes following deactivation of all outer electrodes may break the elongated droplet, forming one or more sub-droplets. Two or more outer electrodes arranged laterally with respect to the inner electrode may be electrically coupled and function as a single electrode.

The electrode configuration may include a reservoir electrode adjacent to the droplet formation electrode configuration. Forming the sub-droplet may include dispensing a smaller volume droplet from a larger volume droplet. A droplet operations electrode may be included adjacent to the droplet formation electrode configuration. The electrode configuration may include one or more centrally located electrodes and one or more necking electrodes adjacent to an edge of the droplet forming electrode configuration. Forming the sub-droplet may include sequentially deactivating sets of electrodes beginning with the necking electrodes and continuing to the centrally located electrodes. The electrode configuration may include a centrally located electrode that may be generally I-shaped and/or hourglass shaped.

The electrode configuration may be interposed in a path of electrodes. The electrode configuration and the path of electrodes may be arranged along a common axis. The electrode configuration may include a central electrode arranged symmetrically about the common axis and necking electrodes flanking the central electrode. A second set of necking electrodes may be provided flanking the first set of necking electrodes. The necking electrodes may have a shape which may be convex away from the axis. The necking electrodes may include electrode bars oriented in a substantially parallel orientation relative to the central electrode. The electrode configuration may have a size which may be approximately equal to the size of one or more adjacent electrodes in the path of electrodes. The electrode configuration may include four triangles arranged to form a square or rectangle. The electrode configuration may include an electrode that produces an electrical field gradient that controls a position of an edge of the droplet during formation of the sub-droplet.

The method may include controlling the position of an edge of the droplet by using the electrode configuration to establish an electrical field gradient that controls the position of an edge of a necking region of the droplet during formation of a sub-droplet. The method may include controlling the footprint of the droplet. The electrode configuration may establish an electrical field gradient that controls the footprint of a necking region of the droplet during formation of a sub-droplet. The footprint may be controlled by controlling voltage applied to the electrode configuration to establish an electrical field gradient at a first voltage that induces droplet necking and an electrical field gradient at a second voltage that induces droplet splitting.

The method may include including controlling voltage applied to the electrode configuration to establish an electrical field gradient at a first voltage that induces droplet extension; an electrical field gradient at a second voltage that induces droplet necking; and an electrical field gradient at a third voltage that induces droplet splitting.

The field gradient may be established by a composition atop the electrode. The composition may include a dielectric composition. The composition may include a patterned material including regions having different thicknesses. The composition may include a patterned material including regions having different relative static permittivity or dielectric constant. The composition may include two or more patterned materials, each patterned material having a different relative static permittivity or dielectric constant. The composition may include:

a dielectric material having a first dielectric constant and a dielectric material having a second dielectric constant which may be different from the first dielectric constant. The materials having different dielectric constants may be patterned to induce a field gradient which effects a droplet operation upon a change in voltage applied to the electrode. The composition may include dielectric material doped in a patterned fashion with one or more substances that modify the dielectric constant of the dielectric material. The field gradient may be established by means including shape of the electrode that produces the electrical field gradient. The field gradient may be established by means including variations in electrode thickness in the electrode that produces the electrical field gradient. The field gradient may be established by means including spatial orientation of the electrode in a z direction relative to a droplet operations surface of the droplet actuator.

As already noted, the electrode that produces the electrical field gradient may include conductivity patterns established within the electrode. The electrode that produces the electrical field gradient may include two or more different conductive materials patterned to produce a predetermined field gradient. The electrode that produces the electrical field gradient may include a wire trace in which different regions the electrode that produces the electrical field gradient may include different densities of wire spacing.

The method may be controlled by a system. The system may control forming the sub-droplet. The system may control the diameter of the necking region of the droplet. The system may control the footprint of the necking region of the droplet. The system may control the footprint of a portion of the necking region of the droplet. The system may include a processor programmed to control the supply of voltage to the one or more electrodes of the electrode configuration. The system may include a sensor coupled to the processor. The method may include monitoring an edge of the droplet during formation of the sub-droplet using the sensor coupled to the processor. The method may include adjusting voltage applied to an electrode or electrode configuration based on the parameter sensed by the sensor. The processor may be configured to control the volume of the dispensed sub-droplet by adjusting voltage of one or more electrodes of the electrode configuration in response to a sensed position of the edge of the droplet while forming of the sub-droplet in order to locate the edge of the droplet at a predetermined position indicative of a desired sub-droplet volume.

The invention provides a method of forming a sub-droplet from a droplet, the method including controllably reducing the diameter of a necking region of a droplet in a necking-and-splitting process. The sub-droplet may have a predetermined volume.

The invention provides a method forming a sub-droplet from a droplet, the method including controllably expanding the volume of the droplet atop a terminal electrode and initiating a droplet splitting process at an intermediate electrode upon reaching a predetermined volume atop the terminal electrode. The sub-droplet may have a predetermined volume.

The invention provides a method of forming a sub-droplet, the method including providing an elongated droplet spanning an electrode configuration including a first electrode and a second electrode, the elongated droplet including a volume of liquid atop the first electrode and a volume of liquid atop the second electrode. The method may include controllably expanding the volume of the elongated droplet atop the second electrode. The method may include splitting the droplet at the first electrode to yield the sub-droplet. The sub-droplet may have a predetermined volume.

The invention provides a method of forming a sub-droplet, the method including providing an elongated droplet spanning an electrode configured to produce a field gradient including an intermediate region in which a relatively higher voltage may be required to effect electrowetting atop the intermediate region. The method may include applying a voltage to the electrode sufficient to cause a droplet to expand across the intermediate region. The method may include sufficiently reducing the voltage to cause the droplet to break at the intermediate region. The field gradient may be established by mans including electrode shape. The field gradient may be established by means including electrode thickness. The field gradient may be established by means including conductivity patterns established within the electrode. The electrode may include two or more different conductive materials patterned to produce a predetermined field gradient. The field gradient may be established by means including a wire trace in which different regions of the electrode configuration have different densities of wire spacing. The field gradient may be established by a means including a pattern of conductive material within the electrode. The field gradient may be established by a means including a pattern of nonconductive material within the electrode. The field gradient may be established by a means including a pattern of differently conductive material within the electrode. The electrode or electrode configuration may produce a patterned field gradient that effects a droplet operation upon activation, deactivation or an adjustment in voltage.

The invention provides a method of forming a sub-droplet, the method including providing an elongated droplet spanning an electrode configuration including a terminal electrode region configured to produce a field gradient, wherein droplet volume atop the terminal region may be incrementally increased by increasing voltage applied to the terminal region. The method may include applying a voltage to the electrode sufficient to cause a droplet to expand to a predetermined volume atop the terminal region. The method may include causing the droplet to break, thereby forming a sub-droplet atop the terminal region. The terminal region may be configured to permit increasing droplet volume atop the terminal region to a volume which may be greater than the volume of an adjacent unit sized droplet operations electrode. The field gradient may be established by mans including electrode shape. The field gradient may be established by means including electrode thickness. The field gradient may be established by means including conductivity patterns established within the electrode. The electrode may include two or more different conductive materials patterned to produce a predetermined field gradient. The field gradient may be established by means including a wire trace in which different regions of the electrode configuration have different densities of wire spacing. The field gradient may be established by a means including a pattern of conductive material within the electrode. The field gradient may be established by a means including a pattern of nonconductive material within the electrode. The field gradient may be established by a means including a pattern of differently conductive material within the electrode.

The invention provides a droplet actuator including: a top substrate assembly including reservoir; a bottom substrate assembly separated from the top substrate to form a gap; electrodes associated with the top substrate assembly and/or the bottom substrate assembly and configured to conduct one or more droplet operations; and a fluid path. The fluid path may be configured for flowing fluid from the reservoir into the gap, where the droplet may be subjected to one or more droplet operations mediated by one or more of the electrodes; and/or transporting fluid using the electrodes into contact with the opening and causing the fluid to substantially exit the gap and enter the reservoir.

The top substrate assembly may include a top substrate and a reservoir substrate associated with the top substrate and including the reservoir formed therein. The droplet actuator may include a reservoir electrode associated with the bottom substrate. The opening may overlap an edge of the reservoir electrode. The droplet actuator may include a first droplet operations electrode associated with the bottom substrate and adjacent to the reservoir electrode, wherein the opening overlaps an edge of the first electrode and an edge of the droplet operations electrode. The droplet actuator may include a first droplet operations electrode associated with the bottom substrate and at least partially inset into the reservoir electrode, wherein the opening overlaps an edge of the first electrode and an edge of the droplet operations electrode. The droplet actuator may be configured to facilitate flow of droplets from the gap into the reservoir. The reservoir may have a diameter which may be greater than about 1 mm. The reservoir may have a diameter which may be greater than about 2 mm. The reservoir may have a volume sufficient to hold a volume of liquid ranging from about 100 to about 300 mL. The reservoir may have a volume sufficient to hold a volume of liquid ranging from about 5 μl to about 5000 μL. The reservoir may have a volume sufficient to hold a volume of liquid ranging from about 10 μL to about 2000 μL. The reservoir may have a volume sufficient to hold a volume of liquid ranging from about 50 μL to about 1500 μL. The reservoir may have dimensions which may be substantially cylindrical. The opening may be substantially aligned about an axis of the cylindrical dimensions of the reservoir. The gap may include a filler fluid. The filler fluid may include an oil. The reservoir may include region having a reduced diameter relative to a main volume of the reservoir, the region having a reduced diameter providing a fluid path between the main volume of the reservoir and the opening. The restricted region of the reservoir may have a height above the bottom substrate that exceeds the dead height corresponding to the dead volume of the restricted region of the reservoir. The main volume of the reservoir may have a height above the bottom substrate that exceeds the dead height corresponding to the dead volume of the main volume of the reservoir. The restricted region of the reservoir may have a first diameter and a first height above the bottom substrate; the main volume of the reservoir may have a second diameter, a second height above the bottom substrate; and the first diameter, first height, second diameter, and second height may be selected such that a liquid volume equal to substantially all of the volume of the main volume of the reservoir may be available for dispensing. The main volume of the reservoir may be elongated relative to a cylindrical main volume without substantially increasing dead volume relative to the corresponding cylindrical main volume.

The invention provides a method of transporting a droplet out of a droplet actuator gap. The method may include providing a droplet actuator including: a top substrate assembly including reservoir; a bottom substrate assembly separated from the top substrate to form a gap; electrodes associated with the top substrate assembly and/or the bottom substrate assembly and configured to conduct one or more droplet operations; and a fluid path configured for flowing fluid from the gap into the reservoir. The method may include transporting fluid using the electrodes into contact with the opening and causing the fluid to substantially exit the gap and enter the reservoir.

The top substrate assembly may include a top substrate and a reservoir substrate associated with the top substrate and including the reservoir formed therein. A reservoir electrode may be associated with the bottom substrate. The opening may overlap an edge of the reservoir electrode. A first droplet operations electrode may be associated with the bottom substrate and adjacent to the reservoir electrode. The opening may overlap an edge of the first electrode and an edge of the droplet operations electrode. A first droplet operations electrode may be associated with the bottom substrate and at least partially inset into the reservoir electrode. The opening may overlap an edge of the first electrode and an edge of the droplet operations electrode.

The embodiments included in this Summary of the Invention are illustrative only. Further embodiments will be apparent to one of skill in the art upon review of this Summary of the Invention and the ensuing sections and claims.

6 DEFINITIONS

As used herein, the following terms have the meanings indicated.

"Activate" with reference to one or more electrodes means effecting a change in the electrical state of the one or more electrodes which, in the presence of a droplet, results in a droplet operation.

"Bead," with respect to beads on a droplet actuator, means any bead or particle that is capable of interacting with a droplet on or in proximity with a droplet actuator. Beads may be any of a wide variety of shapes, such as spherical, generally spherical, egg shaped, disc shaped, cubical and other three dimensional shapes. The bead may, for example, be capable of being transported in a droplet on a droplet actuator or otherwise configured with respect to a droplet actuator in a manner which permits a droplet on the droplet actuator to be brought into contact with the bead, on the droplet actuator and/or off the droplet actuator. Beads may be manufactured using a wide variety of materials, including for example, resins, and polymers. The beads may be any suitable size, including for example, microbeads, microparticles, nanobeads and nanoparticles. In some cases, beads are magnetically responsive; in other cases beads are not significantly magnetically responsive. For magnetically responsive beads, the magnetically responsive material may constitute substantially all of a bead or one component only of a bead. The remainder of the bead may include, among other things, polymeric material, coatings, and moieties which permit attachment of an assay reagent. Examples of suitable magnetically responsive beads are described in U.S. Patent Publication No. 2005-0260686, entitled, "Multiplex flow assays preferably with magnetic particles as solid phase," published on Nov. 24, 2005, the entire disclosure of which is incorporated herein by reference for its teaching concerning magnetically responsive materials and beads. The fluids may include one or more magnetically responsive and/or non-magnetically responsive beads. Examples of droplet actuator techniques for immobilizing magnetically responsive beads and/or non-magnetically responsive beads and/or conducting droplet operations protocols using beads are described in U.S. patent application Ser. No. 11/639,566, entitled "Droplet-Based Particle Sorting," filed on Dec. 15, 2006; U.S. Patent Application No. 61/039,183, entitled "Multiplexing Bead Detection in a Single Droplet," filed on Mar. 25, 2008; U.S. Patent Application No. 61/047,789, entitled "Droplet Actuator Devices and Droplet Operations Using Beads," filed on Apr. 25, 2008; U.S. Patent Application No. 61/086,183, entitled "Droplet Actuator Devices and Methods for Manipulating Beads," filed on Aug. 5, 2008; International Patent Application No. PCT/US2008/053545, entitled "Droplet Actuator Devices and Methods Employing Magnetic Beads," filed on Feb. 11, 2008; International Patent Application No. PCT/US2008/058018, entitled "Bead-based Multiplexed Analytical Methods and Instrumentation," filed on Mar. 24, 2008; International Patent Application No. PCT/US2008/058047, "Bead Sorting on a Droplet Actuator," filed on Mar. 23, 2008; and International Patent Application No. PCT/US2006/047486, entitled "Droplet-based Biochemistry," filed on Dec. 11, 2006; the entire disclosures of which are incorporated herein by reference.

"Droplet" means a volume of liquid on a droplet actuator that is at least partially bounded by filler fluid. For example, a droplet may be completely surrounded by filler fluid or may be bounded by filler fluid and one or more surfaces of the droplet actuator. Droplets may, for example, be aqueous or non-aqueous or may be mixtures or emulsions including aqueous and non-aqueous components. Droplets may be wholly or partially in a droplet actuator gap. Droplets may take a wide variety of shapes; nonlimiting examples include generally disc shaped, slug shaped, truncated sphere, ellipsoid, spherical, partially compressed sphere, hemispherical, ovoid, cylindrical, and various shapes formed during droplet operations, such as merging or splitting or formed as a result of contact of such shapes with one or more surfaces of a droplet actuator. For examples of droplet fluids that may be subjected to droplet operations using the approach of the invention, see International Patent Application No. PCT/US 06/47486, entitled, "Droplet-Based Biochemistry," filed on Dec. 11, 2006. In various embodiments, a droplet may include a biological sample, such as whole blood, lymphatic fluid, serum, plasma, sweat, tear, saliva, sputum, cerebrospinal fluid, amniotic fluid, seminal fluid, vaginal excretion, serous fluid, synovial fluid, pericardial fluid, peritoneal fluid, pleural fluid, transudates, exudates, cystic fluid, bile, urine, gastric fluid, intestinal fluid, fecal samples, liquids containing single or multiple cells, liquids containing organelles, fluidized tissues, fluidized organisms, liquids containing multi-celled organisms, biological swabs and biological washes. Moreover, a droplet may include a reagent, such as water, deionized water, saline solutions, acidic solutions, basic solutions, detergent solutions and/or buffers. Other examples of droplet contents include reagents, such as a reagent for a biochemical protocol, such as a nucleic acid amplification protocol, an affinity-based assay protocol, an enzymatic assay protocol, a sequencing protocol, and/or a protocol for analyses of biological fluids.

"Droplet Actuator" means a device for manipulating droplets. For examples of droplet actuators, see U.S. Pat. No. 6,911,132, entitled "Apparatus for Manipulating Droplets by Electrowetting-Based Techniques," issued on Jun. 28, 2005 to Pamula et al.; U.S. patent application Ser. No. 11/343,284, entitled "Apparatuses and Methods for Manipulating Droplets on a Printed Circuit Board," filed on filed on Jan. 30, 2006; U.S. Pat. No. 6,773,566, entitled "Electrostatic Actuators for Microfluidics and Methods for Using Same," issued on Aug. 10, 2004 and U.S. Pat. No. 6,565,727, entitled "Actuators for Microfluidics Without Moving Parts," issued on Jan. 24, 2000, both to Shenderov et al.; Pollack et al., International Patent Application No. PCT/US2006/047486, entitled "Droplet-Based Biochemistry," filed on Dec. 11, 2006, the disclosures of which are incorporated herein by reference. Methods of the invention may be executed using droplet actuator systems, e.g., as described in International Patent Application No. PCT/US2007/009379, entitled "Droplet manipulation systems," filed on May 9, 2007. In various embodiments, the manipulation of droplets by a droplet actuator may be electrode mediated, e.g., electrowetting mediated or dielectrophoresis mediated. Examples of other methods of controlling fluid flow that may be used in the droplet actuators of the invention include devices that induce hydrodynamic fluidic pressure, such as those that operate on the basis of mechanical principles (e.g. external syringe pumps, pneumatic membrane pumps, vibrating membrane pumps, vacuum devices, centrifugal forces, and capillary action); electrical or magnetic principles (e.g. electroosmotic flow, electrokinetic pumps piezoelectric/ultrasonic pumps, ferrofluidic plugs, electrohydrodynamic pumps, and magnetohydrodynamic pumps); thermodynamic principles (e.g. gas bubble generation/phase-change-induced volume expansion); other kinds of surface-wetting principles (e.g. electrowetting, and optoelectrowetting, as well as chemically, thermally, and radioactively induced surface-tension gradient); gravity; surface tension (e.g., capillary action); electrostatic forces (e.g., electroosmotic flow); centrifugal flow (substrate disposed on a compact disc and rotated); magnetic forces (e.g., oscillating ions causes flow); magnetohydrodynamic forces; and vacuum or pressure differential. In certain embodiments, combinations of two or more of the foregoing techniques may be employed in droplet actuators of the invention.

"Droplet operation" means any manipulation of a droplet on a droplet actuator. A droplet operation may, for example, include: loading a droplet into the droplet actuator; dispensing one or more droplets from a source droplet; splitting, separating or dividing a droplet into two or more droplets; transporting a droplet from one location to another in any direction; merging or combining two or more droplets into a single droplet; diluting a droplet; mixing a droplet; agitating a droplet; deforming a droplet; retaining a droplet in position; incubating a droplet; heating a droplet; vaporizing a droplet; cooling a droplet; disposing of a droplet; transporting a droplet out of a droplet actuator; other droplet operations described herein; and/or any combination of the foregoing. The terms "merge," "merging," "combine," "combining" and the like are used to describe the creation of one droplet from two or more droplets. It should be understood that when such a term is used in reference to two or more droplets, any combination of droplet operations that are sufficient to result in the combination of the two or more droplets into one droplet may be used. For example, "merging droplet A with droplet B," can be achieved by transporting droplet A into contact with a stationary droplet B, transporting droplet B into contact with a stationary droplet A, or transporting droplets A and B into contact with each other. The terms "splitting," "separating" and "dividing" are not intended to imply any particular outcome with respect to volume of the resulting droplets (i.e., the volume of the resulting droplets can be the same or different) or number of resulting droplets (the number of resulting droplets may be 2, 3, 4, 5 or more). The term "mixing" refers to droplet operations which result in more homogenous distribution of one or more components within a droplet. Examples of "loading" droplet operations include microdialysis loading, pressure assisted loading, robotic loading, passive loading, and pipette loading. Droplet operations may be electrode-mediated. In some cases, droplet operations are further facilitated by the use of hydrophilic and/or hydrophobic regions on surfaces and/or by physical obstacles.

"Filler fluid" means a fluid associated with a droplet operations substrate of a droplet actuator, which fluid is sufficiently immiscible with a droplet phase to render the droplet phase subject to electrode-mediated droplet operations. The filler fluid may, for example, be a low-viscosity oil, such as silicone oil. Other examples of filler fluids are provided in International Patent Application No. PCT/US2006/047486, entitled, "Droplet-Based Biochemistry," filed on Dec. 11, 2006; and in International Patent Application No. PCT/US2008/072604, entitled "Use of additives for enhancing droplet actuation," filed on Aug. 8, 2008. The filler fluid may fill the entire gap of the droplet actuator or may coat one or more surfaces of the droplet actuator.

"Immobilize" with respect to magnetically responsive beads, means that the beads are substantially restrained in position in a droplet or in filler fluid on a droplet actuator. For example, in one embodiment, immobilized beads are sufficiently restrained in position to permit execution of a splitting operation on a droplet, yielding one droplet with substantially all of the beads and one droplet substantially lacking in the beads.

"Magnetically responsive" means responsive to a magnetic field. "Magnetically responsive beads" include or are composed of magnetically responsive materials. Examples of magnetically responsive materials include paramagnetic materials, ferromagnetic materials, ferrimagnetic materials, and metamagnetic materials. Examples of suitable paramagnetic materials include iron, nickel, and cobalt, as well as metal oxides, such as $Fe_3O_4$, $BaFe_{12}O_{19}$, CoO, NiO, $Mn_2O_3$, $Cr_2O_3$, and CoMnP.

"Washing" with respect to washing a magnetically responsive bead means reducing the amount and/or concentration of one or more substances in contact with the magnetically responsive bead or exposed to the magnetically responsive bead from a droplet in contact with the magnetically responsive bead. The reduction in the amount and/or concentration of the substance may be partial, substantially complete, or even complete. The substance may be any of a wide variety of substances; examples include target substances for further analysis, and unwanted substances, such as components of a sample, contaminants, and/or excess reagent. In some embodiments, a washing operation begins with a starting droplet in contact with a magnetically responsive bead, where the droplet includes an initial amount and initial concentration of a substance. The washing operation may proceed using a variety of droplet operations. The washing operation may yield a droplet including the magnetically responsive bead, where the droplet has a total amount and/or concentration of the substance which is less than the initial amount and/or concentration of the substance. Examples of suitable washing techniques are described in Pamula et al., U.S. Pat. No. 7,439,014, entitled "Droplet-Based Surface Modification and Washing," granted on Oct. 21, 2008, the entire disclosure of which is incorporated herein by reference.

The terms "top," "bottom," "over," "under," and "on" are used throughout the description with reference to the relative positions of components of the droplet actuator, such as relative positions of top and bottom substrates of the droplet actuator. It will be appreciated that the droplet actuator is functional regardless of its orientation in space.

When a liquid in any form (e.g., a droplet or a continuous body, whether moving or stationary) is described as being "on", "at", or "over" an electrode, array, matrix or surface, such liquid could be either in direct contact with the electrode/array/matrix/surface, or could be in contact with one or more layers or films that are interposed between the liquid and the electrode/array/matrix/surface.

When a droplet is described as being "on" or "loaded on" a droplet actuator, it should be understood that the droplet is arranged on the droplet actuator in a manner which facilitates using the droplet actuator to conduct one or more droplet operations on the droplet, the droplet is arranged on the droplet actuator in a manner which facilitates sensing of a property of or a signal from the droplet, and/or the droplet has been subjected to a droplet operation on the droplet actuator.

7 BRIEF DESCRIPTION OF THE FIGURES

FIGS. 1A, 1B, 1C, 1D, and 1E illustrate top views of an electrode configuration and process of dispensing droplets having a predetermined volume;

FIGS. 2A, 2B, and 2C illustrate top views of an electrode configuration and process of dispensing droplets having more accurate and/or precise volumes by controlling the drainage of the droplet during the droplet formation process;

FIGS. 3A, 3B, and 3C illustrate top views of electrode configurations that include an intermediate electrode or electrode configuration for controllably dispensing droplets having more accurate and/or precise volumes FIGS. 4A and 4B illustrate a top and side view, respectively, of a droplet actuator electrode configuration and its use in a process of staged droplet dispensing;

Figure 13:
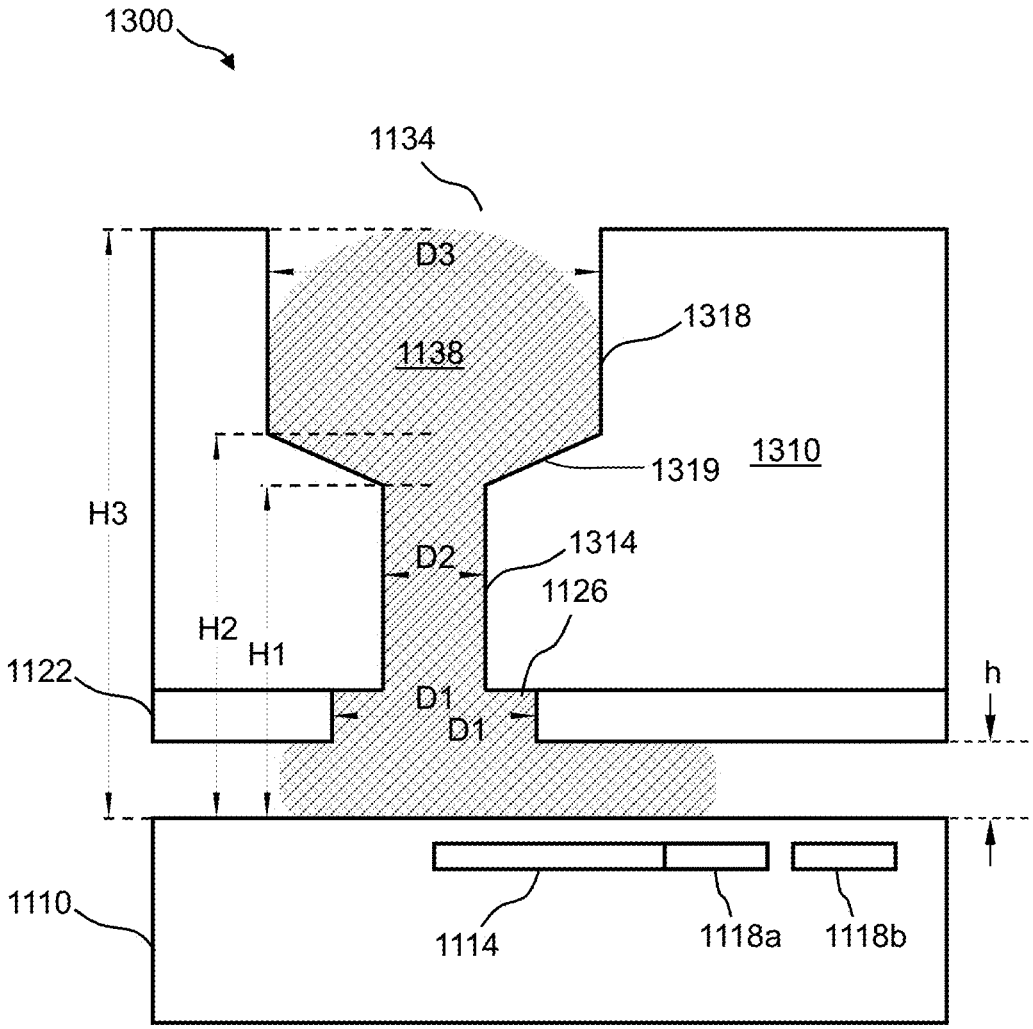
Figure 14A:
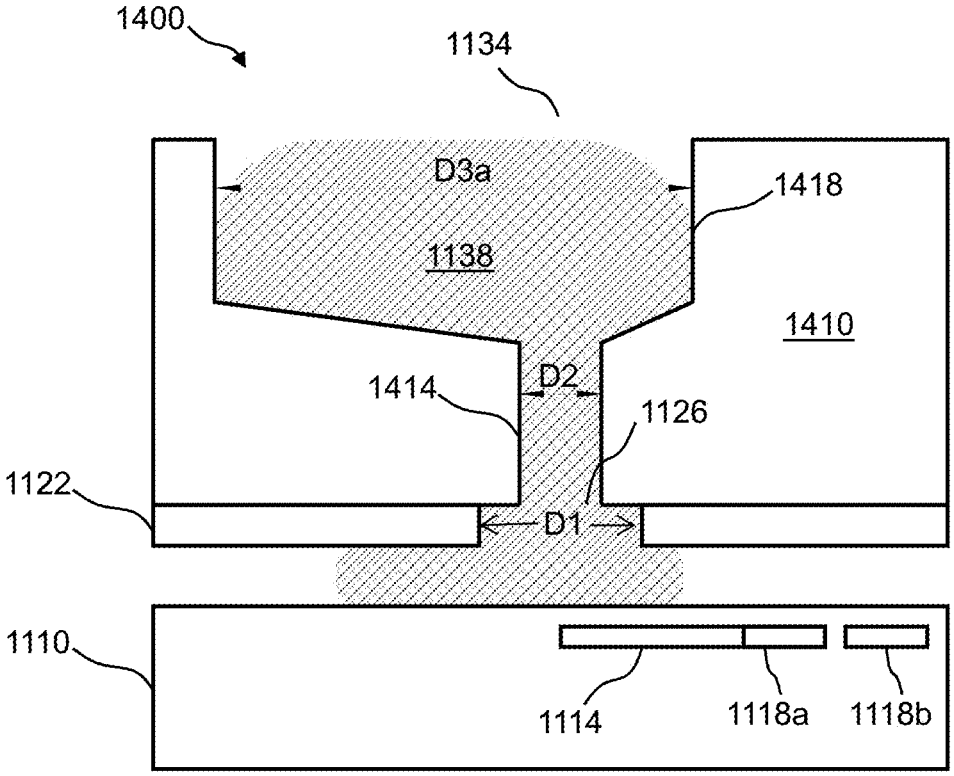
Figure 14B:
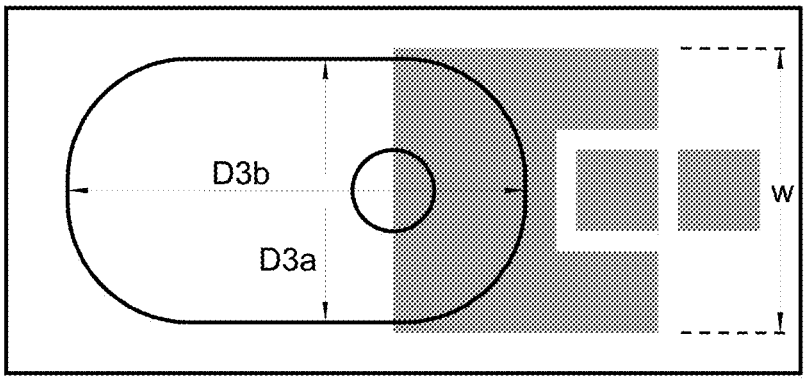
Figure 15:
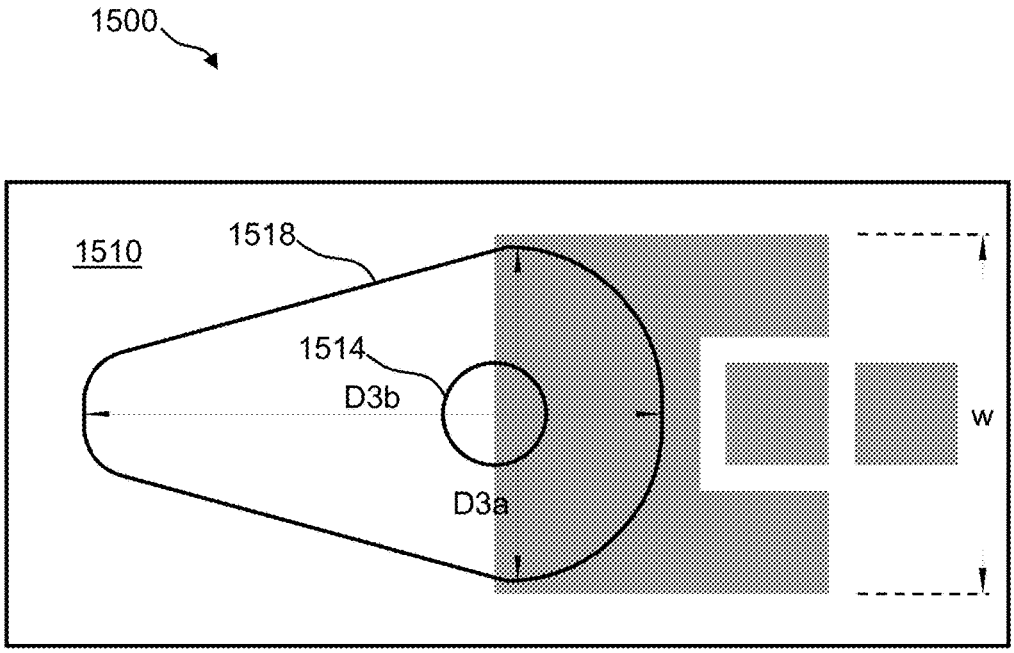
Figure 16:
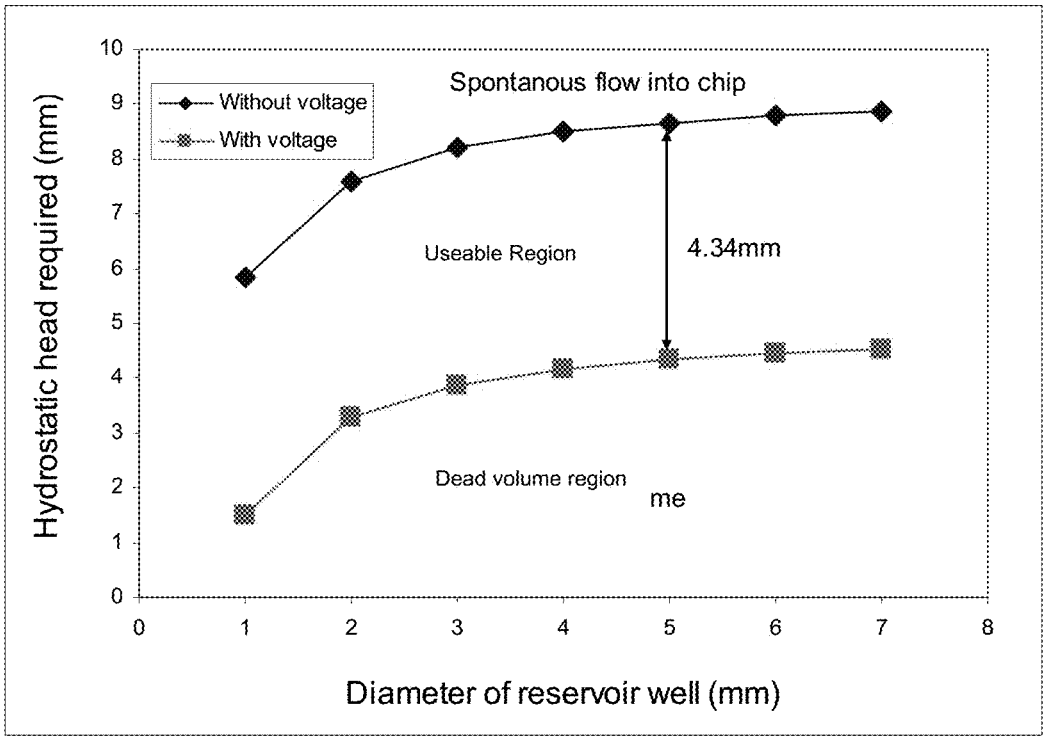

FIGS. 12A, 12B, 12C, and 12D illustrate side views of another droplet actuator configuration including a reservoir for input/output of operations fluid;

FIG. 13 illustrates a side view of another droplet actuator configuration including a reservoir for input/output of operations fluid;

FIGS. 14A and 14B illustrate a side view and a top view of another droplet actuator configuration including a reservoir for input/output of operations fluid;

FIG. 15 illustrates a top view of another droplet actuator configuration including a reservoir for input/output of operations fluid;

FIG. 16 is a graph showing typical behavior of a hydrostatic head requirement while varying the diameter of the reservoir well.

8 DESCRIPTION

The invention provides droplet actuators and methods for conducting droplet operations on a droplet actuator. For example, the invention provides droplet actuator configurations and techniques for improved droplet loading, splitting and/or dispensing in a droplet actuator. The droplet actuators of the invention may in some cases include various modified electrode configurations. In some embodiments, the droplet actuators and methods of the invention are useful for dispensing droplets having a varied volume (e.g., analog metering of droplets). In some embodiments, the droplet actuators of the invention are useful for dispensing droplets having more accurate and/or precise volumes by controlling the drainage of the droplet during the droplet formation process. In some embodiments, the droplet actuator and methods of the invention a useful for facilitating staged droplet dispensing. Certain embodiments make use of an electrode configuration that employs one or more physical structures for assisting with the droplet splitting operation. Priming operations are also provided. The invention also provides a droplet actuator that uses a reservoir associated with the top substrate for operations fluid input/output (I/O). Examples of embodiments of the operations fluid I/O mechanisms of the invention may include a droplet actuator that has a reservoir electrode feeding an arrangement of electrodes (e.g., electrowetting electrodes), a top substrate that has a opening positioned in relation to the reservoir electrode, and a reservoir substrate that has a reservoir that is positioned in relation to the opening in the top substrate. Other embodiments of the invention will be apparent from the ensuing discussion in light of the definitions provided above.

8.1 Electrode Configurations for Analog Metering of Droplets

Figure 1A:
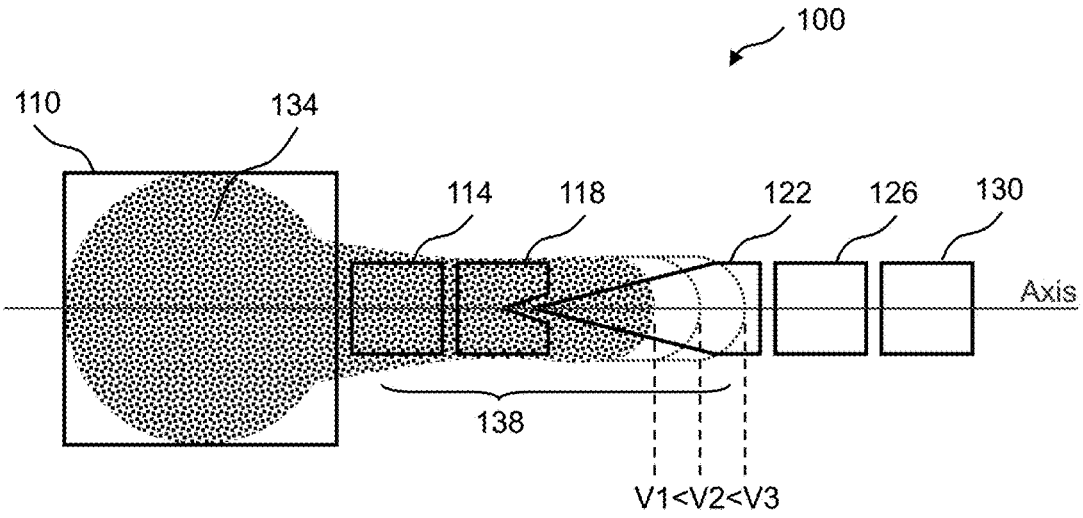
Figure 1B:
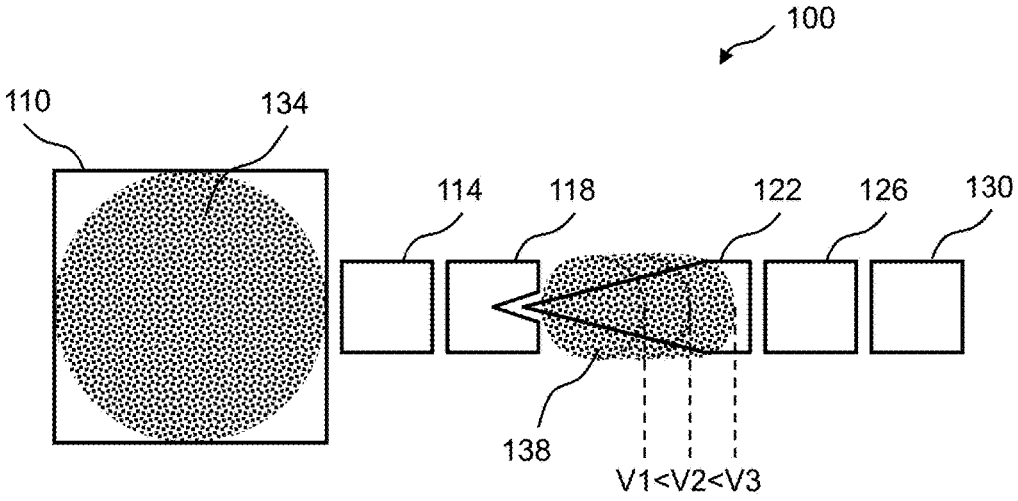

FIGS. 1A and 1B illustrate top views of an electrode configuration 100 and process of dispensing droplets having a predetermined volume. The volume of the dispensed droplets may be selected in an analog or digital fashion. Electrode configuration 100 is configured relative to a droplet operations surface such that electrodes in electrode configuration 100 may be used to conduct droplet operations on the droplet operations surface. Electrode configuration 100 includes a reservoir electrode 110, which serves as a liquid source for droplet dispensing operations, positioned in proximity to a configuration of dispensing electrodes 114, 118, 122.

Dispensing electrodes 114, 118, 122 may be configured for dispensing a droplet within a certain range of droplet volumes. In the embodiment illustrated, the dispensing electrodes include electrode 114 that has a standard droplet operations electrode geometry, an electrode 118 that has a standard droplet operations geometry with a notch or indention therein, and a generally triangular-shaped electrode 122. The narrow end of triangular-shaped electrode 122 is oriented toward reservoir electrode 110 and situated within the notch or indentation of electrode 118. The wide end of triangular-shaped electrode 122 is in proximity with a path of droplet operations electrodes (e.g., dielectrophoresis or electrowetting electrodes), such as electrodes 126 and 130. The electrode configuration is aligned along an axis which passes through a center of each of the electrodes in the configuration, though it will be appreciated that a straight, linear axis is helpful but not required for the operation of the invention.

FIG. 1A shows a volume of liquid 134 positioned atop reservoir electrode 110. When electrode 114, electrode 118, and triangular-shaped electrode 122 are activated, a droplet extension 138 is flows out of the volume of liquid 134 at reservoir electrode 110 and onto the activated electrodes. Droplet extension 138 generally conforms to the shape of the activated droplet operations electrodes.

The length of the droplet extension 138 depends on the voltage applied to triangular-shaped electrode 122. Increasing the voltage applied increases the length of the droplet extension 138. For example, when a voltage V1 is applied to triangular-shaped electrode 122, the droplet extension 138 extends a certain distance. When a voltage V2, which is greater than voltage V1, is applied to triangular-shaped electrode 122, the droplet extension 138 extends a certain greater distance. When a voltage V3, which is greater than voltage V2, is applied to triangular-shaped electrode 122, the droplet extension 138 extends a certain greater distance still. Voltage may be varied in discrete steps and/or in an analog fashion.

Referring to FIG. 1B, once the droplet extension 138 extends to a desired distance on the droplet operations surface, one or both of electrodes 114 and 118 may be deactivated, while triangular-shaped electrode 122 remains activated. The deactivation of the intermediate electrodes causes a droplet 138 to be formed atop triangular-shaped electrode 122. The volume of droplet 138 depends on the voltage applied at triangular-shaped electrode 122. For example, when voltage V1 is applied to triangular-shaped electrode 122, droplet 138 is a certain volume. When voltage V2, which is greater than voltage V1, is applied to triangular-shaped electrode 122, droplet 138 has a certain greater volume. When a voltage V3, which is greater than voltage V2, is applied to triangular-shaped electrode 122, droplet 138 is a certain greater volume still.

The aspect of the invention that is illustrated in FIGS. 1A and 1B provides a method to vary the volume of dispensed droplets on the droplet actuator. The volume may be varied in an analog fashion or a digital fashion. The method makes use of a set of droplet dispensing electrodes, including one or more intermediate electrodes and an elongated terminal electrode. By varying the voltage applied to the elongated terminal electrode, the volume of dispensed droplets may be controllably varied. The elongated terminal electrode may be configured in any manner which permits the length of the droplet extension to be controlled atop the elongated electrode. For example, the control may be effected by controlling voltage supplied to the elongated electrode. In alternative embodiments, the terminal electrode may be laterally elongated or both laterally and axially (relative to the axis of the electrode path) elongated.

The elongated electrode may be generally triangular, having an apex pointed towards the region in which the droplet splits away from the parent droplet during dispensing. Other tapering electrode shapes, such as trapezoids (e.g., an isosceles trapezoid), trapeziums, elongated pentagons, elongated hexagons, and other elongated polygonal (e.g., elongated polygons that are generally symmetrical with respect to a centrally located axis extending along the length of the elongated polygon) shapes, may be used. In the triangular embodiment illustrated, increasing the voltage applied to the triangular-shaped electrode causes the droplet extension to extend away from the apex towards the wide end of the triangle. Thus, by simply controlling the voltage on that dispensing electrode, a longer or shorter droplet extension may be formed, and the volume of the dispensed droplet may be controlled.

Figure 1C:
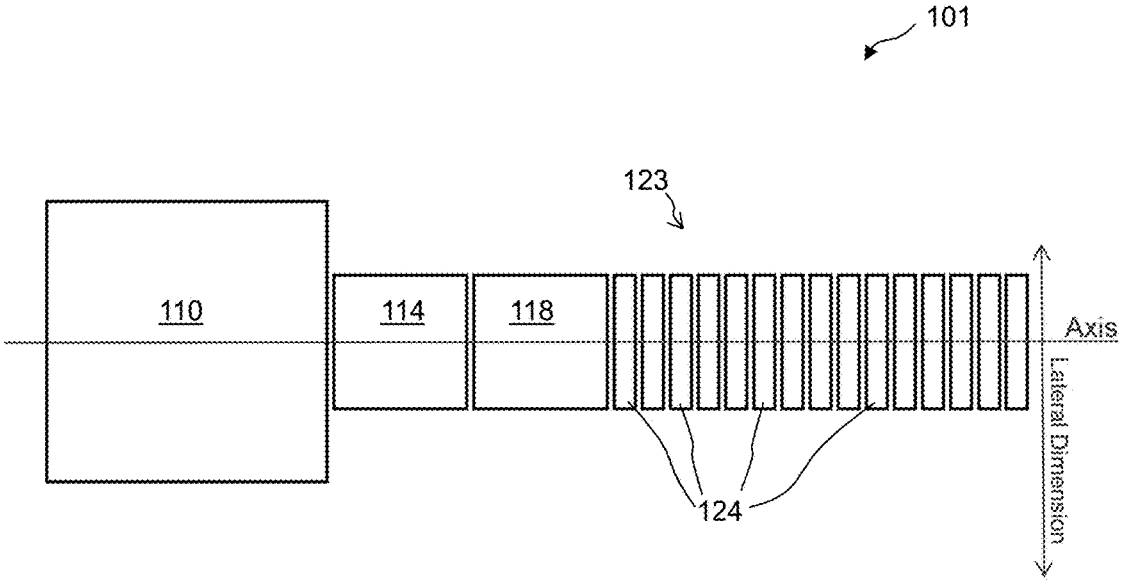

FIG. 1C illustrates an alternative in which the tapering electrode is replaced with a series of electrode bars. Electrode configuration 101 includes a dispensing electrode, droplet operations electrodes 114 and 118 and bar configuration 123, which is composed of a series of electrode bars 124. Electrode bars 124 may be oriented in any manner in which sequential activation of electrode bars beginning with the bar that is proximal with respect to electrode 118 and continuing in the direction of the electrode bar 124 that is distal with respect to electrode 118 will incrementally expand the volume atop electrode configuration 123. Once a predetermined volume atop electrode configuration 123 is achieved, the droplet may be formed by deactivating an intermediate droplet operations electrode, such as electrode 118 or electrode 114. In one embodiment, electrode bars 124 have a dimension lateral to an axis which is similar to the lateral dimension of the adjacent droplet operations electrode 118. In one embodiment, electrode bars 124 have a dimension lateral to an axis which is approximately the same as the lateral dimension of the adjacent droplet operations electrode 118. In one embodiment, the axial dimension of the electrode bars ranges from about 0.75 to about 0.01% of the axial dimension of the adjacent droplet operations electrode 118. In another embodiment, the axial dimension of the electrode bars ranges from about 0.5 to about 0.1% of the axial dimension of the adjacent droplet operations electrode 118. In another embodiment, the axial dimension of the electrode bars ranges from about 0.25 to about 0.1% of the axial dimension of the adjacent droplet operations electrode 118.

The control may in some cases be effected by a field gradient produced across the electrode. For example, the field gradient may cause a lengthening in the droplet extension as voltage is increased. Examples of other techniques for establishing a field gradient across the electrode are gradients in the dielectric constant of the dielectric material atop the electrode caused by doping or thickness of the dielectric material, using various electrode patterns or shapes. Examples are discussed below. The terminal electrode may be provided in any configuration or include any structure or shape which causes the length of the droplet extension to depend on the characteristics of the terminal electrode, such as the voltage applied to the terminal electrode. For example, the electrode may be vertically thicker at one terminus then at the other terminus. Further, various embodiments may be provided in which one or more counter electrodes are also utilized to control the length of the droplet extension across the terminal electrode.

The volume control facilitated by the novel dispensing techniques described herein has a wide variety of uses. In one example, droplet volume control facilitates variable-ratio mixing. Instead of executing multiple complex droplet operations in a binary mixing tree to produce droplets having the desired mixing ratio, droplets having the desired volume may simply be dispensed and combined. For example, if a mixing ratio of 1.7-to-1 is desired, a droplet having a volume of 1.7 units may be dispensed and combined with a droplet having volume of 1 unit.

In some embodiments, the extension of the droplet extension along the elongated electrode may be further controlled by detecting the extent of the droplet extension and effecting droplet formation when the droplet extension has achieved a certain predetermined length. Examples of such detection modalities include visual detection, detection based on imaging, and various detection techniques based on electrical properties of the droplet extension (e.g., electrical properties of the droplet extension relative to the surrounding filler fluid). For example, capacitance detection techniques may be used in some embodiments for determining or monitoring the droplet extension length.

Feedback mechanisms may be used to control the formation of droplets, such as splitting or dispensing of droplets. For example, feedback mechanisms may be used in a droplet formation process to control the volume of a sub-droplet.

Formation of new droplets requires the formation and breaking of a meniscus connecting the two liquid bodies, generally referred to herein as "necking" and "splitting," respectively. A feedback mechanism can be used to monitor the shape and position of the droplet and/or meniscus to determine whether breaking would result in unequal or out of specification droplet volumes. Adjustments can then be made to voltage and/or timing of adjustments to voltage. For example, impedance sensing may be used to monitor the capacitive loading of the electrowetting electrode to infer droplet overlap and by inference, the volume supported by each electrode in the electrode splitting process. Other feedback mechanisms, such as image analysis are also suitable for use in the present invention. Feedback may be used to dynamically alter the applied voltage in magnitude, frequency and/or shape to result in more controlled droplet formation.

In one embodiment, capacitance at the elongated terminal electrode may be monitored to determine the volume of the droplet extension, and the one or more intermediate electrodes may be deactivated when the extension has reached a predetermined length sufficient to create a droplet having a desired droplet volume. For examples of suitable capacitance detection techniques, see Sturmer et al., International Patent Publication No. WO/2008/101194, entitled "Capacitance Detection in a Droplet Actuator," published on Aug. 21, 2008; and Kale et al., International Patent Publication No. WO/2002/080822, entitled "System and Method for Dispensing Liquids," published on Oct. 17, 2002; the entire disclosures of which are incorporated herein by reference. In another embodiment, impedance of the advancing contact line can be monitored by using electrodes that are separate from the electrodes used for manipulation of droplets. For example, elongated electrodes along the sides of electrodes 114, 118, 122, and 126 can be utilized to monitor the impedance of the advancing droplet. These elongated impedance measurement electrodes may be dedicated for measurement of impedance and they can be either strictly coplanar with the droplet operations electrodes or substantially coplanar or in another plane such as on the top plate.

Figure 1D:
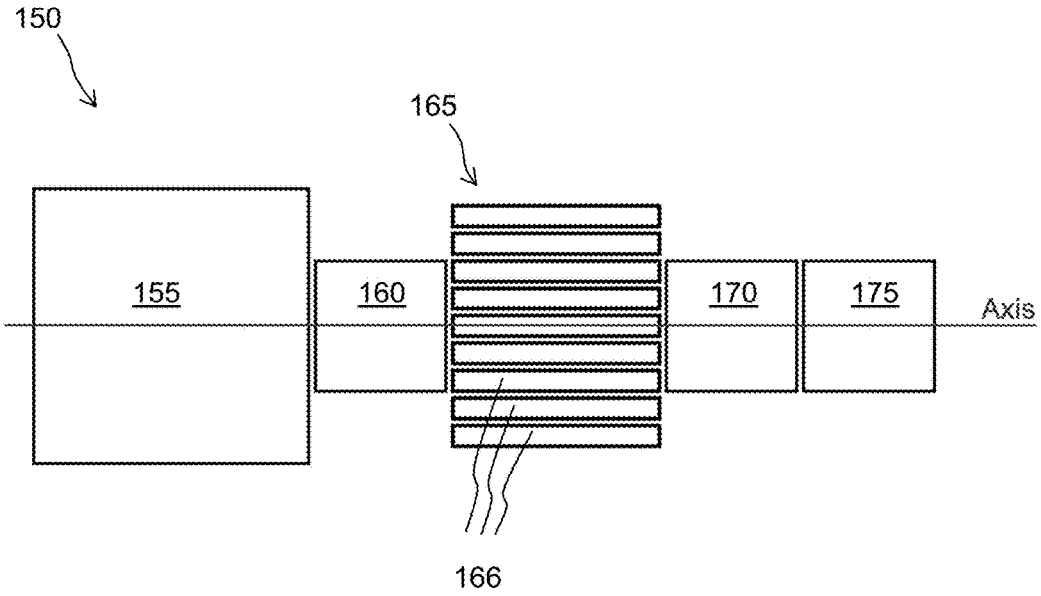
Figure 1E:
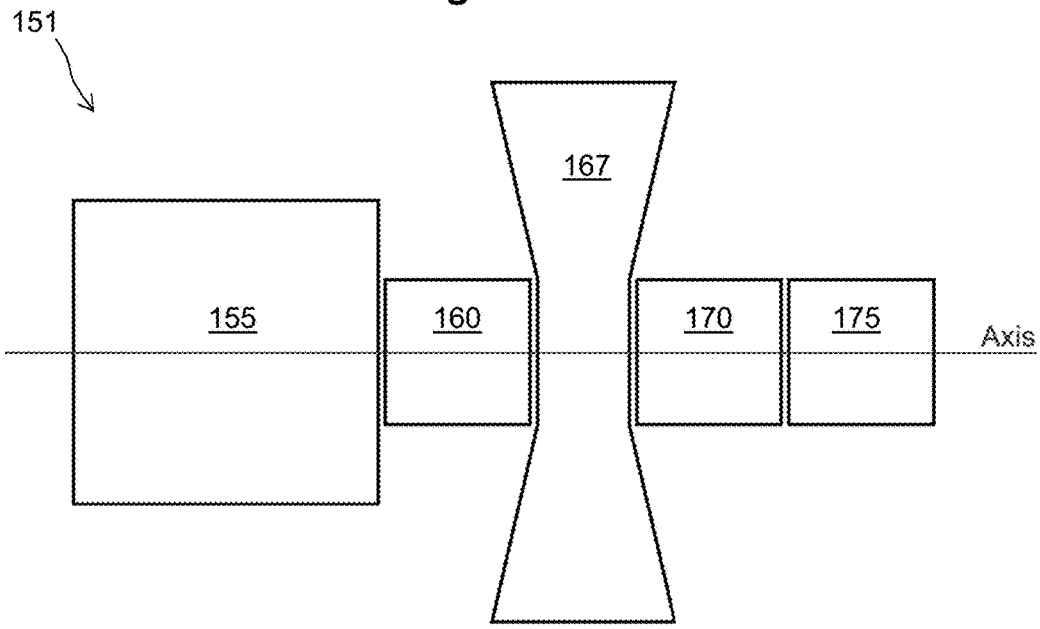

In some embodiments, variability in droplet volume is established using an intermediate electrode or electrode assembly rather than the terminal electrode. For example, referring to FIGS. 1D and 1E, dispensing configuration 150 or 151 includes a dispensing electrode 155, an intermediate electrode 160 for causing the droplet to split (which may in other embodiments, have any of the other intermediate or droplet splitting electrode configurations described herein), a laterally extended electrode 167 or electrode configuration 165, and a terminal electrode 170. Electrode 167 or electrode configuration 165 is laterally extended relative to the other electrodes in dispensing configuration 150 or 151. Dispensing configuration 150 may be associated with one or more additional droplet operations electrodes 175. In an alternative embodiment, the orientation of electrode 122 may be reversed, i.e., with the apex oriented distally with respect reservoir electrode 110 and the wide end oriented proximally with respect to reservoir electrode 110.

In the embodiment illustrated, the electrodes in the set are activated to cause the droplet to extend along the electrodes of dispensing configuration 150 and onto terminal electrode 170. In dispensing configuration 150, droplet volume may be controlled by selectively applying voltage to one or more sub-electrodes 166 of electrode configuration 165. In dispensing configuration 151, droplet volume may be controlled by varying the voltage applied to electrode 167; increasing the voltage increases the area of the laterally extended electrode that is covered by the droplet. When a predetermined volume has been reached, e.g., as observed or as calculated, intermediate electrode 160 is deactivated, causing the droplet to be formed on the laterally extended electrode 167 or electrode configuration 165 and terminal electrode 170. The laterally extended electrode may have any variety of shapes. For example, it may be circular, ovular, rectangular, diamond shaped, star shaped, hourglass shaped, etc. Any of the various techniques for creating a field gradient described herein with respect to the terminal electrode may also be used with respect to the laterally extended intermediate electrode. The various techniques may also be combined in a single electrode configuration and/or with respect to a single electrode. For example, the electric field may be controlled with dielectric doping, dielectric thickness, electrode doping, electrode thickness and/or electrode shape. The laterally extended intermediate electrode may be extended in one or both directions relative to an axis of the electrode set. Additional electrodes may be inserted between the electrodes described in the specifically illustrated examples without departing from the invention.

In another alternative embodiment, rather than changing the voltage at an electrode in order to create an electric field gradient, the gradient is produced by applying a predetermined voltage for predetermined period of time. Of course, combinations of the two approaches are also within the scope of the invention. This approach is suitable for the terminal elongated electrode technique, as well as the intermediate laterally extended electrode technique. The timing of the applied voltage may establish a particular droplet extension length prior to droplet formation. In this manner, a droplet having a predetermined volume may be dispensed. Because the transport time of the droplet extension may be predetermined, timing may be used to dispense a droplet having a predetermined volume. As an example, the timing of the applied voltage at the elongated or laterally extended electrode may be used for determining the droplet extension volume, which determines the droplet volume. Because the transport time of the droplet extension from one end of the elongated electrode to the other end may be predetermined, timing may be used to dispense a droplet having a predetermined volume. Similarly, because the time it takes the droplet to cover the laterally extended electrode varies with time, the volume can be predicted based on the duration of electrode activation. In various other embodiments, timing of voltage applied may be combined with changes in voltage in order to determine the length of the droplet extension and thereby determine the volume of the droplet dispensed.

The invention provides related embodiments in which the electric field gradient is established by electrode shape and/or means other than electrode shape. In addition to shape, a patterned field gradient may be mediated by the electrical characteristics of the electrode and/or electrical characteristics of materials associated with the electrode, such as dielectric and/or other coatings atop the electrode. The electrode itself may be patterned, e.g., as illustrated by electrode 805 in FIG. 8. The electrode may be composed of different conductive materials patterned to provide a desired patterned field gradient. Conductive and/or non-conductive materials with differing electrical conductivity may be patterned to form a single electrode which produces a patterned field gradient. Similarly, conductive materials with differing electrical conductivity may be patterned to form a single electrode which produces a patterned field gradient.

Materials associated with an electrode may be patterned in a manner which produces a patterned field gradient. The dielectric material situated atop the electrode may be patterned to establish a dielectric topography in which various regions atop an electrode have different dielectric constants. The dielectric topography may thus produce a patterned field gradient. Patterning of dielectric materials atop the electrode may be based on thickness patterns established in the dielectric material. Materials with different dielectric constants may be patterned atop the electrode to establish the dielectric topography.

Among other things, the techniques for establishing patterned field gradients may be used to mimic the effects of droplet operations conducted on groups of electrodes or droplet operations produced by specially shaped electrodes. The patterned field gradient may exhibit characteristics which mimic the electric field produced by electrodes having certain shapes, non-limiting examples of which include electrode 122 of FIG. 1A, electrode configuration 123 of FIG. 1C, electrode 166 of FIG. 1D, electrode 167 of FIG. 1E, electrode 805 of FIG. 8. The patterned field gradient may exhibit characteristics which mimic electrode configurations, such as electrode configuration 165 of FIG. 1C, electrode configuration 214 of FIG. 2A, electrode configuration 314 of FIG. 3A, electrode configuration 356 of FIG. 3B, electrode configuration 165 of FIG. 3C, and various combinations of electrodes 614*a*, 614*b*, 614*c*, and 618 of FIG. 6A. Similarly, various standard electrode configurations for conducting droplet operations described here and known in the art may be replaced or supplemented with techniques that effect a patterned field gradient, such as those techniques described here. For example, field gradients may be produced which effect loading of a droplet into the droplet actuator; dispensing of one or more droplets from a source droplet; splitting, separating or dividing a droplet into two or more droplets; transporting a droplet from one location to another in any direction; merging or combining two or more droplets into a single droplet; diluting a droplet; mixing a droplet; agitating a droplet; deforming a droplet; retaining a droplet in a specific position; incubating a droplet; heating a droplet; vaporizing a droplet; cooling a droplet; disposing of a droplet; transporting a droplet out of a droplet actuator; and various combinations of the foregoing. As an example, in a droplet splitting operation, a field gradient across three electrodes may be established such that at a first, higher voltage, an elongated droplet will form along the elongated electrode, and at a second, lower, voltage the droplet will split, yielding two daughter droplets.

In one embodiment, the field gradient is patterned to effect controllable droplet extension over time or with changes in voltage applied to the electrode, e.g., as described with respect to electrode 122 of FIGS. 1A and 1B. For example, a field gradient at a terminal electrode may vary in a manner which effects controllable droplet extension over time or with changes in voltage applied to the electrode. In another example, a terminal electrode may be configured using a trace technique, such as that described with respect to electrode 805 of FIG. 8, which effects controllable droplet extension over time or with changes in voltage applied to the electrode.

Figure 2A:
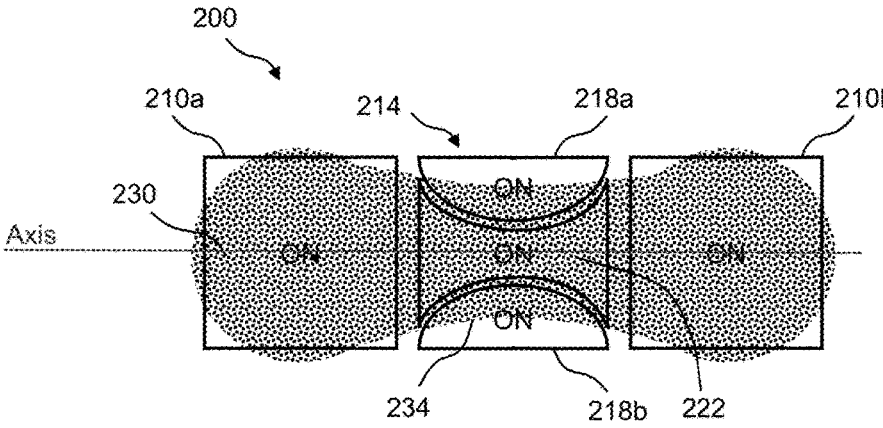
Figure 2B:
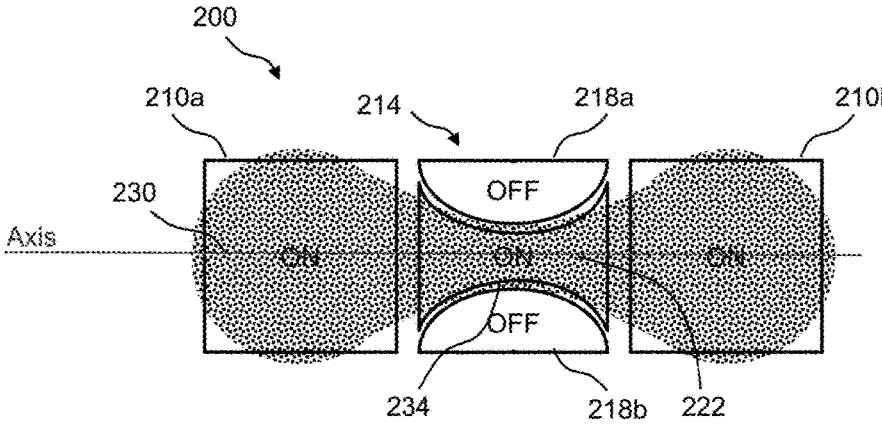
Figure 2C:
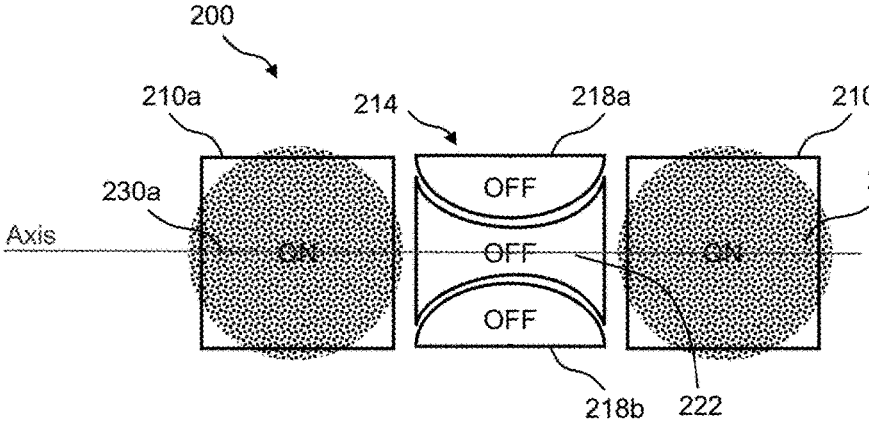

FIGS. 2A, 2B, and 2C illustrate top views of an electrode configuration 200 and process of dispensing droplets having more accurate and/or precise volumes by controlling the drainage of the droplet during the droplet formation process. Electrode configuration 200 includes electrodes 210*a* and 210*b* (e.g., electrowetting electrodes) having an intermediate droplet splitting electrode configuration 214 arranged therebetween. In the embodiment illustrated, intermediate electrode configuration 214 is formed of two lateral electrodes 218 (e.g., lateral electrodes 218*a* and 218*b* having a semicircle geometry) and a necking electrode 222 (e.g., having an hourglass type geometry) arranged between the two lateral electrodes, e.g., as shown in FIGS. 2A, 2B, and 2C.

FIGS. 2A, 2B, and 2C illustrate a sequence of steps for performing a droplet splitting operation using electrode configuration 200. First, as shown in FIG. 2A, an elongated droplet 230 is formed across electrode configuration 200 by activating electrode 210*a*, all parts of electrode configuration 214, and electrode 210*b*. Second, as shown in FIG. 2B, electrodes 218*a* and 218*b* are deactivated, while all other electrodes in electrode configuration 200 remain activated. Deactivation of electrodes 218*a* and 218*b* initiates a necking process in which an intermediate region of droplet 230 atop intermediate electrode configuration 214 is reduced in width. Droplet 230 still spans electrode configuration 200 from electrode 218*a* to electrode 218*b*; however, the width of neck 234 of slug 230 is controllably reduced, generally conforming to the shape of necking electrode 222. Third, as shown in FIG. 2C, necking electrode 222 is deactivated, while electrodes 218*a* and 218*b* remain activated. At this point in the process, the entire intermediate electrode to 14 has been deactivated, causing the neck 234 to break, yielding two daughter droplets 230*a* and 230*b*. Either of electrodes 210*a* and 210*b* may be replaced with a larger reservoir electrode. Additional electrodes may be inserted between the electrodes described in the specifically illustrated examples without departing from the invention.

The embodiment shown in FIG. 2 is illustrative of a variety of embodiments in which necking is controlled during droplet dispensing in order to produce one or more daughter droplets having a predetermined volume. In these embodiments, a path of droplet operations electrodes is provided. The path includes one or more intermediate electrode configurations. Droplet splitting occurs at the intermediate electrode configurations. The intermediate electrode configurations are configured to permit a multi-step droplet necking-and-splitting operation. Generally speaking, the controlled necking-and-splitting is effected by sequentially deactivating electrodes beginning with electrodes adjacent to an edge of the droplet, such as electrodes 218*a* and 218*b* and continuing to centrally positioned electrodes, such as electrode 222.

The invention provides related embodiments, in which the electric field is controllably manipulated to reduce the electric field from an outer edge of the region of the neck of the droplet towards a central region of the neck of the droplet, thereby yielding a similarly controlled necking-and-splitting process. For example, in some embodiments a single intermediate electrode may be provided, and the dielectric material atop the intermediate electrode may establish a dielectric topography which effects controllable necking-and-splitting as voltage at the intermediate electrode is reduced. In another embodiment, a single intermediate electrode may be provided, and the electrode itself may be doped, patterned, shaped, and/or spatially oriented in a manner which effects controllable necking-and-splitting as voltage at the intermediate electrode is reduced. In yet another technique, the splitting electrode may be configured using a trace technique, such as that described with respect to FIG. 8, to provide controllable necking as voltage is reduced on the electrode.

The patterned field gradient techniques described herein may be used to effect a stepwise controlled necking-and-splitting process similar to the process effected by electrode configuration 214. For example, electrode 214 may be replaced with a standard droplet operations electrode such as electrode 210*a*. The patterned field gradient techniques may produce an electric field which at a first, higher, voltage causes the droplet to elongate across the three electrodes as illustrated in FIG. 2A. At a second, reduced, voltage, the droplet conforms to a second electrowetting pattern which is similar to the pattern illustrated in FIG. 2B. At a third voltage, reduced still further or deactivated, the neck breaks, forming 2 daughter droplets on the flanking electrodes, as illustrated in FIG. 2C. Similarly, the patterned field gradient techniques may be used to effect an analog or substantially analog necking and splitting process, in which the droplet neck gradually narrows and then breaks as voltage to the electrode is reduced in an analog or substantially analog fashion.

Figure 3A:
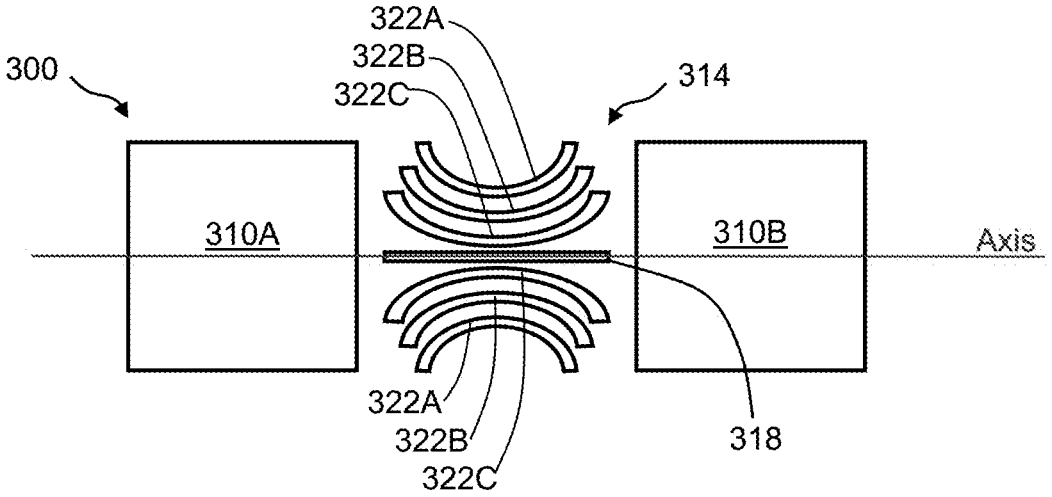

FIG. 3A illustrates a top view of an electrode configuration 300 that includes an intermediate electrode configuration 314 for controllably dispensing droplets having more accurate and/or precise volumes. Intermediate electrode configuration 314 enhances accuracy and/or precision of droplet volume by controlling the drainage of liquid from the neck region of an elongated droplet during the droplet formation process. Electrode configuration 300 includes electrodes 310*a* and 310*b* (e.g., electrowetting electrodes) and an intermediate droplet splitting electrode configuration 314 that is arranged therebetween. Intermediate electrode configuration 314 includes a set of necking electrodes 322.

Figure 9:
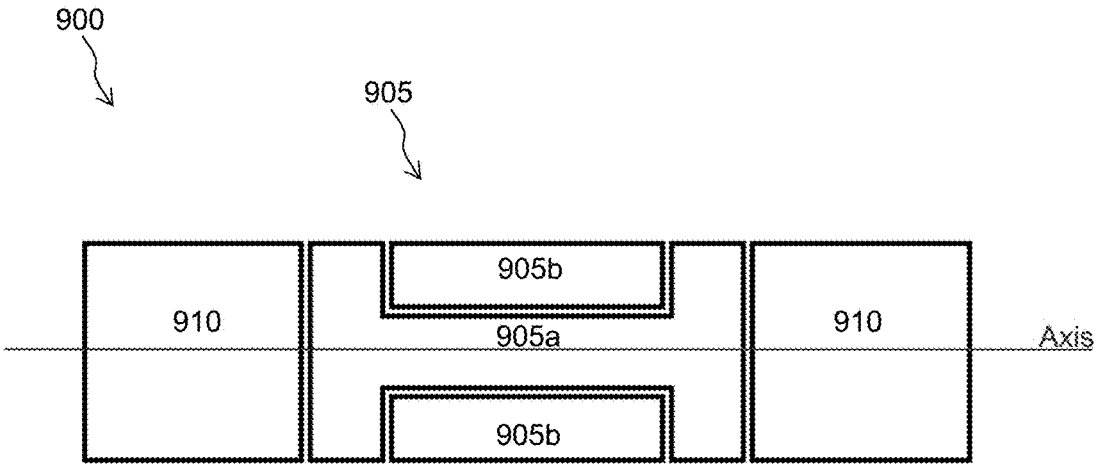
FIG. 9 illustrates an electrode configuration that includes an intermediate necking-and-splitting electrode configuration flanked by droplet operations electrodes.

Necking electrodes 322 are generally shaped in a manner which permits them to mimic the curve of the edge of the neck of a droplet during a splitting operation. In the embodiment illustrated, three necking electrodes 322A, 322B, and 322C are provided on either side of a central necking electrode 318. Necking electrodes 322 are generally convex in the direction of the edge of the neck of the droplet. Where a central necking electrode 318 is present, necking electrodes 322 may be generally convex in a direction which is away from necking electrode 318. Where a central necking electrode 318 is not present, necking electrodes 322 may be generally convex away from a central axis extending from a centrally located point on electrode 310A to a centrally located point on electrode 310B. Central necking electrode 318 is generally symmetrical and centrally located relative to necking electrodes 322. In the embodiment illustrated, central necking electrode 318 is generally linear; however, it will be appreciated that other geometries are possible within the scope of the invention. For example, central necking electrode 318 may have an hourglass shape similar to electrode 322 in FIG. 2. Central necking electrode 318 may also be I-shaped, e.g., as illustrated in FIG. 9 below.

Compared with intermediate electrode configuration 214 of FIG. 2, intermediate electrode configuration 314 of FIG. 3A shows a finer pattern of electrodes (i.e., finer gradient). Each electrode segment of intermediate electrode configuration 314 is independently controlled or alternatively matching sets may be independently controlled together. For example, electrodes 322A on either side of intermediate electrode 318 may be controlled together; electrodes 322B may be controlled together; and electrode 322C may be controlled together. As a result, the deactivation of each electrode pair during the droplet formation may be effected in a deactivation sequence selected to control the neck volume (i.e., drainage) of the elongated droplet (not shown).

In operation, all of electrodes 310A, 310B and some or all of intermediate electrodes 314 may be activated to elongate a droplet across electrode configuration 300. Intermediate electrodes may be sequentially deactivated to controllably cause a neck-and-split droplet formation operation.

For example, electrodes 322A may be deactivated, followed by electrodes 322B, followed by electrodes 322C, followed by central necking electrode 318. As each set of electrodes is sequentially deactivated, the diameter of the neck of the elongated droplet gradually narrows and is broken. Controlling the drainage of liquid from the neck of the droplet during the droplet splitting operation may enhance the accuracy and/or precision of dispensed droplet volumes. Either of electrodes 310*a* and 310*b* may be replaced with a larger reservoir electrode. Additional electrodes may be inserted between the electrodes described in the specifically illustrated example without departing from the invention.

Figure 3B:
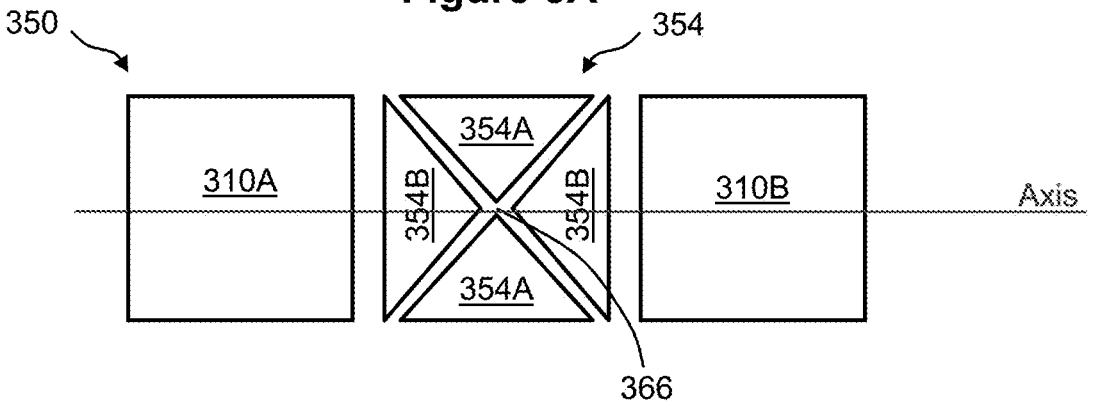

FIG. 3B illustrates a top view of an electrode configuration 350 that includes an intermediate electrode configuration 354 configured for dispensing droplets. Droplets dispensed using electrode configuration 350 may have more accurate and/or precise volumes due to control on the necking process exerted by intermediate electrodes 354 during droplet formation.

Electrode configuration 350 includes electrodes 310A and 310B (e.g., electrowetting electrodes). An intermediate electrode configuration 354 is arranged between electrodes 310A and 310B. Intermediate electrode configuration 354 includes a set of geometrically similar triangular-shaped electrodes 354. Electrodes 354 are arranged to form a square. It will be appreciated that various alternative arrangements are possible. More than four triangular electrodes may be used. The triangular electrodes may be elongated or shortened relative to the triangular electrodes shown in FIG. 3B, e.g., an elongated configuration 356 is shown in FIG. 3C.

As illustrated, intermediate electrode configuration 354 includes electrodes 354A and electrodes 354B. Electrodes 354A are configured to help control the necking of the elongated droplet during a droplet splitting operation. Electrodes 354A include outer edges that are generally parallel with each other and generally parallel with and contiguous with the outer edge of the elongated droplet. Electrodes 354A each have an apex which is pointed towards a generally central point within intermediate electrode configuration 354. Electrodes 354B at a configuration which is generally identical to the configuration of electrodes 354A, except that electrodes 354B are arranged at a right angle relative to electrodes 354A. Together, electrodes 354A and electrodes 354B form an intermediate electrode configuration 354, which is generally square shaped. In an alternative embodiment, the overall shape of the configuration may be hourglass shaped (e.g., similar to electrode 222 in FIG. 2A), or H-shaped (e.g., similar to electrode 905*a* in FIG. 9).

Each electrode of intermediate electrode configuration 354 may be independently controlled. Alternatively, electrodes 354A may be controlled together, while electrodes 354B may be controlled together. Deactivation of electrodes 354A during droplet formation assists in the control of droplet necking-and-splitting. In a splitting operation, electrodes 310A, 310B and electrode configuration 354 may be activated to cause an elongated droplet to extend across electrode configuration 350. Electrodes 354A may be deactivated to initiate necking. Electrodes 354B may be deactivated to effect droplet splitting, yielding two daughter droplets. Similar embodiments with a greater number of triangular electrodes can readily be envisioned by one of skill in the art in light of the instant disclosure.

Figure 3C:
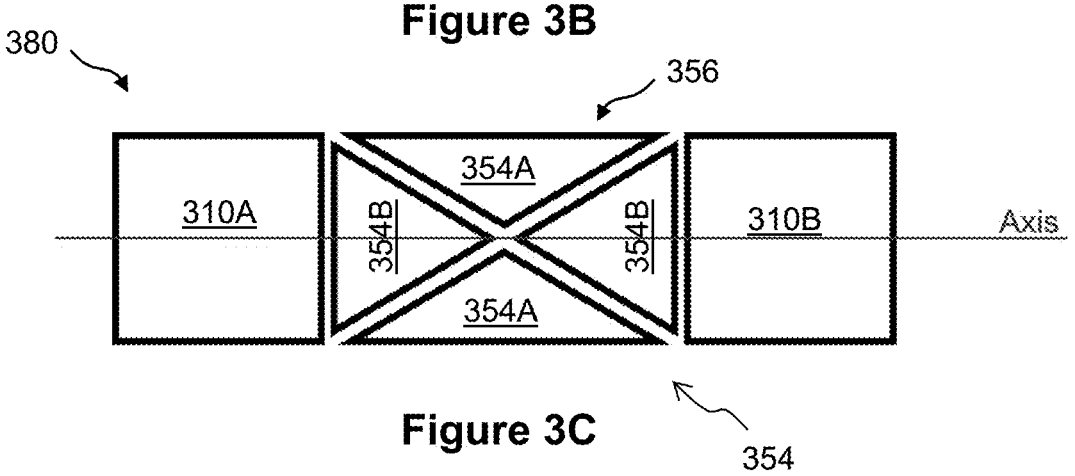

FIG. 3C illustrates an electrode configuration which is substantially similar to the configuration illustrated in FIG. 3A, except that the intermediate electrode configuration 354 is elongated along the direction of the droplet path.

As with other examples, the lateral draining and droplet formation may be further controlled by detecting the volume of the droplet being formed, extent of necking, or other parameters, and effecting droplet formation in a manner which precisely controls the volume of the resulting droplet. Examples of such detection modalities include visual detection, detection based on imaging, and various detection techniques based on electrical properties of the droplet extension (e.g., electrical properties of the droplet extension relative to the surrounding filler fluid). For example, capacitance detection techniques may be used in some embodiments for determining or monitoring the lateral draining and/or droplet formation. Voltage to the necking electrode or electrode configuration may, for example, be controlled based on the detected volume of the droplet being dispensed.

Although the configurations illustrated in FIG. 3 are described with respect to droplet splitting operations in which two daughter droplets are formed having substantially similar volumes, similar configurations may be used for droplet dispensing operations. Generally speaking, and in droplet dispensing operations, the lateral electrodes (e.g., 310A and 310B) will have different sizes. For example, one outer electrode may have the size and shape of a reservoir electrode, while the other may be a standard droplet operations electrode.

Further, while the examples are shown having a single intermediate electrode configuration, multiple intermediate electrode configurations are possible. For example, in one embodiment, an electrode path includes multiple droplet operations electrodes interspersed with one or more intermediate electrode configurations. All electrodes within the group may be activated to cause a droplet to extend along the electrode path. Intermediate electrode configurations, such as those described with reference to FIG. 3, may then be deactivated in a stepwise manner to controllably cause the formation of multiple droplets. As with other configurations, alternative techniques, such as electrode doping, dielectric doping, electrode thickness, dielectric thickness, trace electrodes, counter electrodes, and other techniques may be used to mimic the controllable splitting effected by the described electrode configurations.

Figure 4A:
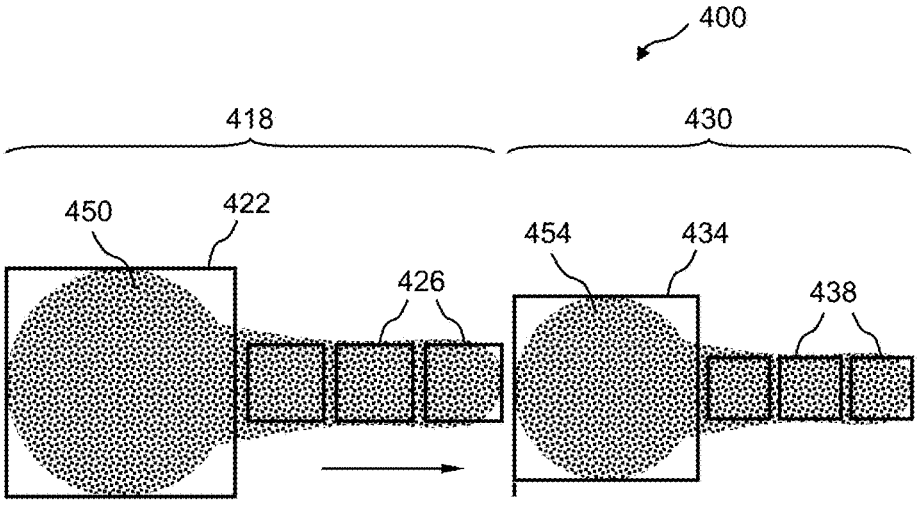
Figure 4B:
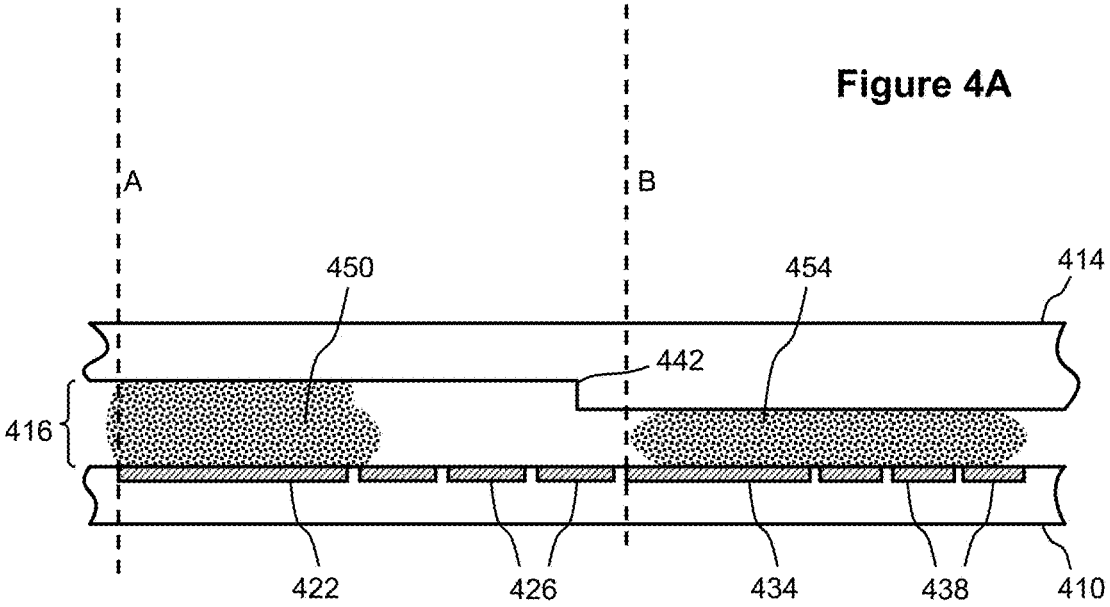

FIGS. 4A and 4B illustrate a top and side view, respectively, of a droplet actuator electrode configuration 400. Electrode configuration 400 provides a process of "staged" droplet dispensing. Droplet actuator 400 includes a bottom substrate 410 and a top substrate 414. Substrates 410 and 414 are arranged in a generally parallel fashion and are separated to provide a gap 416 therebetween. A first droplet dispensing configuration 418 that includes a reservoir electrode 422 that is in proximity with a set of dispensing electrodes 426 (e.g. electrowetting electrodes) is associated with bottom substrate 410. Electrodes 426 of first droplet dispensing configuration 418 are arranged in proximity with a second droplet dispensing configuration 430, such that droplets dispensed by first droplet dispensing configuration 418 may be transported using droplet operations into second droplet dispensing configuration 430. Additional droplet operations electrodes (not shown) may be inserted at position B.

In one embodiment, second droplet dispensing configuration 430 has one or more features which differ from the features of first droplet dispensing configuration 418. For example, second droplet dispensing configuration 430 may include a reservoir electrode which has a size that is different relative to the size of the reservoir electrode of first droplet dispensing configuration 418. Similarly, second droplet dispensing configuration 430 may include droplet operations electrodes which have a size that is different from the size of droplet operations electrodes of first droplet dispensing configuration 418. As another example, second droplet dispensing configuration 430 may include a gap 417 having a height which is different than the height of the gap of first droplet dispensing configuration 418. In various embodiments, some or all of these size differences are present.

Similarly, in certain embodiment, second droplet dispensing configuration 430 has one or more features which are smaller the corresponding features of first droplet dispensing configuration 418. For example, second droplet dispensing configuration 430 may include a reservoir electrode which has a size that is smaller relative to the size of the reservoir electrode of first droplet dispensing configuration 418. Similarly, second droplet dispensing configuration 430 may include droplet operations electrodes which have a size that is smaller relative to the size of droplet operations electrodes of first droplet dispensing configuration 418. As another example, second droplet dispensing configuration 430 may include a gap 417 having a height which is smaller relative to the height of the gap of first droplet dispensing configuration 418. In various embodiments, some or all of these size differences are present.

In another embodiment, second droplet dispensing configuration 430 has features which are substantially identical to the features of first droplet dispensing configuration 418.

Where the gap height of second droplet dispensing configuration 430 differ from the gap height of first droplet dispensing configuration 418, the difference in height may be effected using a variety of means. In one example, the topology of gap 416 may vary by varying the topology of top substrate 414. For example, the thickness of top substrate 414 may vary at a transition point 442 (e.g., a step), such that top substrate 414 has a certain thickness in the region of first droplet dispensing configuration 418 and a different thickness in the region of second droplet dispensing configuration 430. In this example, the height of gap 416 may be inversely proportional to the thickness of top substrate 414. Consequently, gap 416 has a certain height in the region of first droplet dispensing configuration 418 and a different height in the region of second droplet dispensing configuration 430.

Because the volume of droplets that are dispensed within droplet actuator 400 is proportional to the features of the droplet dispensing configurations, such as droplet operations electrode size and or gap height, droplets having different volumes may be dispensed from the differently sized droplet dispensing configurations. For example, in one embodiment, first droplet dispensing configuration 418 is configured to dispense droplets having a larger volume than droplets dispensed from second droplet dispensing configuration 430. In this manner, large droplets may be dispensed from first droplet dispensing configuration 418 and transported onto reservoir electrode 434 of second droplet dispensing configuration 430. Relatively smaller droplets may be dispensed from second droplet dispensing configuration 430.

In this way, droplet actuator 400 provides a mechanism for "staged" droplet dispensing, where, in this example, each successive stage produces a smaller droplet than the previous stage. Droplet actuator 400 is not limited to two droplet dispensing stages only. Droplet actuator 400 may include any number of droplet dispensing stages and, thereby, provide multiple stages for progressing to smaller and smaller droplets. In this manner, scaling from larger fluid volume and larger droplets to smaller fluid volume and smaller droplets may be achieved in the same droplet actuator.

Further, the volume of a droplet dispensed may depend on the volume of liquid atop the dispensing electrode. The staged dispensing approach of the invention may be used to maintain the volume of liquid volume atop the second dispensing electrode within a predetermined range in order to maintain the droplets dispensed from the second dispensing electrode within a predetermined droplet volume. Maintaining the droplets dispensed from the second dispensing electrode within a predetermined droplet volume may result in greater accuracy and/or precision of droplets dispensed using the second dispensing configuration 430.

In operation, electrodes 422 and 426 may be used to dispense daughter droplets having a first volume from droplet 450. Various techniques for dispensing daughter droplets from a parent droplet using a reservoir electrode and droplet dispensing electrodes may be used. In one such technique, electrodes 422 and 426 are activated to extend the parent droplet along the path of electrodes 426. An intermediate one or more of electrodes 426 may be deactivated to yield a daughter droplet on the path of electrodes 426. Intermediate electrodes designed for controllable necking-and-splitting may be used in this embodiment as well. Terminal electrodes designed for controlling dispensed volume may also be included. The daughter droplet may be transported using droplet operations onto reservoir electrode 434.

In this manner, reservoir electrode 434 maybe controllably supplied with liquid. The volume of droplet 454 may thus be established within a predetermined range in order to improve the precision and/or accuracy of droplet dispensing from droplet dispensing configuration 438. Similarly, in embodiments in which gap 416 and/or droplet operations electrodes 438 are smaller along second droplet dispensing configuration 430 relative to droplet operations electrodes 426 along droplet dispensing configuration 418, a smaller volume droplet may be dispensed from droplet dispensing configuration 430. In one example, the droplets that are formed along first droplet dispensing configuration 418 may have microliter volumes and the droplets that are formed along second droplet dispensing configuration 430 may have nanoliter volumes.

Figure 5:
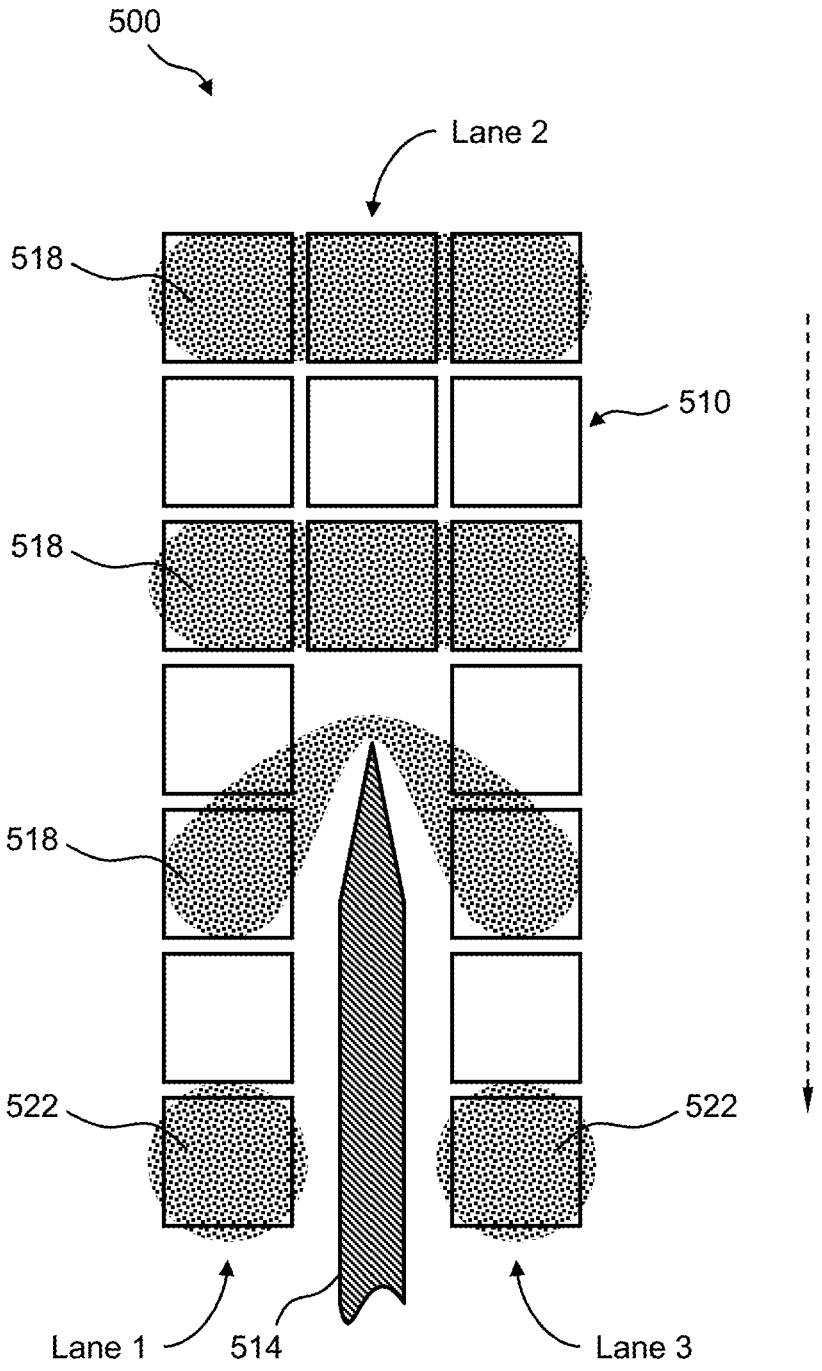
FIG. 5 illustrates a top view of an electrode configuration that uses a physical structure for assisting with a droplet splitting operation in a droplet actuator.

FIG. 5 illustrates a top view of an electrode configuration 500 that uses a physical structure for assisting with a droplet splitting operation in a droplet actuator. Electrode configuration 500 may include a configuration of electrodes 510 (e.g., electrowetting electrodes), such as an array or grid. As illustrated, electrode configuration 500 includes a lane 1, lane 2, and lane 3 of electrodes 510. Additionally physical obstacle 514 is integrated into electrode configuration 500 at lane 2, in place of electrodes 510 in lane 2. In one example, obstacle 514 may be formed of gasket material, e.g., dry film solder mask.

In operation, when an elongated droplet 518 is transported along the grid of electrodes 510, obstacle 514 intersects elongated droplet 518, causing elongated droplet 518 to split into two droplets 522. More specifically, in a first step elongated droplet 518, is formed across three electrodes 510. In a second step elongated droplet 518, is transported via electrowetting operations along electrodes 510 and toward obstacle 514. In a third step, obstacle 514 intersects the elongated droplet 518. In a fourth step, the transport of elongated droplet 518 along electrodes 510 continues until a split occurs due to the action of obstacle 514, which results in the formation of two daughter droplets 522. Obstacle 514 produces a reproducible splitting action that results in daughter droplets each having an approximately identical volume.

In an alternative embodiment, elongated droplet 518 may span any number of electrodes 510 and/or electrodes may have any of a variety of sizes, so that the elongated droplet may be split via obstacle 514 at any of a range of points along elongated droplet 518. In other words, the point at which the droplet splits may be varied to yield daughter droplets, e.g., a 2:1 split ratio, a 3:1 split ratio, a 4:1 split ratio, etc. The physical barrier may be an elongated barrier, such as the one illustrated in FIG. 5, or a shorter barrier, such as a column extending from the bottom substrate to the top substrate of the droplet actuator. The physical barrier may extend from the bottom substrate to the top substrate of the physical barrier or may fill any sufficient space therebetween to cause droplet splitting. Electrodes may be omitted from the region of the physical barrier as illustrated in FIG. 5; in other cases, electrodes may underlie the physical barrier.

Figure 6A:
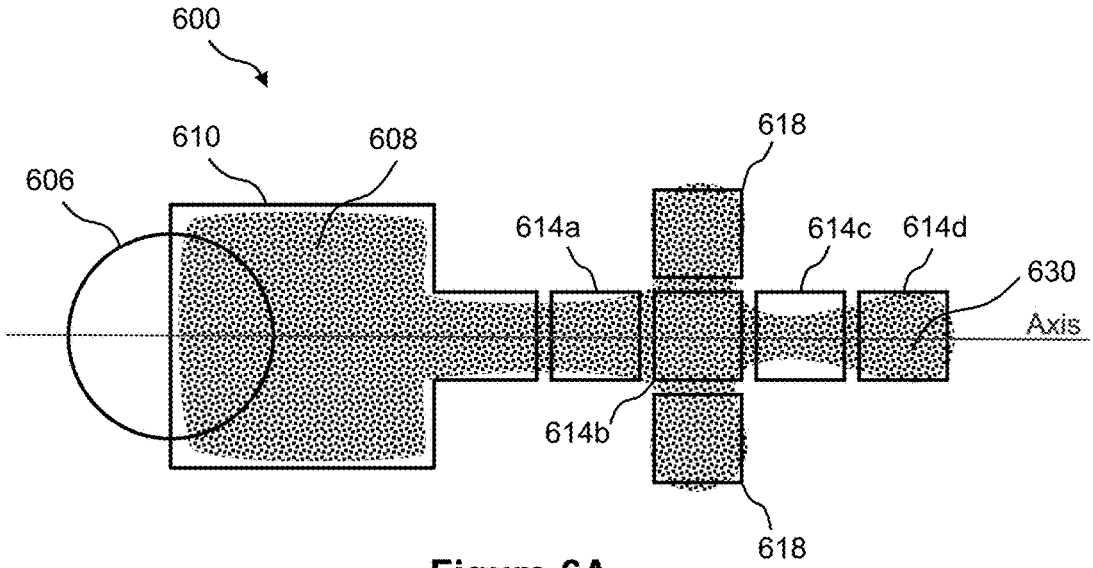
FIGS. 6A and 6B illustrate top views of an electrode configuration for improved dispensing of droplets in a droplet actuator.

FIG. 6A illustrates a top view of an electrode configuration 600 that uses a priming operation in combination with dispensing droplets in a droplet actuator. FIG. 6A shows a priming inlet 606 that is positioned for loading liquid 608 at a reservoir electrode 610, which is in proximity with a path of electrodes 614 (e.g., electrowetting electrodes). Additionally, arranged along the path of electrodes 614 are two lateral electrodes 618, as shown in FIG. 6A. The two lateral electrodes 618 are used (1) to assist the "pulling" back of liquid during the droplet splitting operation and (2) to enhance drainage during the droplet necking-and-splitting operation. Alternatively, it will be appreciated that electrodes 618 may be used to control volume of the dispensed droplet, while electrode 614*a* is used split the droplet.

In operation, initially the path of electrodes 614 (e.g., electrodes 614*a*, 614*b*, 614*c*, and 614*d*) are all activated, and a droplet extension 608 flows from reservoir electrode 610 along electrodes 614*a*, 614*b*, 614*c*, and 614*d*. Lateral electrodes 618 are initially deactivated. Once the droplet extension is formed, a droplet may be dispensed at electrode 614*d* by the activating intermediate electrode 614*c*, which is the intermediate electrode, and activating the two lateral electrodes 618.

A variety of activation sequences of possible. Lateral electrodes 618 may be activated followed by deactivation of intermediate electrode 614*c*. Lateral electrodes 618 may be activated substantially simultaneously with the deactivation of intermediate electrodes 614*c*. Any activation sequence which reliably yields a droplet at electrode 630 may be used in accordance with the invention.

Lateral electrodes 618 may provide "pulling" action which assists the droplet formation at electrode 614*c*. Lateral electrodes 618 may provide locations to which liquid may drain, also assisting with the droplet splitting operation. Controlling the drainage of liquid from the neck of the droplet during the droplet splitting operation may enhance the accuracy and/or precision of dispensed droplet volumes. In an alternative configuration, electrodes 618 may be joined with electrode 614*b* as a single lateral draining electrode.

As with other examples, the control of draining may be effected by a field gradient produced across the lateral draining electrode. For example, the field gradient may cause a lengthening in the droplet extension across the lateral draining electrode as voltage is increased. Examples of other techniques for establishing a field gradient across the lateral electrode are gradients in the dielectric constant of the dielectric material atop the electrode caused by doping or thickness of the dielectric material, using various electrode patterns or shapes. The lateral draining electrode may be provided in any configuration or include any structure or shape which causes the length of the droplet extension to depend on the characteristics of the terminal electrode, such as the voltage applied to the terminal electrode. For example, the electrode may be vertically thicker centrally and thinner towards the lateral extensions. Further, various embodiments may be provided in which one or more counter electrodes are also utilized to control the length of the droplet extension across the terminal electrode.

As with other examples, the lateral draining and droplet formation may be further controlled by detecting the extent of the droplet extension and effecting droplet formation when the droplet extension has achieved a certain predetermined length. Examples of such detection modalities include visual detection, detection based on imaging, and various detection techniques based on electrical properties of the droplet extension (e.g., electrical properties of the droplet extension relative to the surrounding filler fluid). For example, capacitance detection techniques may be used in some embodiments for determining or monitoring the lateral draining and/or droplet formation. Voltage to the lateral draining electrode or electrodes may, for example, be controlled based on the detected volume of the droplet being dispensed.

Figure 6B:
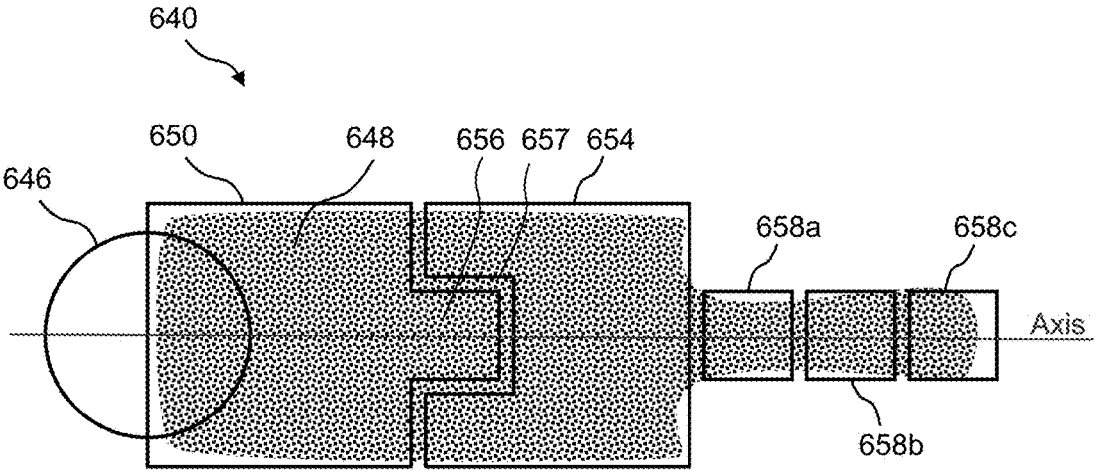

FIG. 6B illustrates a top view of an electrode configuration 640. FIG. 6B shows a priming inlet 646 that is configured for loading liquid 648 at a reservoir electrode 650. The priming inlet may, for example, the provided in a top substrate of the droplet actuator. Reservoir electrode 650 is in proximity with a second reservoir electrode 654 in order to form a reservoir electrode pair. In some embodiments, reservoir electrodes 650 and 654 may have an interlocking tongue(656)-and-notch(657) geometry or interdigitations along their common border. Reservoir electrode 654 is in proximity with a path of electrodes 658 (e.g., electrowetting electrodes) arranged for dispensing droplets from reservoir electrode 645.

In operation, electrodes 658 (e.g., electrodes 658*a*, 658*b*, and 658*c*) are activated to form droplet extension 648, as liquid from reservoir electrode 650 and reservoir electrode 654 flows along electrodes 658*a*, 658*b*, and 658*c*. Upon formation of the droplet extension, a droplet may be dispensed at electrode 658*b* by deactivating intermediate electrode 658*a*. Electrode 658*c* may remain activated to provide a "pulling" action which assists the droplet splitting operation. Consequently, a droplet (not shown) may be formed at electrodes 658*b* and 658*c*.

Figure 7A:
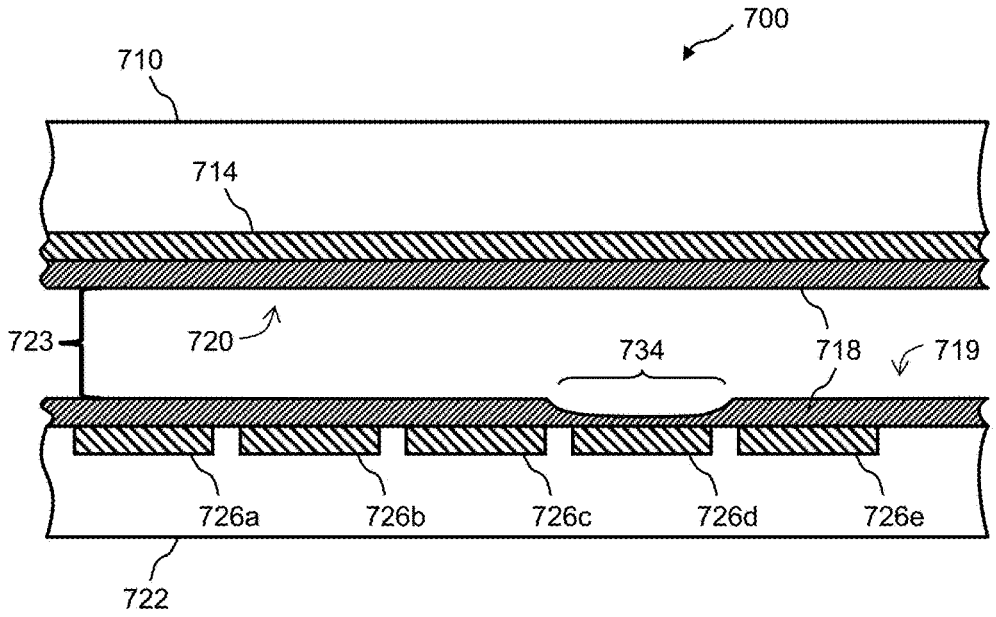
FIGS. 7A and 7B illustrates side views of a droplet actuator configured for providing improved droplet dispensing by reconfiguring gap topology at a designated target electrode.

FIG. 7A illustrates a side view of a droplet actuator 700 configured for providing improved droplet dispensing by modifying gap topology at a designated target electrode. Droplet actuator 700 includes a top substrate 710 and a bottom substrate 722. Top substrate 710 is separated from bottom substrate 722 by a gap 723. Top substrate 710 is associated with a ground electrode 714 configured to serve as a ground for a droplet provided in the gap. Bottom substrate 722 includes droplet operations electrodes 726, configured in a manner appropriate for conducting one more droplet operations in the gap. Both substrates include a dielectric layer 718 facing the gap, and as is typical for droplet actuators, the dielectric layer may be hydrophobic or may be coated with a hydrophobic coating (not shown). A droplet 740 (in FIG. 7B) situated in gap 723 may be subjected to droplet operations on droplet operations surface 719.

The invention provides a recessed region 734, such as a divot, in the droplet operations surface 719 and/or in the top surface 720. Recessed region 734 may be situated atop one of more of the droplet operations electrodes. For example, as illustrated, recessed region 734 is situated atop electrode 726*d*. Recessed region 734 may be configured in a manner which stabilizes a droplet atop the electrode. For example, recessed region 734 may be configured in a manner which stabilizes a droplet atop the electrode during a droplet splitting operation.

Recessed region 734 may be any variation in the physical topology at the surface of the substrate generally atop an electrode in a manner which enhances stability of a droplet at the electrode relative to a corresponding configuration which lacks the recessed region. Any configuration which provides a recessed region sufficient to enhance stability of a droplet at the electrode will suffice. The size and shape of the recessed region may vary. The recessed region may correspond generally with the shape and size of the associated electrode; however, it is not necessary for the shape and size of the recessed region to exactly correspond with the shape and size of the associated electrode. Sufficient overlap to provide enhanced stability of the droplet that the electrode will suffice. The size and shape of the recessed region may be selected to enhance the accuracy and/or precision of dispensed droplet volumes.

Figure 7B:
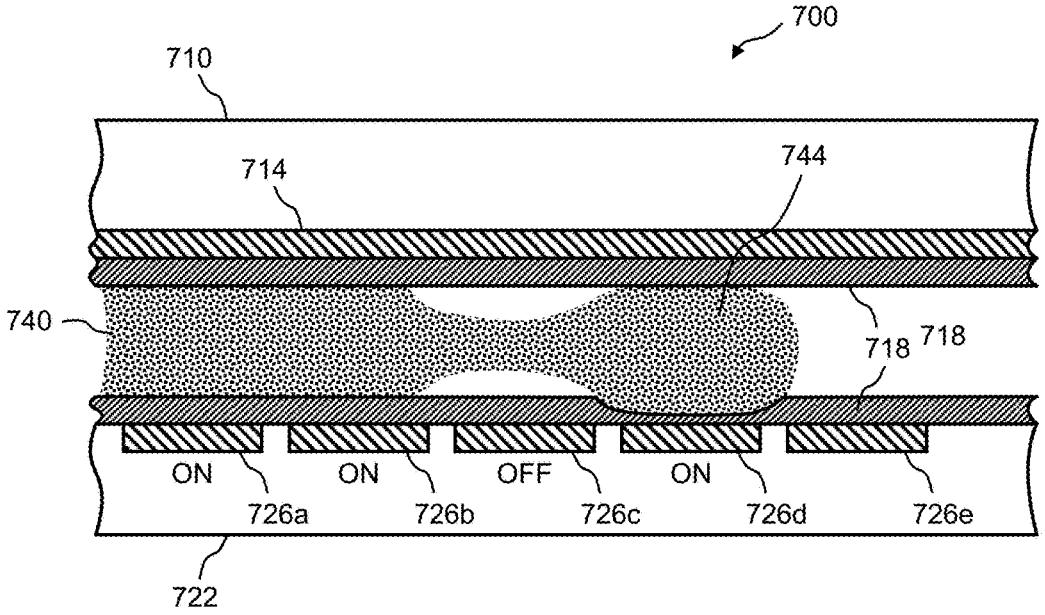

FIG. 7B illustrates a side view of droplet actuator 700 when in use during a droplet dispensing operation. In operation, electrodes adjacent to the electrode which is associated with the recessed region may be activated, and an intermediate electrode may be deactivated to cause the formation of a droplet situated in the recessed region. As illustrated, electrodes 726*a*, 726*b*, 726*c*, and 726*d* are activated to cause a droplet extension to flow across the active in electrodes. Electrode 726*c* is deactivated to cause formation of a droplet in recessed region 734 atop electrode 726*d*. Because of the larger gap at indent 734, the liquid inherently tends to stay in indent 734. Also a pressure difference at indent 734 tends to pull the droplet or cause the droplet to flow into indent 734.

Multiple recessed regions may be provided. For example, a recessed region may be provided atop electrodes 726*b* (not shown) and 726*d* (as shown). A droplet may be provided atop activated electrodes 726*b*, 726*c* and 726*d*. Electrode 726*c* may be deactivated to cause splitting of the droplet, yielding to daughter droplets, one in recessed region 734 atop electrode 726*d*, and another in the recessed region (not shown) atop electrode 726*b*. The size and shape of the recessed regions may be selected to enhance the accuracy and/or precision of the daughter droplet volumes.

A variety of alternative configurations will be apparent to one of skill in the art on consideration of the disclosure provided herein. For example, the recessed region may in some embodiments be associated with multiple electrodes. A recessed region may be associate with 2, 3, 4 or more electrodes. A droplet splitting operation may produce a droplet which lies atop 2, 3, 4 or more electrodes within such an extended recessed region. In another embodiment, a single droplet actuator may include a variety of recessed regions having different sizes and/or associated with different numbers of electrodes. The recessed region may be provided as an indentation in the dielectric layer. The region may be provided as an indentation in the dielectric layer and the electrode. The region may be provided as an indentation in the dielectric layer the electrode, and the substrate material. The region may be provided as an indentation in the dielectric layer and the substrate material. A recessed region may be provided in the bottom substrate, the top substrate, or both top and bottom substrates.

FIG. 8 illustrates another embodiment for controlling necking-and-splitting during a droplet splitting or dispensing process. In this embodiment, the necking-and-splitting electrode includes a wire trace in which the wires are more densely spaced in the central region and more sparsely spaced in the outer region. As voltage applied to the necking-and-splitting electrode is reduced, the diameter of the neck is controllably reduced, thereby enhancing the accuracy and/or precision of the daughter droplet volumes. The figure also illustrates alternative configurations for arranging the intermediate necking-and-splitting electrode, which may be used with any of the other embodiments described herein. Voltage may be applied at any point along the trace. In one embodiment, the contact for applying voltage to the trace is generally centrally located.

Figure 8A:
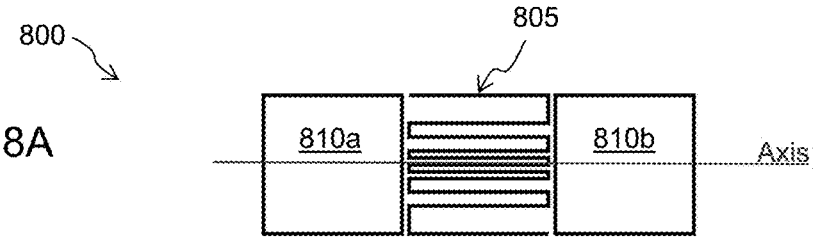
FIGS. 8A and 8B illustrate another embodiment of the invention for controlling necking-and-splitting during a droplet splitting or dispensing process, in which the necking-and-splitting electrode includes a wire trace.

FIG. 8A illustrates an arrangement suitable for droplet splitting. Electrode configuration 800 includes droplet operations electrodes 810*a* and 810*b* flank necking-and-splitting electrode 805. In operation, all three electrodes may be activated to cause a droplet to extend across the electrode configuration 800. Voltage applied to electrode 805 may be gradually reduced to control necking-and-splitting of the droplet, yielding two daughter droplets atop electrodes 810*a* and 810*b*.

Figure 8B:
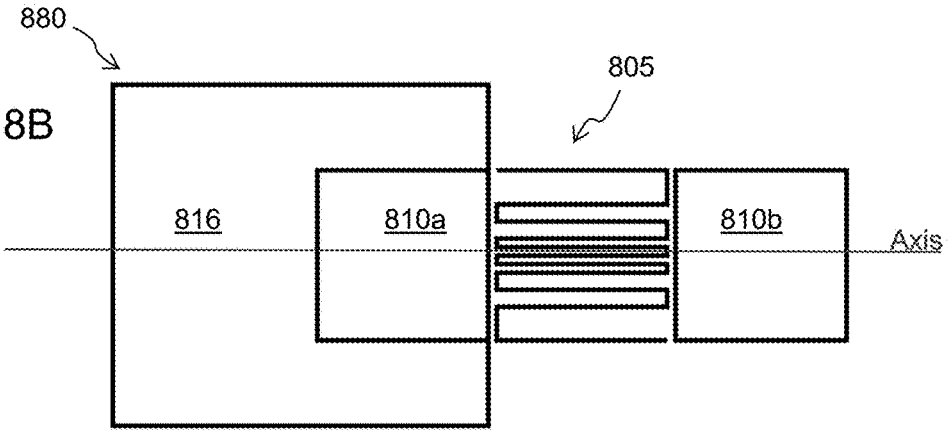

FIG. 8B illustrates an arrangement suitable for droplet dispensing. Electrode configuration 840 includes reservoir electrode 816, inset droplet operations electrode 810*a*, necking-and-splitting electrode 805 and couple operations electrode 810*b*. Reservoir electrode 816 is adjacent to droplet operations electrode 810*a*, which is adjacent to necking-and-splitting electrode 805, which is adjacent to droplet operations electrode 810*b*. In operation, a droplet may be supplied atop reservoir electrode 816. All the electrodes in configuration 840 may be activated, causing a droplet extension to extend from reservoir electrode 816, flowing across electrodes 805 and 810*b*. Voltage applied to electrode 805 may be gradually reduced to control necking-and-splitting of the droplet, yielding a droplet atop electrode 810*b*.

It will be appreciated that the trace electrode in these configurations may be replaced with other electrodes described herein for controlling necking and splitting. Other techniques described herein for creating a field gradient may be used to replace the trace electrode. Further, as with other embodiments, droplet formation and related parameters may be monitored, and voltage applied to the splitting electrode may be controlled to enhance precision and/or accuracy of dispensed droplet volume.

FIG. 9 illustrates an electrode configuration 900 that is similar to electrode configuration 200 illustrated in FIG. 2. Configuration 900 includes an intermediate necking-and-splitting electrode configuration 905 flanked by two droplet operations electrodes 910. The necking-and-splitting electrode configuration 905 includes inner I-shaped electrode 905*a* and outer electrodes 905*b*. In operation, all electrodes of electrode configuration 900 may be activated to form an elongated droplet across the top of the electrode configuration. Electrodes 905*b* may be deactivated to initiate necking of the elongated droplet. Electrode 905*a* may be deactivated to initiate splitting of the elongated droplet, yielding two daughter droplets atop electrodes 910. Controlling the drainage of liquid from the neck of the droplet during the droplet splitting operation may enhance droplet volume accuracy and/or precision.

Figure 10:
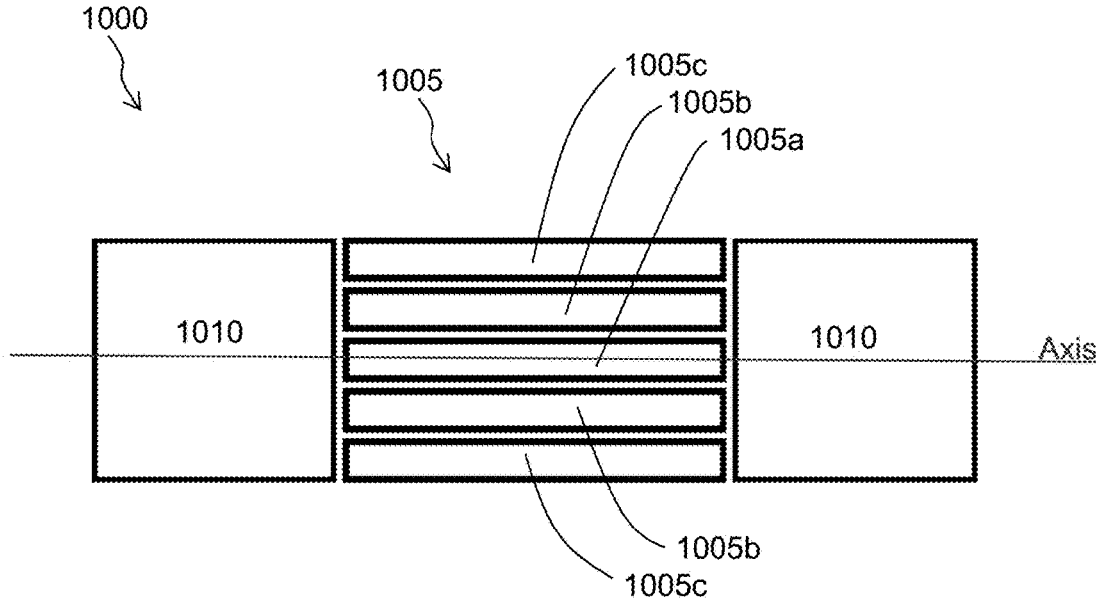
FIG. 10 illustrates an electrode configuration that includes an intermediate necking-and-splitting electrode configuration flanked by droplet operations electrodes.

FIG. 10 illustrates an electrode configuration 1000 that is similar to electrode configuration 300 illustrated in FIG. 3. Configuration 1000 includes an intermediate necking-and-splitting electrode configuration 1005 flanked by two droplet operations electrodes 1010. The necking-and-splitting electrode configuration includes a series of generally linear or elongated electrodes, including central electrode 1005*a*, intermediate flanking electrodes 1005*b*, and outer flanking electrodes 1005*c*. In operation, all electrodes of electrode configuration 1000 may be activated to form an elongated droplet across the top of the electrode configuration. Outer flanking electrodes 1005*c* may be deactivated to initiate the necking process. Intermediate flanking electrodes 1005*b* may be deactivated to continue the necking process. Central electrode 1005*a* may be initiated to complete the splitting process, yielding two droplets atop electrodes 1010. Controlling the drainage of liquid from the neck of the droplet during the droplet splitting operation may enhance droplet volume accuracy and/or precision.

Figure 11A:
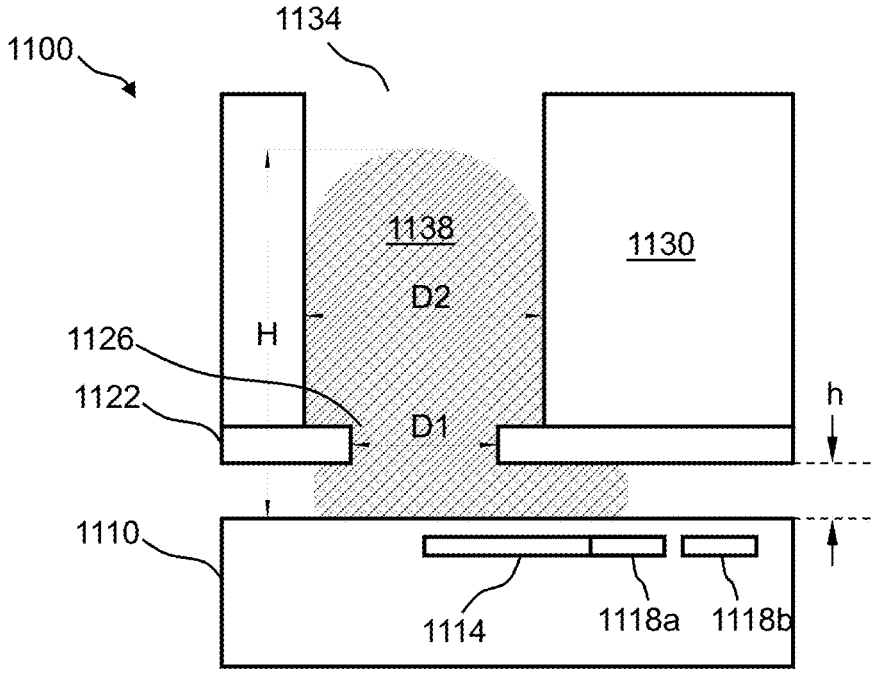
FIGS. 11A and 11B illustrate a side view and top view, respectively, of a section of a droplet actuator configured to include a reservoir associated with top substrate for loading/unloading operations fluid.
Figure 11B:
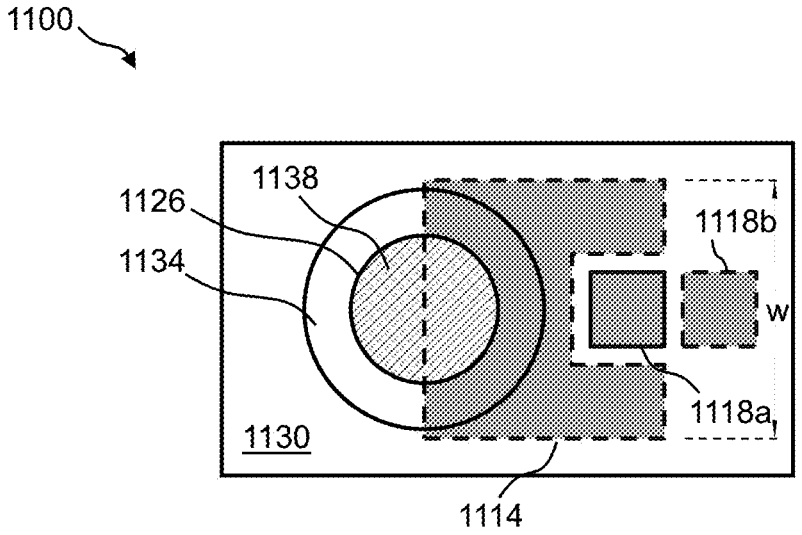

FIGS. 11A and 11B illustrate a side view and top view, respectively, of a section of droplet actuator 1100. Droplet actuator 1100 includes a reservoir substrate 1130 associated with top substrate 1122 for operations fluid I/O. Reservoir substrate 1130 may be integral with or coupled to top substrate 1122. Droplet actuator 1100 includes a bottom substrate 1110 that includes a reservoir electrode 1114. Reservoir electrode 1114 feeds an arrangement of electrodes 1118 (e.g., electrowetting electrodes 1118*a* and 1118*b*). Top substrate 1122 includes an opening 1126 that provides a path suitable for transferring fluid from reservoir 1134 into proximity with or contact with electrode 1114. Reservoir substrate 1130 includes a reservoir 1134 (which may be enclosed, partially enclosed or open). A quantity of sample fluid 1138 operations fluid 1138 may be held in reservoir 1134.

Various parameters in the configuration may be adjusted to control dispensing results. Examples of such parameters include: the gap h between bottom substrate 1110 and top substrate 1122; the width w of reservoir electrode 1114; the diameter D1 of opening 1126 in top substrate 1122; the diameter D2 of reservoir 1134 and the general geometry of reservoir; the height H of operations fluid 1138 in the reservoir 1134; the surface tension $\gamma o$ of filler fluid; the surface tension F1 of operations fluid 1138; the interfacial tension $\gamma LO$ of operations fluid 1138 with filler fluid; the critical surface tension $\gamma solid$ of droplet actuator surfaces; the liquid contact angle $\theta s$ on droplet actuator surface; the critical surface tension $\gamma well$ of reservoir substrate wall; the liquid contact angle $\theta w$ on the reservoir substrate wall; the applied voltage V; the contact angle $\theta V$ at the applied voltage; the applied voltage type i.e., AC or DC; the oil meniscus level; the position of the opening in the top substrate in relation to the reservoir electrode; and the electrode switching sequence.

Depending on the function of the reservoir (i.e., input or output) it may be beneficial to adjust the opening in the top substrate (and the reservoir) relative to the reservoir electrode. For example, in order to act as a waste reservoir, the opening is preferably positioned overlapping the first electrode that is adjacent to the reservoir electrode, e.g., as illustrated in FIG. 12. A combination of this opening position and the electrode switching sequence used in the "disposal" operation prevents any inadvertent dispensing from this reservoir.

The waste reservoir may be made as large as possible to accommodate a large volume of waste. Making the reservoir large lowers the pressure at the reservoir, which allows the discarded liquids to easily flow into the reservoir and prevents inadvertent dispensing from the waste reservoir. More details of one example reservoir position are described with reference to FIGS. 2A, 2B, 2C, and 2D.

FIGS. 12A, 12B, 12C, and 12D illustrate a side view of a droplet actuator 1200. Droplet actuator 1200 includes a reservoir substrate over the top substrate for operations fluid I/O. Droplet actuator 1200 is substantially the same as droplet actuator 1100 of FIGS. 1A and 1B, except that droplet actuator 1200 has a certain reservoir(1134)-to-opening(1126) position that is suited for disposing of droplets (e.g., droplet 1210) by use of certain electrode switching sequences. It is preferable for the waste droplet to be unit sized (diameter nominally the size of unit electrode) or two times the unit size (2×). The waste droplet may in some embodiments be several times the unit size. For disposing a 2× droplet the switching sequence is changed such that two electrodes are kept ON at a time: OFF ON ON; ON ON OFF; ON OFF OFF; OFF OFF OFF.

In a simpler embodiment the opening in the top substrate substantially overlaps the first electrode and the reservoir electrode is not necessary. In this case the switching sequence for 1× droplets is OFF ON; ON OFF; OFF OFF; and the switching sequence for a 2× droplet is ON ON; ON OFF; OFF OFF. Alternatively, the 1× or 2× droplet switching sequence may be used for larger droplets. This embodiment may also be used with a fourth electrode (not shown) for dispensing droplets, e.g., using a switching sequence: ON ON OFF OFF; ON ON ON OFF; ON OFF OFF ON.

Figures 12A, 12B, 12C, 12D:
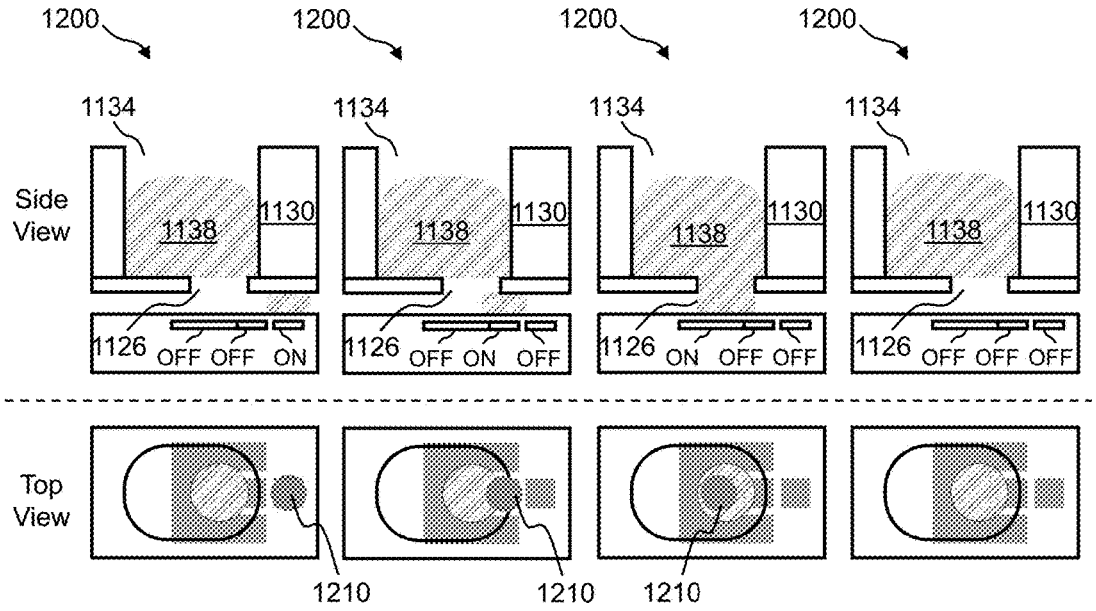

FIG. 12A shows a first step of the sequence, wherein reservoir electrode 114 is turned OFF, electrode 1118*a* is turned OFF, and electrode 1118*b* is turned OFF. In this step, the quantity of operations fluid 1138 is retained in reservoir 1134. FIG. 2B shows a second step of the sequence, wherein reservoir electrode 1114 is turned ON, electrode 1118*a* is turned OFF, and electrode 1118*b* is turned OFF. In this step, a quantity of operations fluid 1138 is pulled from reservoir 1134, through opening 1126, and onto reservoir electrode 1114. FIG. 2C shows a third step of the sequence, wherein reservoir electrode 1114 is turned OFF, electrode 1118*a* is turned ON, and electrode 1118*b* is turned OFF. In this step, droplet 1210 is dispensed from reservoir electrode 1114 and onto electrode 118*a* due to the pulling action of electrode 118*a*. FIG. 2D shows a fourth step of the sequence, wherein reservoir electrode 1114 is turned OFF, electrode 1118*a* is turned OFF, and electrode 118*b* is turned ON. In this step, droplet 1210 is transported from electrode 118*a* to electrode 118*b* due to the pulling action of electrode 1118*b*.

Another example switching sequence is: ON ON OFF OFF; ON ON ON OFF; OFF ON ON ON; ON OFF OFF ON. The third state "OFF ON ON ON" with the reservoir electrode OFF allows for the finger to be extended easily up to the $4^{th}$ electrode. In typical operation, this state is maintained for only a fraction of a second (e.g., about ¼ or about ⅛ sec).

In order to enter the waste well 1134, the droplet must first overcome the pressure difference between the reservoir and the top substrate opening and then overcome the pressure difference between the opening and the inside of the droplet actuator. These pressure differences may be overcome by the hydrostatic head created by the droplet.

The invention also provides embodiments in which the reservoir diameter is large enough to accept small, medium, and large volume pipette tips, without having to use specialized small diameter gel loading tips. In some embodiments the reservoir diameter should be larger than about 1 millimeter (mm) In order to further avoid wetting of the top surface of the reservoir substrate, the diameter of the reservoir may be larger, depending for example, on the volume of liquid to be loaded. A reservoir diameter that is greater than or equal to about 2 mm is sufficient a large range of input volumes, e.g., from about 5 μl to about 5000 μL, or from about 10 μL to about 2000 μL, or from about 50 μL to about 1500 μL.

In one configuration, the reservoir is cylindrical. The reservoir may be centered around the opening in the top substrate, as shown in droplet actuator 1100 of FIGS. 11A and 11B. The diameter of the opening in the top substrate is typically between about 1 mm and about 2 mm. The reservoir substrate diameter is typically greater than or equal to about 1.5 mm. The hydrostatic head that is required increases with the diameter, but asymptotically approaches a constant value that is a function of the liquid-oil interfacial tension, liquid-solid contact angle, applied voltage, and gap between the top substrate and the bottom substrate. There is also a hydrostatic head which, when exceeded, may cause the liquid to spontaneously flow into the gap between the bottom and top substrate. It is preferable to keep the head below this value.

The graph shown in FIG. 16 shows typical behavior of the hydrostatic head requirement while varying the diameter of the reservoir well. The head required asymptotically approaches a constant value with increasing diameter. The region between the two curves (with and without voltage) is the preferred region for dispensing. A head less than the lower curve may interfere with loading of liquid into the droplet actuator, and a head greater than the upper curve may cause causes liquid to flow in spontaneously. The dead volume increases with diameter; however, the number of droplets per additional mm of liquid also increases correspondingly. For a given reservoir substrate height this means that the number of droplets increases.

Table 1 below shows experimental data for two different opening diameters for an immunoassay wash buffer (e.g., for conducting bead washing operations). The opening in the top substrate was about 2 mm. The gap between the top substrate and the bottom substrate was about 200 um. The oil was about 0.1% Triton X-15 in 2cSt silicone oil and was added in excess. The reservoir substrate was about 0.250 inches (in) thick.

TABLE 1

| Reservoir diameter | Loaded volume | Dead volume | Number of droplets |
|---|---|---|---|
| 2 mm | 20 μL | 10-15 μL | 15-25 |
| 3 mm | 40 μL | 20-25 μL | 50-60 |

FIG. 13 illustrates a side view of a droplet actuator 1300. Droplet actuator 1300 is substantially the same as droplet actuator 1100 of FIGS. 11A and 11B, except that reservoir substrate 1130 of droplet actuator 1100 is replaced with a reservoir substrate 1310. Reservoir substrate 1310 includes reservoir 1134 which includes a larger diameter region 1318 having a diameter D3 and a restricted diameter region 1314 having a restricted diameter D2. Reservoir 1134 also includes a tapering transition region 1319, in which the diameter of reservoir 1134 tapers from diameter D3 to diameter D2.

The height (H1) of restricted region 1314 may be larger than the "dead height" that corresponds to the dead volume for a reservoir that has diameter D2. The height (H3) of the reservoir substrate 1310 may be larger than the "dead height" (H2) for a reservoir that has diameter D3. Because D2 is smaller than D3, the overall dead volume is small. Because D3 is large, the number of droplets generated may be large. For example, using H1=0.125 in, H3=0.250 in, D2=1.5 mm, and D3=4 mm the final dead volume is from about 5 μL to about 10 μL, while being able to dispense about 100 droplets from an initial operations fluid volume of about 40 μL.

Though the final dead volume is from about 5 μL to about 10 μL, an initial "activation" volume of liquid may be needed to overcome the pressure difference between D3 and D2. For the case where D3=4 mm and D2=1.5 mm, this "activation" volume was found to be from about 15 μL to about 20 μL. This "activation volume" may be reduced by decreasing D3 or increasing D2.

Referring again to FIG. 13, as a specific embodiment of this design, H1 is about equal to the "dead height" H2 that is required for larger diameter region 1318. The entire capacity of larger diameter region 1318 is then available for dispensing droplets. In another embodiment H1 is equal to the asymptotic value of "dead height" as illustrated above.

FIGS. 14A and 14B illustrate a side view and top view, respectively, of a droplet actuator 1400. Droplet actuator 1400 is substantially the same as droplet actuator 1300 of FIG. 13, except that reservoir substrate 1310 of droplet actuator 1300 is replaced with a reservoir substrate 1410, with a constricted region 1414 providing fluid communication between a larger diameter region 1418 of reservoir 1134 and opening 1126. Constricted diameter region 1414 may in some embodiments be cylindrical with a diameter D2. Larger diameter region 1418 may in some embodiments be elongated (e.g., elliptical) with a first dimension D3*a* and a second dimension D3*b*, as shown in FIGS. 4A and 4B. This configuration may increase the capacity of the wells further and the resulting number of available droplets without significantly increasing the dead volume. As compared with droplet actuator 1300 of FIG. 13, the dimension of the larger reservoir region 1418 is increased in one dimension (e.g., D3*b*) while keeping the other dimension (e.g., D3*a*) substantially the same as D3 of droplet actuator 1300.

FIG. 15 illustrates a top view of a droplet actuator 1500. Droplet actuator 1500 is substantially the same as droplet actuator 1400 of FIGS. 14A and 14B, except that reservoir substrate 1410 of droplet actuator 1400 is replaced with a reservoir substrate 1510. Reservoir substrate 1510 includes restricted volume region 1514 and a main volume region 1518 which is elongated having a first dimension D3*a* and which tapers along a second dimension D3*b* such that a cross-section of the volume tapers in a direction which is distal with respect to the restricted volume region 1514. Restricted volume region 1514 provides a fluid path from main volume region 1518 to opening 1126 and into the gap of the droplet actuator.

Referring to FIGS. 11A through 15, the use of a spacer may be used in order to prevent liquid from spontaneously flowing into the droplet actuator. For example, a spacer pattern around the reservoir, which narrows down to an approximately one-electrode opening, reduces the chances of liquid from spontaneously flowing into the droplet actuator in an uncontrolled manner. The top substrate and reservoir substrate may be fabricated separately or as one piece of material. Alternative embodiments of the invention may be implemented using a "hybrid" top substrate in which the liquid is loaded around the edge of the glass.

Increasing the gap h reduces "dead height" and correspondingly the dead volume. However increasing the gap may adversely affect other processes, such as splitting, and causes an increase in droplet volume. The width w of the reservoir is preferably larger than the unit electrode. The gap height should not be so great as to cause undue interference with droplet operations, such as droplet dispensing and droplet splitting, for which the droplet actuator is intended.

Lowering the surface tension $\gamma_o$ of the filler fluid may improve the loading process significantly by lowering the interfacial tension of the liquid with the filler fluid. This is the most effective way of reducing dead volume because it improves the loading of all operations fluids. However, extremely low values of surface tension may result in emulsification of the droplets in the filler fluid. The surface tension of the filler fluid should not be lowered to the extent that any resulting emulsification of droplets in the filler fluid is sufficient to cause undue interference with the droplet operations for which the droplet actuator is intended.

Lowering the surface tension $\gamma_L$ of the droplet improves the loading process significantly by lowering the interfacial tension of the liquid with the oil. However lower surface tension may also causes the liquid to wet the solid surface more. The surface tension of the droplet should not be sufficiently reduced to cause undue interference with the droplet operations for which the droplet actuator is intended.

A higher contact angle $\theta_w$ on the reservoir substrate wall enhances loading. A lower contact angle is preferred for disposal. Higher applied voltage $\theta_v$ causes a larger contact angle change and aids loading. Contact angle hysteresis is reduced using AC voltage and loading is enhanced.

The oil meniscus level has a significant effect on the loading process. Reducing the oil level in the wells to a point at which the liquid in the reservoir has an interface with air significantly improves loading. This is because a liquid-air interface has a higher interfacial tension and a correspondingly higher Laplace pressure than a liquid-oil interface. A higher Laplace pressure at the reservoir reduces the pressure difference that needs to be overcome.

9 CONCLUDING REMARKS

The foregoing detailed description of embodiments refers to the accompanying drawings, which illustrate specific embodiments of the invention. Other embodiments having different structures and operations do not depart from the scope of the present invention. This specification is divided into sections for the convenience of the reader only. Headings should not be construed as limiting of the scope of the invention. The definitions are intended as a part of the description of the invention. It will be understood that various details of the present invention may be changed without departing from the scope of the present invention. Furthermore, the foregoing description is for the purpose of illustration only, and not for the purpose of limitation, as the present invention is defined by the claims as set forth hereinafter.

We claim:

1. A droplet actuator comprising:

a top substrate comprising a reservoir integral with the top substrate;

a bottom substrate separated from the top substrate to form a gap;

droplet transport electrodes proximal to the top substrate and/or the bottom substrate in a manner which permits the droplet transport electrodes to conduct one or more electrowetting-mediated droplet transport operations;

a reservoir electrode proximal to the bottom substrate in a manner which permits, in combination with the droplet transport electrodes, a droplet extension to flow out of a volume of fluid at the reservoir electrode, wherein the reservoir electrode is larger than the droplet transport electrodes;

a fluid path comprising an opening in the top substrate and configured for flowing fluid from the reservoir into the gap; and wherein the opening has a diameter D1 and the reservoir has a diameter D2, and wherein D2 is smaller than D1;

wherein the diameter D1 is at least twice as large as height of the gap: and wherein the droplet actuator is configured such that fluid flowing through the fluid path flows from the reservoir across the opening into the gap and is positioned as a volume of fluid atop the reservoir electrode until a voltage is applied to one or more of the droplet transport electrodes.

2. The droplet actuator of claim 1 wherein the opening overlaps an edge of the reservoir electrode.

3. The droplet actuator of claim 1 wherein D1 is in a range of about 1 mm to about 2 mm.

4. The droplet actuator of claim 1 wherein D2 is greater than about 1 mm.

5. The droplet actuator of claim 1 wherein the gap height is about 200 um.

6. The droplet actuator of claim 1 wherein the reservoir has a volume sufficient to hold a volume of liquid ranging from about 5 μl to about 5000 μL.

7. The droplet actuator of claim 1 wherein the reservoir has a volume sufficient to hold a volume of liquid ranging from about 10 μL to about 2000 μL.

8. The droplet actuator of claim 1 wherein the reservoir has a volume sufficient to hold a volume of liquid ranging from about 50 μL to about 1500 μL.

9. The droplet actuator of claim 1, wherein the reservoir has dimensions which are substantially cylindrical.

10. The droplet actuator of claim 9 wherein the opening is substantially aligned about an axis of the cylindrical dimensions of the reservoir.

11. The droplet actuator of claim 1, wherein the gap comprises a filler fluid.

12. The droplet actuator of claim 11 wherein the filler fluid comprises an oil.

13. The droplet actuator of claim 1 wherein the droplet actuator is configured such that in response to the voltage applied to the one or more of the droplet transport electrodes, the droplet extension comprising a controlled volume of fluid that is a fraction of the volume of fluid atop the reservoir electrode flows out of the volume of fluid to form a droplet, where the droplet is subjected to the one or more electrowetting-mediated droplet transport operations mediated by the one or more of the droplet transport electrodes.

14. A droplet actuator comprising:

a top substrate comprising a reservoir integral with the top substrate, wherein the reservoir comprises a restricted region having a reduced diameter relative to a main volume region of the reservoir;

a bottom substrate separated from the top substrate to form a gap;

droplet transport electrodes proximal to the top substrate and/or the bottom substrate in a manner which permits the droplet transport electrodes to conduct one or more electrowetting-mediated droplet transport operations;

a reservoir electrode proximal to the bottom substrate in a manner which permits, in combination with the droplet transport electrodes, a droplet extension to flow out of a volume of fluid at the reservoir electrode, wherein the reservoir electrode is larger than the droplet transport electrodes;

a fluid path comprising an opening in the top substrate and configured for flowing fluid from the reservoir into the gap; and wherein the opening has a diameter D1, the restricted region has a diameter D2, and the main volume region has a diameter D3, and wherein D1 is larger than D2 and D3 is larger than D1;

wherein the diameter D1 is at least twice as large as height of the gap; and wherein the droplet actuator is configured such that fluid flowing through the fluid path flows from the reservoir across the restricted region and across the opening into the gap and is positioned as a volume of fluid atop the reservoir electrode until a voltage is applied to one or more of the droplet transport electrodes.

15. The droplet actuator of claim 14 wherein the restricted region of the reservoir provides a fluid path between the main volume region of the reservoir and the opening.

16. The droplet actuator of claim 14 wherein D1 is in the range of about 1 mm to about 2 mm.

17. The droplet actuator of claim 14 wherein D2 is about 1.5 mm.

18. The droplet actuator of claim 14 wherein D3 is about 4 mm.

19. The droplet actuator of claim 14 wherein the reservoir further comprises a tapering transition region wherein the reservoir diameter tapers from D3 to D2.

20. The droplet actuator of claim 14 wherein the droplet actuator is configured such that in response to the voltage applied to the one or more of the droplet transport electrodes, a droplet extension comprising a controlled volume of fluid that is a fraction of the volume of fluid atop the reservoir electrode flows out of the volume of fluid to form a droplet, where the droplet is subjected to one or more electrowetting-mediated droplet transport operations mediated by the one or more of the droplet transport electrodes.

* * * * *